US005278038A

United States Patent [19]

Miyoshi et al.

[11] Patent Number: 5,278,038

[45] Date of Patent: * Jan. 11, 1994

[54] LIGHT-SENSITIVE SILVER HALIDE COLOR PHOTOGRAPHIC MATERIAL

[75] Inventors: Masanobu Miyoshi; Makoto Kajiwara; Kaoru Onodera, all of Odawara, Japan

[73] Assignee: Konishiroku Photo Industry Co., Ltd., Tokyo, Japan

[ * ] Notice: The portion of the term of this patent subsequent to Nov. 18, 2003 has been disclaimed.

[21] Appl. No.: 679,937

[22] Filed: Apr. 3, 1991

Related U.S. Application Data

[60] Division of Ser. No. 569,778, Aug. 21, 1990, Pat. No. 5,023,170, which is a continuation of Ser. No. 851,778, Apr. 14, 1986, abandoned.

[30] Foreign Application Priority Data

Apr. 22, 1985 [JP] Japan ..... 60-86046

[51] Int. Cl.[5] ..... G03C 7/38; G03C 1/34; G03C 1/035

[52] U.S. Cl. ..... 430/551; 430/558; 430/567

[58] Field of Search ..... 430/558, 567, 551

[56] References Cited

U.S. PATENT DOCUMENTS 3,725,067 4/1973 Bailey et al. ..... 430/558
4,400,463 8/1983 Maskasky ..... 430/567

(List continued on next page.)

FOREIGN PATENT DOCUMENTS 0070181 1/1983 European Pat. Off. .
0070182 1/1983 European Pat. Off. .
0137722 4/1985 European Pat. Off. .
0160469 11/1985 European Pat. Off. .
0164130 12/1985 European Pat. Off. .
1810464 7/1969 Fed. Rep. of Germany .
3613020 10/1986 Fed. Rep. of Germany .
58-42045 3/1983 Japan .
59-99437 6/1984 Japan .
61-248043 11/1986 Japan .
2132783 7/1984 United Kingdom .
2135788 9/1984 United Kingdom .
2178551 2/1987 United Kingdom .

OTHER PUBLICATIONS

Carroll et al, "Introduction of Photographic Theory", 1980 pp. 86–88.
James, "The Theory of the Photographic Process", 4th ed. 1911, pp. 98–100.
Maskasky, Joe E., "Journal of Imaging Science", vol. 30, No. 6, Nov./Dec. 1986.

*Primary Examiner*—Lee C. Wright
*Attorney, Agent, or Firm*—Frishauf, Holtz, Goodman & Woodward

[57] ABSTRACT

Light-sensitive silver halide color photographic material, having at least one light-sensitive silver halide emulsion layer on a support, wherein at least one of said emulsion layer contains light-sensitive silver halide grains having outer surfaces principally comprised of {100} face, and a magenta dye image forming coupler represented by Formula (I) shown below:

Formula (I):

wherein Z represents a group of nonmetal atom necessary for formation of a nitrogen-containing hetero ring; said ring formed by Z may have a substituent; X represents a hydrogen atom or a substituent eliminable by the reaction with an oxidant in a color developing agent; and R represents a hydrogen atom or a substituent.

which can porovide a light-sensitive silver halide color photographic material having high sensitivity, being low in fogs, and having improved color reproducibility.

17 Claims, No Drawings

U.S. PATENT DOCUMENTS

| | | | |
|---|---|---|---|
| 4,443,536 | 4/1984 | Lestina | 430/557 |
| 4,461,826 | 7/1984 | Yamashita et al. | 430/505 |
| 4,500,630 | 2/1985 | Sato et al. | 430/558 |
| 4,540,654 | 9/1985 | Sato et al. | 430/558 |
| 4,548,899 | 10/1985 | Nakayama et al. | 430/558 |
| 4,562,146 | 12/1985 | Masuda et al. | 430/558 |
| 4,585,732 | 4/1986 | Kawagishi et al. | 430/558 |
| 4,590,153 | 5/1986 | Kawagishi et al. | 430/558 |
| 4,623,617 | 11/1986 | Kaneko et al. | 430/551 |
| 4,640,889 | 2/1987 | Komorita et al. | 430/567 |
| 4,675,275 | 6/1987 | Nishijima et al. | 430/551 |
| 4,675,280 | 6/1987 | Kaneko et al. | 430/558 |
| 4,680,254 | 7/1987 | Maskasky | 430/567 |
| 4,684,603 | 8/1987 | Nishijima et al. | 430/551 |
| 4,695,533 | 9/1987 | Nakayama et al. | 430/558 |
| 4,720,452 | 1/1988 | Takiguchi et al. | 430/567 |
| 4,830,956 | 5/1989 | Waki | 430/558 |
| 5,023,170 | 6/1991 | Miyoshi et al. | 430/558 |

LIGHT-SENSITIVE SILVER HALIDE COLOR PHOTOGRAPHIC MATERIAL

This is a division of application Ser. No. 07/569,778 filed Aug. 21, 1990, now U.S. Pat. No. 5,023,170, which is a continuation of application Ser. No. 06/851,778 filed Apr. 14, 1986, now abandoned.

BACKGROUND OF THE INVENTION

This invention relates to a light-sensitive silver halide color photographic material, more particularly, to a light-sensitive silver halide color photographic material having high sensitivity and excellent color reproducibility.

In the color photography employing a light-sensitive silver halide color photographic material, the color reporoduction is carried out, in general, by the subtractive color process. Namely, in an ordinary light-sensitive silver halide color photographic material, a yellow dye forming coupler is used in a blue light- sensitive emulsion layer, a magenta dye forming coupler in a green light-sensitive emulsion layer, and a cyan dye forming coupler in a red light-sensitive emulsion layer. In the color developing after imagewise exposure, an oxidation product of a color developing agent to be formed by development of light-sensitive silver halides undergoes a coupling reaction with the above dye forming couplers to form yellow, magenta and cyan dye images, respectively, whereby the color reproduction is achieved.

The color reproducibility is one of the most important performances which may decide the quality of a color photograph. Accordingly, since the discovery of the principle of the above color photography, there has been made a number of studies for improvement in the color reproducibility.

Although there are many factors which affect the color reproducibility, important factors among those are the spectral sensitivity characteristics of a light-sensitive silver halide emulsion and the spectral absorption characteristics of a color dye.

In the spectral sensitivity characteristic of a light-sensitive silver halide emulsion, what is particularly questioned is a question of the blue sensitivity of a silver halide having been subjected to spectral sensitization. In nature, the silver halide has the sensitivity only to blue light in a visible light, but it is possible by the technique of spectral sensitization which is known in the art to make the silver halide have the sensitivities to green light and red light and further to infrared light also. Therefore, by the spectral sensitization, silver halide grains are made to have the sensitivities to blue light and light in a spectral sensitized region (for example, green light, red light, etc.). Because of the blue light-sensitivity of the silver halide having been subjected to the spectral sensitization, however, it follows that, in the above-mentioned light-sensitive silver halide color photographic material, magenta and cyan color development may also incidentally take place besides yellow color development, during the course of color developingt after imagewise exposure by blue light, to bring about an undesirability in the color reporoduction. As one of techniques to solve this problem, there is a method in which a yellow filter is provided below the blue light-sensitive emulsion layer, i.e., on the side distant from a light source. This method is greatly effective, but has disadvantages such that it reults in high production cost, has no effect on the layers upper than the yellow fileter (namely, when, for example, a blue light-sensitive emulsion layer or a red light-sensitive emulsion layer is provided on the side nearer to the light source than the blue light-sensitive emulsion layer). In any event, from a viewpoint of the color reproduction, it is preferable to make the sensitivity to the spectral sensitized region as high as possible as compared with the blue light-sensitivity.

Next, as to the spectral absorption characteristics, what are preferable for the color reproduction may be mentioned to be that the wavelength giving maximum spectral absorption in the visible region (hereinafter referred to as "primary absorption") and the shape of a peak of the primary absorption are adequate, and that there is less excessive absorption other than the primary absorption (hereinafter referred to as "secondary absorption"). Firstly, in respect of the primary absorption, it is generally known to be improved to a considerable extent by selecting substituents for a coupler or high boiling organic solvents for a coupler, and there can be said that, in the present state of the art, suitable ones have been selected. However, in respect of the secondary absorption, in particular, the secondary absorption in blue regions of magenta and cyan dyes, which gives seriously bad influence to the color reproducibility, it has been attempted in general in the art to improve it by a masking method using a colored coupler, a method utilizing the interimage effect, etc. However, it does not necessarily follow that these methods can be always used. For instance, the masking method using a colored coupler can be utilized for intermediate images such as those in color negative films, but can not be utilized for what are to become final images such as those in color reversal films, color photographic papers, etc. Accordingly, it has been desired to produce a coupler capable of giving a color dye having less secondary absorption.

In particular, a magenta dye forming coupler of pyrazolone series (hereinafter referred to as "magenta coupler"), generally used in the present art, has particularly a large secondary absorption in a colored dye (a pyrazolone-azomethine dye), and thus its improvement has been strongly desired.

The magenta coupler having less secondary absorption is known to include pyrazolinobenzimidazole series compounds disclosed in German Patents No. 10 70 030 and No. 11 27 220, pyrazolotriazole series compounds disclosed in French Patent No. 2,075,583, U.S. Pat. Nos. 3,705,896 and No. 3,725,067, British Patent No. 1,252,418, etc., and indazolone series compounds disclosed in U.S. Pat. No. 2,673,801, etc.

However, in the above-mentioned compounds, there are many compounds having disadvantages such that the color property is insufficient or that colored dyes are unstable to light or heat, and they have scarcely put into practical use. Among them, the compounds of pyrazolotriazole series are known to have relatively good performance, have less secondary absorption, show sharpnesss in the shape of the primary absorption, and are desirable couplers from the view point of the color reproduction. However, the above pyrazolotriazole series couplers, when they are designed to be put into practical use, were found to have disadvantages such that they are insufficient in the sensitivity and are liable to cause photographic fogs. Therefore, it has become understood that, in order to improve the color reproducibility by using the pyrazolotriazole series magenta couplers, essential techniques are to make high the sensitivity of a silver halide emulsion and to decrease fogs.

A method most well known as the technique to make high the sensitivity is to enlarge the size of light-sensitive silver halide grains. However, according to this method, it follows that not only the sensitivity in the spectral sensitized region of silver halide grains but also the sensitivity to blue light are raised (generally in such a manner that the rise in sensitivity to blue light is larger), and thus such a method is not preferable from the viewpoint of the color reproduction as mentioned above. In order to raise the sensitivity in the spectral sensitized region, it is considered necessary to increase the amount of sensitizing dyes or to select other sensitizing dyes. However, such measures may often give a bad influence to other photographic performances or cause the change in spectral sensitivity, and also, in the present state in the art, considerably desirable sensitizing dyes have been used under desirable conditions. Accordingly, it is difficult to make sensitization in a large region by such measures.

As a countermeasure to the increase in fogs, it is known to use an antifoggant. The antifoggant is known to include, for example, azaindenes, triazoles, tetrazoles, imidazolium salts, etc. However, if these antifoggants are used in a large amount, the lowering of sensitivity will be caused, or even if used in a large amount, it often occurs that the antifogging effect is not sufficient, and thus no fundamental solution will be achieved.

In the techniques mentioned in the foregoing, there has been obtained no light-sensitive silver halide color photographic material having high sensitivity and excellent color reproducibility.

SUMMARY OF THE INVENTION

Accordingly, a first object of this invention is to provide a light-sensitive silver halide color photographic material having excellent color reproducibility. A second object of this invention is to provide a light-sensitive silver halide color photographic material having high sensitivity, being low in fogs, and having improved color reproducibility.

The above objects of this invention can be achieved by a light-sensitive silver halide color photographic material, having at least one light-sensitive silver halide emulsion layer on a support, wherein at least one of said emulsion layer contains light-sensitive silver halide grains having outer surfaces principally comprised of (100) face, and a magenta dye image forming coupler represented by Formula (I) shown below:

Formula (I):

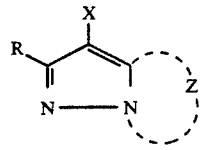

wherein Z represents a group of nonmetal atoms necessary for formation of a nitrogen-containing hetero ring; said ring formed by Z may have a substituent; X represents a hydrogen atom or a substituent eliminable through the reaction with an oxidation product of a color developing agent; and R represents a hydrogen atom or a substituent.

DESCRIPTION OF THE PREFERRED EMBODIMENTS

This invention will be described below in detail.

In the magenta coupler according to this invention, represented by Formula (I), Z represents a group of nonmetal atoms necessary for formation of a nitrogen-containing hetero ring; said ring formed by Z may have a substituent.

X represents a hydrogen atom or a substituent eliminable through the reaction with an oxidation product of a color developing agent.

And, R represents a hydrogen atom or a substituent.

The substituent represented by the above R may include, for example an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom may include, for example, a chlorine atom and a bromine atom. Particularly preferred is a chlorine atom.

The alkyl group represented by R may preferably have those having 1 to 32 carbon atoms; the alkenyl group and the alkynyl group, each having 2 to 32 carbon atoms; the cycloalkyl group and the cycloalkenyl group, each having 3 to 12 carbon atoms, particularly 5 to 7 carbon atoms. The alkyl group, the alkenyl group and the alkynyl group each may be of straight chain structure or branched structure.

Also, these alkyl group, alkenyl group, alkynyl group, cycloalkyl group and cycloalkenyl group each may have a substituent including, for example, an aryl, a cyano, a halogen atom, a hetero ring, a cycloalkyl, a cycloalkenyl, a spiro compound residual group, a bridged hydrocarbon compound residual group, and besides these, those which are substituted through a carbonyl group such as an acyl, a carboxyl, a carbamoyl, an alkoxycarbonyl and an aryloxycarbonyl, and those which are substituted through a hetero atom {specifically, those which are substituted through an oxygen atom such as a hydroxyl, an alkoxy, an aryloxy, a heterocyclic oxy, a siloxy, an acyloxy and a carbamoyloxy, those which are substituted through a nitrogen atom such as a nitro, an amino (including a dialkylamino, etc.), a sulfamoylamino, an alkoxycarbonylamino, an aryloxycarbonylamino, an acylamino, a sulfonamide, an imide and a ureido, those which are substituted through a sulfur atom such as an alkylthio, an arylthio, a heterocyclic thio, a sulfonyl, a sulfinyl and a sulfamoyl and those which are substituted through a phosphorus atom such as a phosphonyl, etc.}.

More specifically, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a tri-fluoromethyl group, a 1-ethoxytridecyl group, a 1-methoxyisopropyl group, an ethyl methanesulfonyl group, a methyl 2,4-di-t-amylfenoxy group, an anilino group, a 1-phenylisopropyl group, a 3-m-butanesulfonaminophenoxypropyl group, a 3-4'-{α-[4''(p-hydroxybenzenesulfonyl)phenoxy)-dodecanoylamino)phen ylpropyl group, a 3-{4'-[α-(2'',4''-di-t-amylphenoxy)butanamide[phenyl}propyl group, a 4-[α-(o-chlorophenoxy)tetradecanamidophnoxy]propyl group, an allyl group, a cyclopentyl group, a cyclohexyl group, etc.

The aryl group represented by R is preferably a phenyl group, and may have a substitutent (for example, an alkyl group, an alkoxy group, an acylamino group, etc.). More specifically, it may include a phenyl group, a 4-t-butylphenyl group, a 2,4-di-t-amylphenyl group, a 4-tetradecanamidophenyl group, a hexadicyloxyphenyl group, a 4'-[α-(4''-t-butylphenoxy)tetradecanamido)-phenyl group, etc.

The heterocyclic group represented by R is preferably one having 5- to 7-members, which may be substituted or condensated. More specifically, it may include a 2-furyl group, a 2-thienyl group, a 2-pyrimidinyl group, a 2-benzothiazolyl group, etc.

The acyl group represented by R may include, for example, alkylcarbonyl groups such as an acetyl group, a phenyl acetyl group, a dodecanoyl group and an α-2,4-di-t-amylphenoxybutanoyl group; arylcarbonyl groups such as a benzoyl group, a 3-pentadecyloxybenzoyl group and a p-chlorobenzoyl group; etc.

The sulfonyl group represented by R may include alkylsulfonyl groups such as a methylsulfonyl group and a dodecylsulfonyl group; arylsufonyl groups such as a benzenesulfonyl group and a p-toluenesulfonyl group; etc.

The sulfinyl group represented by R may include alkylsulfinyl groups such as an ethylsulfinyl group, an octylsulfinyl group and a 3-phenoxybutylsulfinyl group; arylsulfinyl groups such as a phenylsulfinyl group, a m-pentadecylphenylsulfinyl group; etc.

The phosphonyl group represented by R may include alkylsulfonyl groups such as a butyloctylphosphonyl group, alkoxyphosphonyl groups such as an octyloxyphosphonyl group, an aryloxyphosphonyl groups such as a phenoxyphosphonyl group, an arylphosphonyl groups such as a phenylphosphonyl group, etc.

The carbamoyl group represented by R may be substituted with an alkyl group, an aryl group (preferably, a phenyl group), etc., and may include, for example, an N-methylcarbamoyl group, an N,N-dibutylcarbamoyl group, an N-(ethyl 2-pentadecyloctyl)carbamoyl group, an N-ethyl-N-dodecylcarbamoyl group, an N-{3-(2,4-di-t-amylphenoxy)propyl}carbamoyl group, etc.

The sulfamoyl group represented by R may be substituted with an alkyl group, an aryl group (preferably a phenyl group), etc., and may include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group, etc.

The spiro compound residual group represented by R may include, for example, spiro[3.3]heptan-1-yl, etc.

The bridged hydrocabon compound residual group may include, for example, bicyclo[2.2.1]heptan-1-yl, tricyclo[3.3.1.1$^{3,7}$)decan-1-yl, 7,7-dimethyl-dibicyclo[2.2.1]heptan-1-yl, etc.

The alkoxy group represented by R may be further substituted with those mentioned as the substituents for the above alkyl group, and may include, for example, a methoxy group, a propoxy group, a 2-ethoxyethoxy group, a pentadecyloxy group, a 2-dodecyloxyethoxy group, a phenethyloxyethoxy group, etc.

The aryloxy group represented by R is preferably a phenyloxy, wherein the aryl nucleus my be further substituted with those mentioned as the substituents for the above aryl group, and may include, for example, a phenoxy group, a p-t-butylpohenoxy group, a m-pentadecylphenoxy group, etc.

The heterocyclic oxy group represented by R is preferably one having 5- to 7-members, wherein the heterocyclic ring may further have a substituent, and may include, for example, a 3,4,5,6-tetrahydropyranyl-2-oxy group, a 1-phenyltetrazole-5-oxy group, etc.

The siloxy group represented by R may further be substituted with an alkyl group, etc., and may include, for example, a trimethylsiloxy group, a triethylsiloxy group, a dimethylbutylsiloxy group, etc.

The acyloxy group represented by R may include, for example, an alkylcarbonyloxy group, an arylcarbonyloxy group, etc., and may further have a substitutent to include, specifically, an acetyloxy group, an α-chloroacetyloxy group, a benzoyloxy group, etc.

The carbamoyloxy group represented by R may be substituted with an alkyl group, an aryl group, etc., and may include, for example, an N-ethylcarbamoyloxy group, an N,N-diethylcarbamoyloxy group, an N-phenylcarbamoyloxy group, etc.

The amino group represented by R may be substituted with an alkyl group, an aryl group (preferably, a phenyl group), and may include, for example, an ethylamino group, an anilino group, a m-chloroanilino group, a 3-pentadecyloxycarbonylanilino group, a 2-chloro-5-hexadecanamidoanilino group, etc.

The acylamino group represented by R may include an alkylcarbonylamino group, an arylcarbonylamino group (preferably, a phenylcarbonylamino group), etc., and may further have a substituent to include, specifically, an acetoamide group, an α-ethylpropaneamide group, an N-phenylacetoamide group, a dodecanamide group, a 2,4-di-t-amylphenoxyacetoamide group, an α-3-t-butyl-4-hydroxyphenoxybutaneamide group, etc.

The sulfonamide group represented by R may include an alkylsulfonylamino group, an arylsulfonylamino group, and may further have a substituent. It specifically may include, a methylsulfonylamino group, a pentadecylsulfonylamino group, a benzenesulfonamide group, a p-toluensulfonamide, a 2-methoxy-5-t-amylbenzensulfonamide group, etc.

The imide group represented by R may be of open chain structure or cyclic structure, or may have a substituent to include, for example, a succinimide group, a 3-heptadecylsuccinimide, a phthalimide group, a glutalimide group, etc.

The ureido group represented by R may be substituted with an alkyl group, an aryl group (preferably, a phenyl group), etc., and may include, for example, an N-ethylureido group, an N-ethyl-N-decylureido group, an N-phenylureido group, an N-p-tolylureido group, etc.

The sulfamoylamino group represented by R may be substituted with an alkyl group or an aryl group (preferably, a phenyl group), etc., and may include, for example, an N,N-dibutylsulfamoylamino group, an N-methylsulfamoylamino group, an N-phenylsulfamoylamino group, etc.

The alkoxycarbonylamino group represented by R may further have a substituent, and may include, for example, a methoxycarbonylamino group, a methoxyethoxycarbonylamino group, an octadecyloxycarbonylamino group, etc.

The aryloxycarbonylamino group represented by R may have a substituent, and may include, for example, a phenoxycarbonylamino group, a 4-methylphenoxycarbonylamino group, etc.

The alkoxycarbonyl group represented by R may further have a substituent, and may include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group, etc.

The aryloxycarbonyl group represented by R may further have a substituent, and may include, for example, a phenoxycarbonyl group, a p-chlorophenoxycarbonyl group, an m-pentadecyloxyphenoxycarbonyl group, etc.

The alkylthio group represented by R may further have a substituent, and may include, for example, an ethylthio group, a dodecylthio group, an octadecylthio group, a phenethylthio group, a 3-phenoxypropylthio group, etc.

The arylthio group represented by R is preferably a phenylthio group which may further have a substituent, and may include, for example, a phenylthio group, a p-methoxyphenylthio group, a 2-t-octylphenylthio group, a 3-octadecylphenylthio group, a 2-carboxyphenylthio group, a p-acetoaminophenylthio group, etc.

The heterocyclic thio group represented by R is preferably a heterocyclic thio group of 5 to 7 members, and may further have a condensed ring or may have a substituent. It may include, for example, a 2-pyridylthio group, a 2-benzothiazolylthio group, a 2,4-diphenoxy-1,3,5-triazole-6-thio group, etc.

The substituent represented by X, which is eliminable through the reaction with an oxidation product of a color developing agent, may include, for example, a halogen atom (such as a chlorine atom, a bromine atom and a fluorine atom), and also groups which are substituted through a carbon atom, an oxygen atom, a sulfur atom or a nitrogen atom.

The groups which are substituted through a carbon atom may include a carboxyl group, and also, for example, a group represented by the general formula:

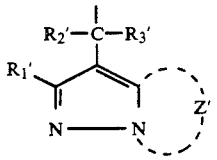

wherein R' is as defined above, Z' is same as defined for the above Z; and $R^{2'}$ and $R^{3'}$ each represent a hydrogen atom, an aryl group, an alkyl group or a heterocyclic group, a hydroxymethyl group and a triphenylmethyl group.

The groups which are substituted through an oxygen atom may include, for example, an alkoxy group, aryloxy group, heterocyclic oxy group, an acyloxy group, a sulfonyloxy group, an alkoxycarbonyloxy group, an aryloxycarbonyloxy group, an alkyloxaryloxy group, an alkoxyoxaryloxy group, etc.

The above alkoxy group may further have a substituent including, for example, an ethoxy group, a 2-phenoxyethoxy group, 2-cyanoethoxy group, a phenethyloxy group, a p-chlorobenzyloxy group, etc.

The above aryloxy group is preferably a phenoxy group, and the aryl group may further have a substituent. More specifically, it may include a phenoxy group, a 3-methylphenoxy group, a 3-dodecylphenoxy group, a 4-methanesulfonamidephenoxy group, a 4-[α-(3'-entadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group, etc.

The above heterocyclic oxy group is preferably a heterocyclic oxy group of 5 to 7 members, or may be of condensed ring, or may have a substituent. Specifically, it may include a 1-phenyltetrazolyloxy group, a 2-benzothiazolyloxy group, etc.

The above acyloxy group may include, for example, alkylcarbonyloxy groups such as an acetoxy group and butanoloxy group, and alkenylcarbonyloxy groups such as a cinnamoyloxy group, and arylcarbonyloxy groups such as a benzoyloxy group.

The above sulfonyloxy group may include, for example, a butanesulfonyloxy group and methanesulfonyloxy group.

The above alkoxycarbonyloxy group may include, for example, an ethoxycarbonyloxy group and a benzyloxycarbonyloxy group.

The above aryloxycarbonyloxy group may include a phenoxycarbonyloxy group, etc.

The above alkyloxalyloxy group may include, for example, a methyloxalyloxy group.

The above alkoxyoxalyloxy group may include an ethoxyoxalyloxy group, etc.

The group which is substituted through a sulfur atom may include, for example, an alkylthio group, an arylthio group, a heterocyclic thio group and an alkyloxythiocarbonylthio group.

The above alkylthio group may include a butylthio group, a 2-cyanoethylthio group, a phenethylthio group, a benzylthio group, etc.

The above arylthio group may include a phenylthio group, a 4-methanesulfonamidephenylthio group, a 4-dodecylphenethylthio group, a 4-nonafluoropentanamidephenythylthio group, a 4-carboxyphenylthio group, a 2-ethoxy-5-t-butylphenylthio group, etc.

The above heterocyclic thio group may include, for example, a 1-phenyl-1,2,3,4-tetrazolyl-5-thio group, a 2-benzothiazolylthio group, etc.

The above alkyloxythiocarbonylthio group may include a dodecyloxythiocarbonylthio group, etc.

The group which is substituted through a nitrogen atom may include, for example, a group represented by the general formula:

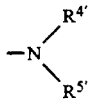

In this formula, $R^{4'}$ and $R^{5'}$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group, and $R^{4'}$ and $R^{5'}$ may be bonded to each other to form a hetero ring, provided that $R^{4'}$ and $R^{5'}$ each are not a hydrogen atom at the same time.

The above alkyl group may be of straight chain or branched one, and is preferably one having 1 to 22 carbon atoms. Also, this alkyl group may have a substituent which may include, for example, an aryl group, an alkoxy group, an aryloxy group, an alkylthio group, an arylthio group, an alkylamino group, arylamino group, an acylamino group, a sulfonamide group, an imino group, an acyl group, an alkylsulfonyl group, an arylsulfonyl group, a carbamoyl group, a sulfamoyl group, an alkoxycarbonyl group, an alkyloxycarbonylamino group, an aryoxycarbonylamino group, a hydroxyl group, a carboxyl group, a cyano group and a halogen atom. The alkyl group may specifically include, for example, an ethyl group, an octyl group, a 2-ethylhexyl group and 2'-chloroethyl group.

The aryl group represented by $R^{4'}$ or $R^{5'}$ is preferably one having 6 to 32 carbon atoms, in particular, a phenyl group and a naphthyl group, wherein the aryl group may have a substituent which may include those mentioned as the substituents for the alkyl group represented by the above $R^{4'}$ or $R^{5'}$. This aryl group may specifically include, for example, a phenyl group, a 1-naphthyl group and a 4-methylsulfonylphenyl group.

The heterocyclic group represented by $R^{4'}$ or $R^{5'}$ is preferably of 5 to 6 members, or may be of condensed ring, or may have a substituent. Specifically, it may include a 2-furyl group, a 2-quinolyl group, a 2-pyrimidyl group, a 2-benzothiazolyl group, a 2-pyridyl group, etc.

The sulfamoyl group represented by $R^{4'}$ or $R^{5'}$ may include an N-alkylsulfamoyl group, an N,N-dialkylsulfamoyl group, N-arylsulfamoyl group, an N,N-diarylsufamoyl group, etc., and the alkyl group and the aryl group of these may have the substituent mentioned for the above alkyl group and aryl group. The sulfamoyl group may specifically include, for example, an N,N-diehtylsulfamoyl group, an N-methylsulfamoyl group, N-dodecylsulfamoyl group and an N-p-tolylsulfamoyl group.

The carbamoyl group represented by $R^{4'}$ or $R^{5'}$ may include an N-alkylcarbamoyl group, an N,N-dialkylcarbamoyl group, an N-arylcarbamoyl group, an N,N-diarylcarbamoyl group, etc., and the alkyl group and the aryl group of these may have the substituent mentioned for the above alkyl group and aryl group. The carbamoyl group may specifically include, for example, an N,N-diethylcarbamoyl group, an N-methylcarbamoyl group, an N-dodecylcarbamoyl group, N-p-cyanophenylcarbamoyl group and N-p-tolylcarbamoyl group.

The acyl group represented by $R^{4'}$ or $R^{5'}$ may include, for example, an alkylcarbonyl group, an arylcarbonyl group and a heterocyclic carbonyl group, and the alkyl group, the aryl group and the heterocyclic group each may have a substituent. The acyl group may specifically include, for example, a hexafluorobutanoyl group, 2,3,4,5,6-pentafluorobenzoyl group, an acety group, a benzoyl group, a naphthoel group, a 2-furylcarbonyl group, etc.

The sulfonyl group represented by $R^{4'}$ or $R^{5'}$ may include an alkylsulfonyl group, an arylsulfonyl group and a heterocyclic sulfonyl group, and may have a substituent. Specifically, it may include, for example, an ethanesulfonyl group, a benzenesulfonyl group, an octanesulfonyl group, a naphthalenesulfonyl group, a p-chlorobenzenesulfonyl group, etc.

The aryloxycarbonyl group represented by $R^{4'}$ or $R^{5'}$ may have as a substituent those mentioned for the above aryl group. Specifically, it may include a phenoxycarbonyl group, etc.

The alkoxycarbonyl group represented by $R^{4'}$ or $R^{5'}$ may have the substituent mentioned for the above alkyl group, and specifically may include a methoxycarbonyl group, a dodecyloxycarbonyl group, a benzyloxycarbonyl group, etc.

The hetero ring to be formed by bonding of $R^{4'}$ and $R^{5'}$ is preferably of 5 to 6 members, and may be saturated or unsaturated, may be aromatic or non-aromatic, or may be of a condensed ring. This hetero ring may include, for example, an N-phthalimide group, an N-succinimide group, a 4-N-urazolyl group, a 1-N-hydantoinyl group, 3-N-2,4-dioxooxazolydinyl group, a 2-N-1,1-dioxo-3-(2H)-oxo-1,2-benzthiazolyl group, a 1-pyrolyl group, a 1-pyrolidinyl group, a 1-pyrazolyl group, a 1-pyrazolydinyl group, a 1-pipelidinyl group, a 1-pyrolinyl group, a 1-imidazolyl group, a 1-imidazolinyl group, a 1-indolyl group, 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrrolidone group, a phthaladione group, a 2-oxo-1-piperidinyl group, etc., and these heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group, a halogen atom, etc.

The nitrogen-containing hetero ring to be formed by Z or Z' may include a pyrazole ring, an imidazole ring, a triazole ring, a tetrazole ring, etc., and the substituent which the above rings each may have include those mentioned for the above R.

When the substituents (for example, R, $R^1$ to $R^8$) on the hetero rings in the Formula (I) and the Formulas (II) to (VIII) shown hereinbelow have a moiety of:

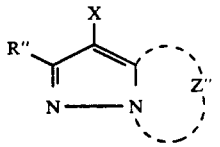

wherein R'', X and Z'' each have the same meaning as R, X, and Z in Formula (I), a so-called bis-body type coupler is formed, which may be included in this invention as a matter of course. Also, on the rings formed by Z, Z', Z'' and the later-mentioned $Z^1$, other rings (for example, a cycloalkene of 5 to 7 members) may be further condensed. For instance, in Formula (V), $R^5$ and $R^6$ may be, and, in Formula (VI), $R^7$ and $R^8$ may be bonded to each other to form a ring (for example, a cycloalkene of 5 to 7 members, bezene).

The coupler represented by Formula (I) may, more specifically, represented, for example, by Formulas (II) to (VII) shown below:

Formula (II)

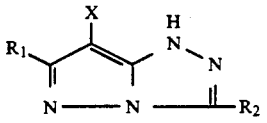

-continued

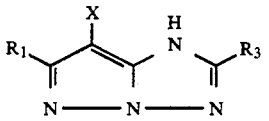

Formula (III)

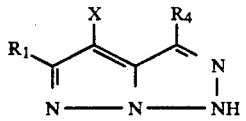

Formula (IV)

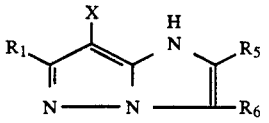

Formula (V)

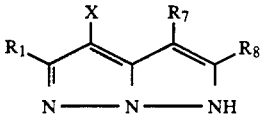

Formula (VI)

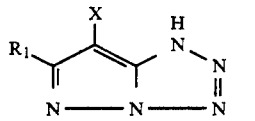

Formula (VII)

In the above Formulas (II) to (VII), $R^1$ to $R^8$ and X each have the same meaning as R and X mentioned before.

Also, what is most preferable in Formula (I) is one represented by Formula (VIII) shown below:

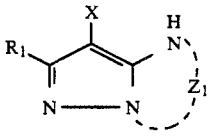

Formula (VIII)

wherein $R^1$, X and $Z^1$ each have the same meaning as R, X and Z in Formula (I).

Of the magenta couplers represented by the above Formulas (II) to (VII), particularly preferred is the magenta coupler represented by Formula (II).

As for the substituents on the hetero rings in Formula (I) to (VIII), it is preferable for R, in the case of Formula (I), and for $R^1$, in the cases of Formulas (II) to (VIII), to each satisfy the condition 1 shown below, and it is further preferable to satisfy the conditions 1 and 2 shown below, and it is particularly preferable to satisfy the conditions 1, 2 and 3 shown below:

Condition 1: A root atom directly bonded to the hetero ring is a carbon atom.

Condition 2: Only one hydrogen atom is bonded to the above carbon atom, or not bonded thereto at all.

Condition 3: All of the bonds between the carbon atom and atoms adjoining thereto are in single bonding.

Substituents most preferable as the substituents R and $R^1$ in the above hetero rings include those represented by Formula (IX) shown below:

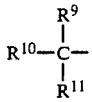

Formula (IX)

In the above formula, $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

Two substituents in the above $R^9$, $R^{10}$ and $R^{11}$, for example, $R^9$ and $R^{10}$, may be bonded to form a saturated or unsaturated ring (for example, a cycloalkane, a cycloalkene, a hetero ring), or $R^{11}$ may be further bonded to this ring to form a bridged hydrocarbon compound residual group.

The groups represented by $R^9$ to $R^{11}$ may have a substituent, and examples of the groups represented by $R^9$ to $R^{11}$ and the substituents these groups may have, may include the specific examples and the substituents mentioned for the group represented by R in Formula (I).

Also, examples of the ring to be formed by bonding, for instance, of $R^9$ and $R^{10}$ and the bridged hydrocarbon compound residual group to be formed by $R^9$ to $R^{11}$, and also the substituents which this ring may have, may include the specific examples and the substituents mentioned for the cycloalkyl, the cycloalkenyl and the heterocyclic bridged hydrocarbon compound residual group which are represented by R in the above Formula (I).

In Formula (X), preferable are;

(i) the case where two of $R^9$ to $R^{11}$ are each an alkyl group; and (ii) the case where one of $R^9$ to $R^{11}$, for example, $R^{11}$ is a hydrogen atom, and the other two, $R^9$ and $R^{10}$ are bonded to form a cycloalkyl group together with the root carbon atom.

Further preferable in the case (i) is the case where two of $R^9$ to $R^{11}$ are each an alkyl group, and the other one is a hydrogen atom or an alkyl group.

Here, the alkyl and the cycloalkyl each may further have a substituent, and examples of the alkyl, the cycloalkyl and the substituents of these may include those for the alkyl, the cycloalkyl and the substituents of these which are represented by R in the above Formula (I).

The substituents which the ring to be formed by Z in Formula (I) and the ring to be formed by $Z^1$ in Formula (VIII) may have, and the substituents $R^2$ to $R^8$ in Formulas (II) to (VI), are preferably those represented by Formula (X) shown below:

$$-R^1-SO_2-R^2 \qquad \text{Formula (X)}$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in Formula (I) may have.

Preferable substituents may include a phenyl.

Preferable examples for the alkylene represented by $R^1$ are shown below:

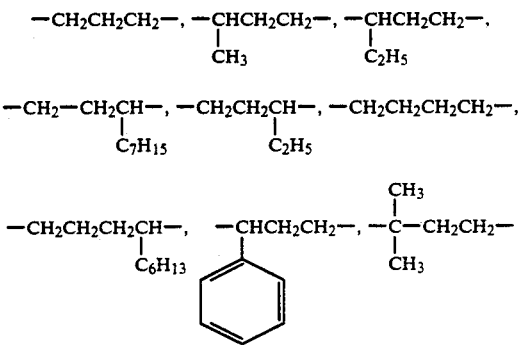

The alkyl group represented by $R^2$ may be of straight chain or branched structure. Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by Formula (I) are those represented by Formula (XI) shown below:

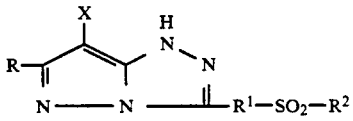

Formula (XI)

wherein R and X each have the same meaning as R and X in Formula (I), and $R^1$ and $R^2$ each have the same meaning as $R^1$ and $R^2$ in Formula (X).

Exemplary compounds of the compound represented by Formula (I) are shown below:

1

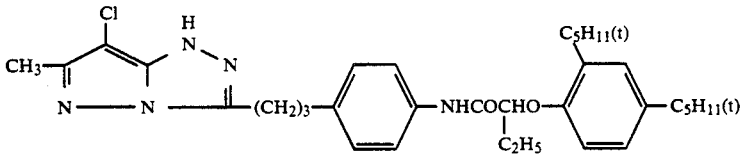

2

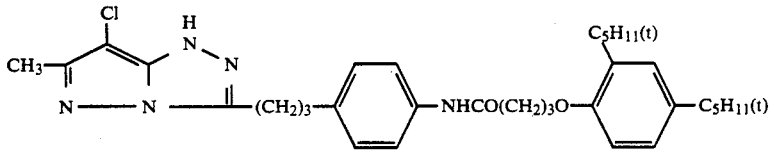

3

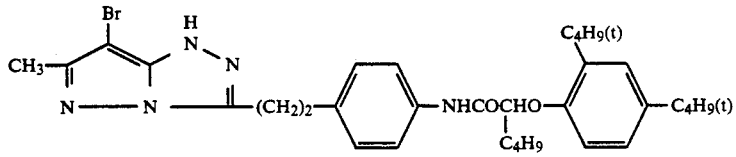

4

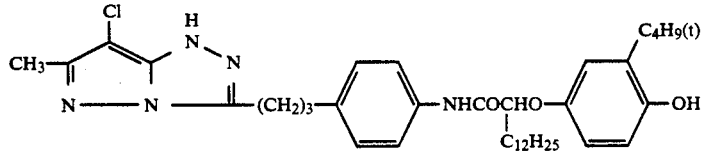

5

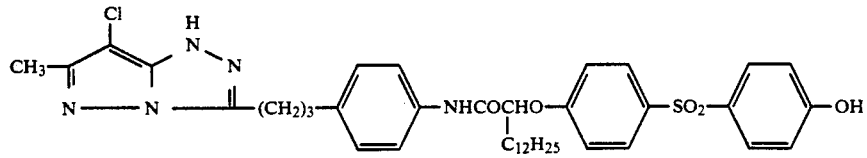

-continued
6
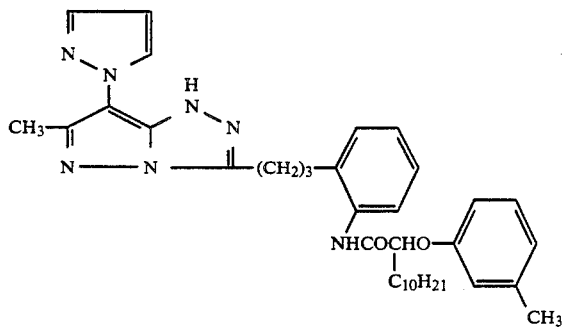
7
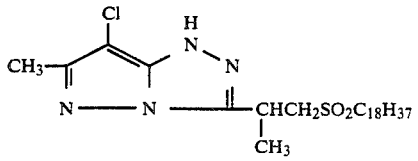
8
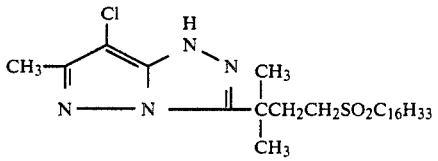
9
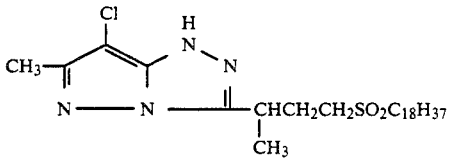
10
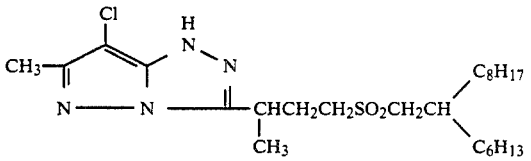
11
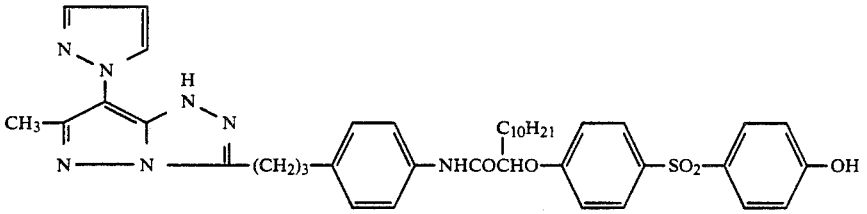
12
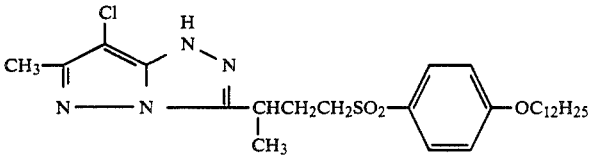
13
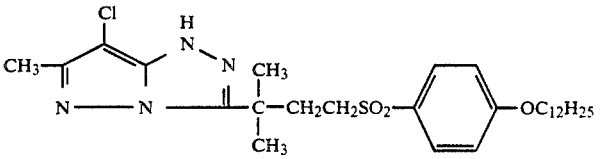

-continued
14
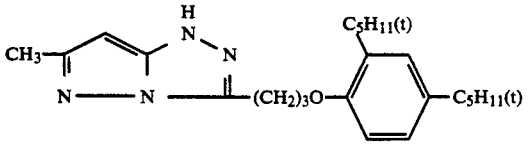
15
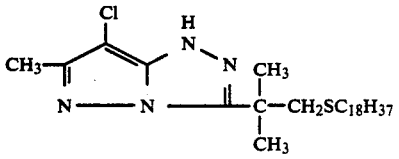
16
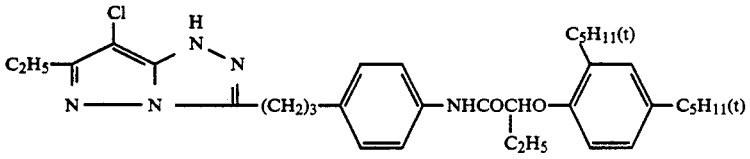
17
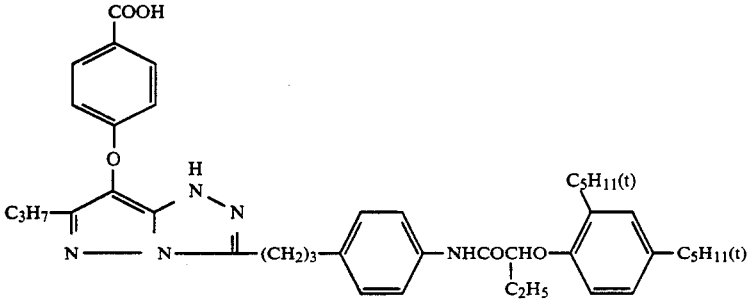
18
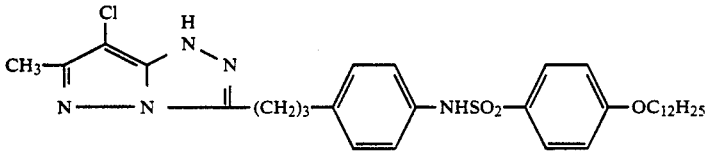
19
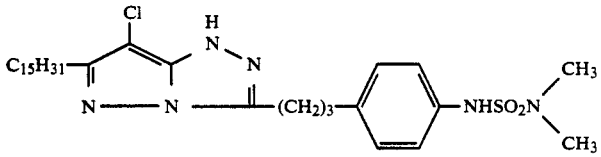
20
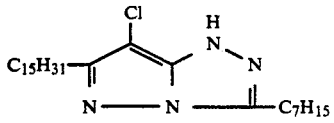
21
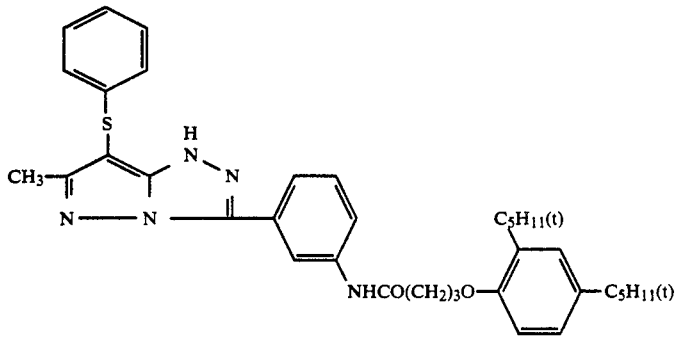

-continued
22
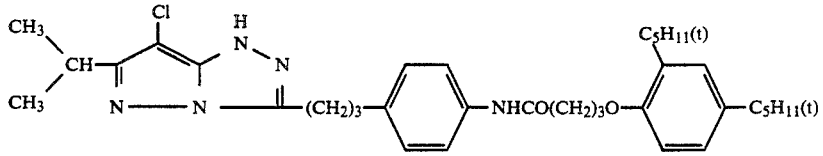
23
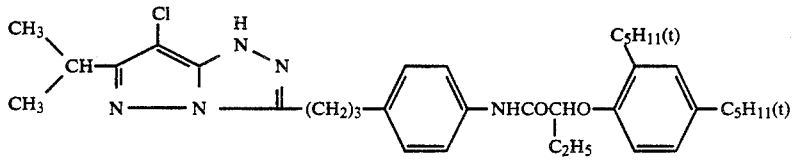
24
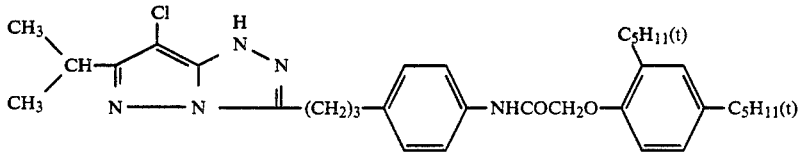
25
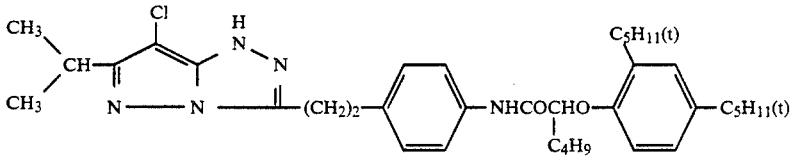
26
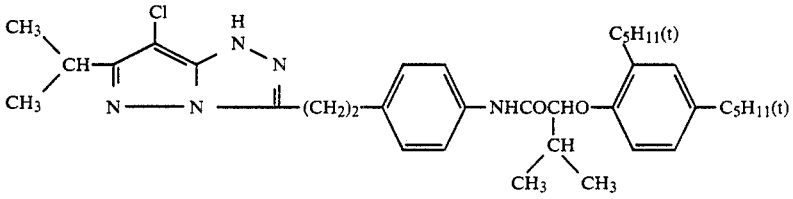
27
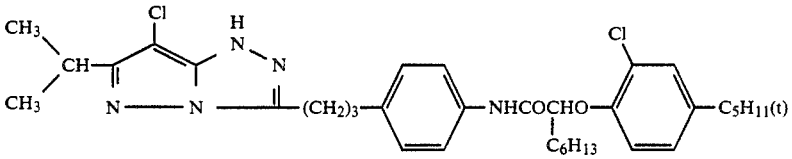
28
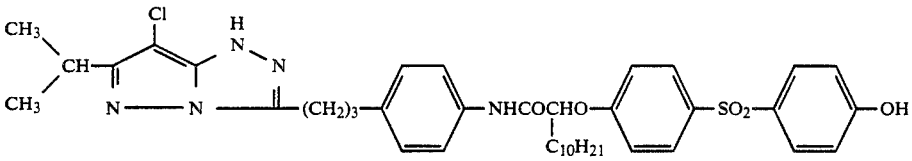
29
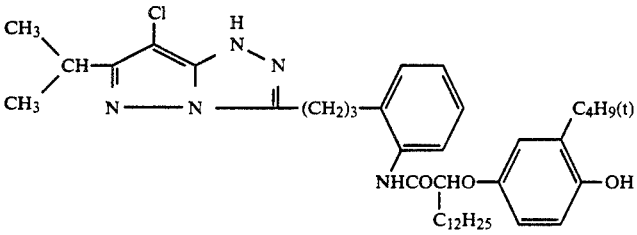

-continued
30
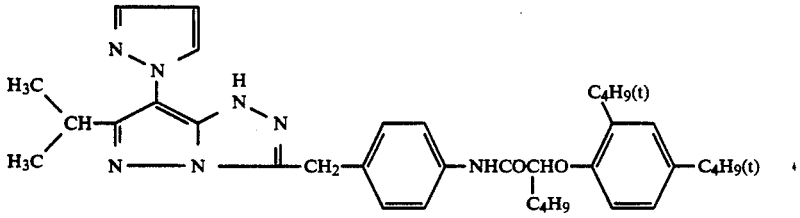
31
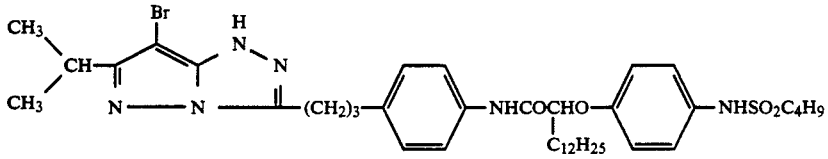
32
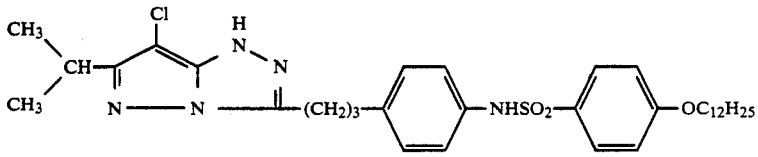
33
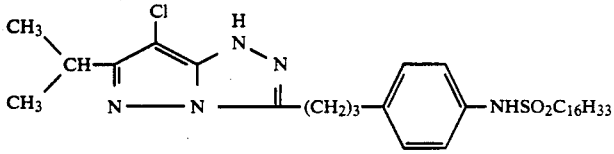
34
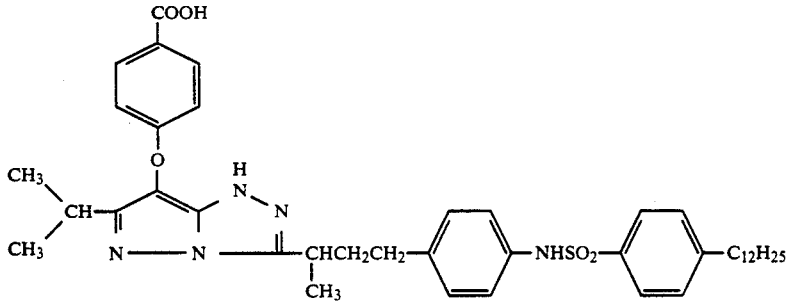
35
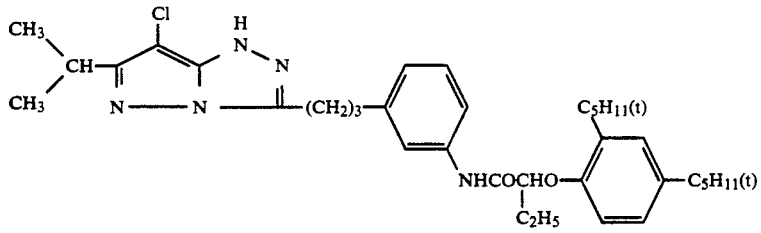
36
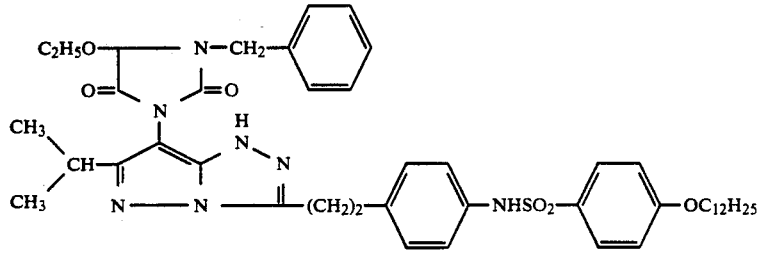

-continued
37
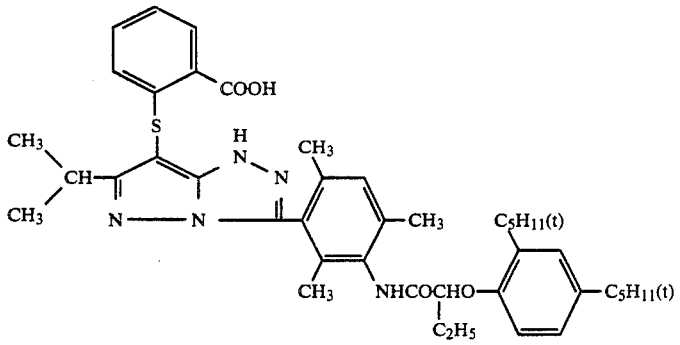
38
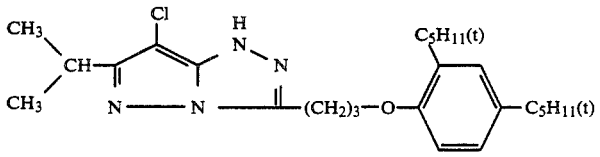
39
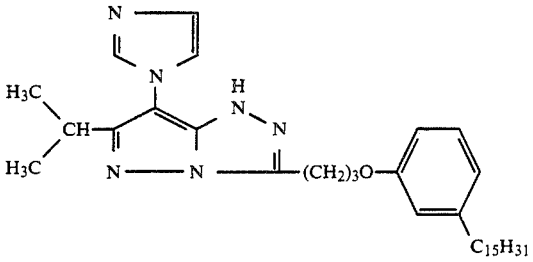
40
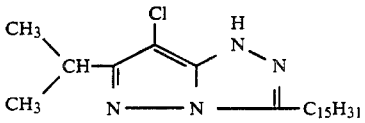
41
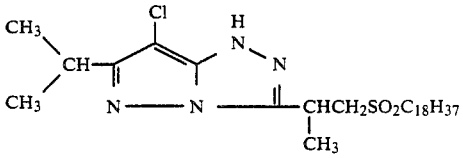
42
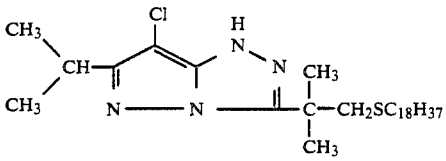
43
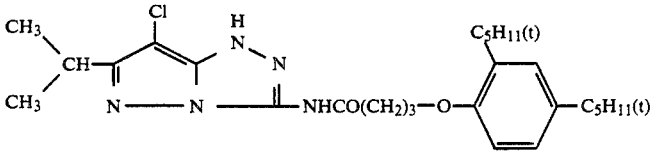
44
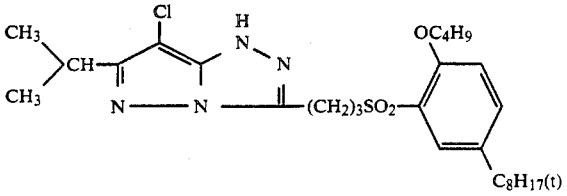

-continued
45
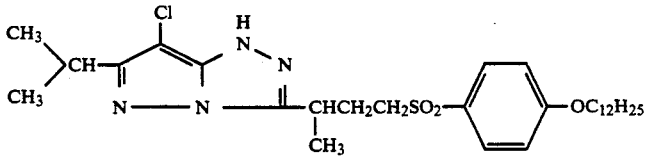
46
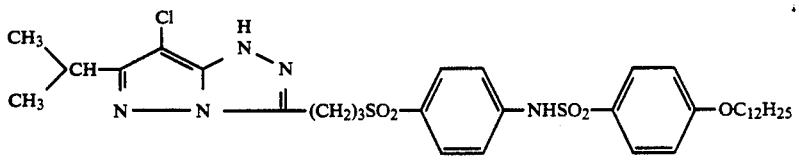
47
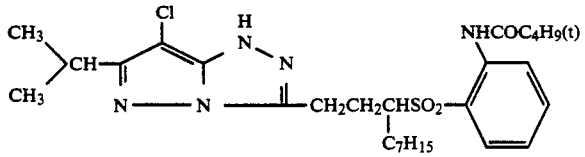
48
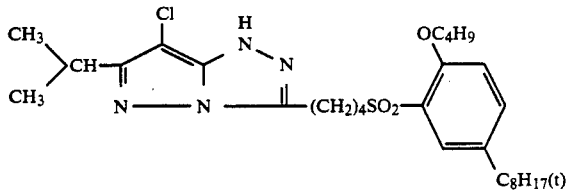
49
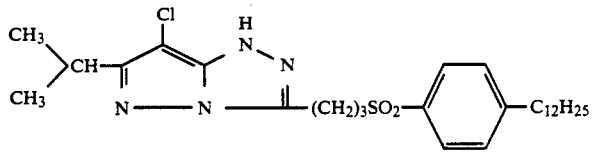
50
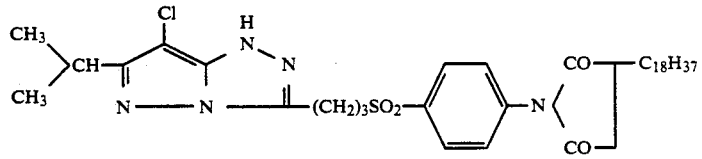
51
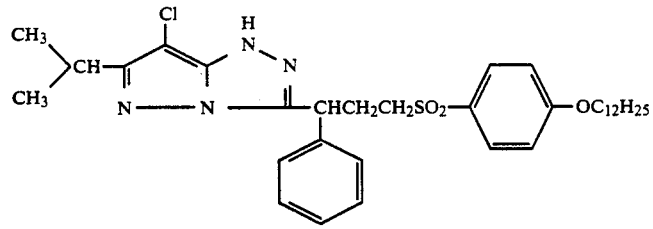
52
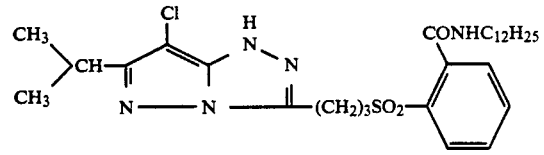
53
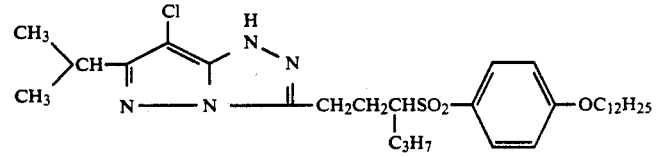

-continued
54
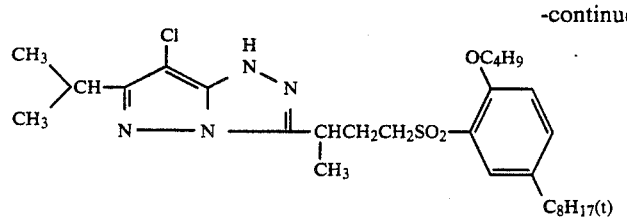
55
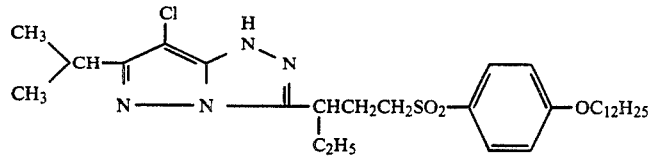
56
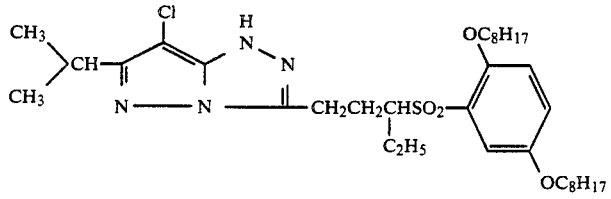
57
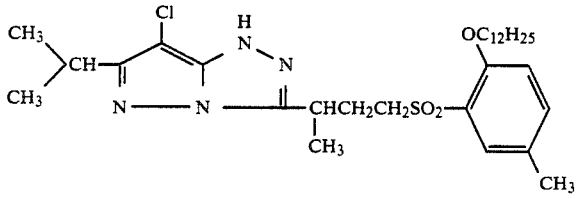
58
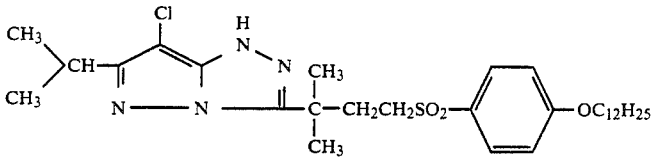
59
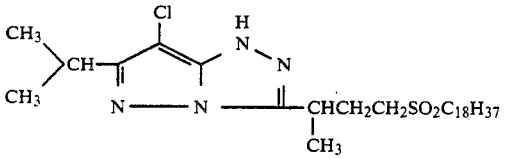
60
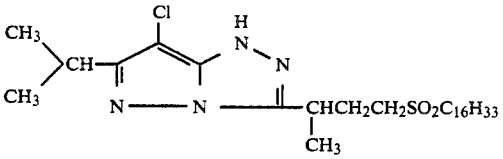
61
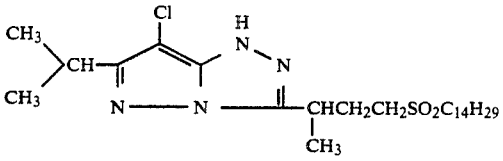
62
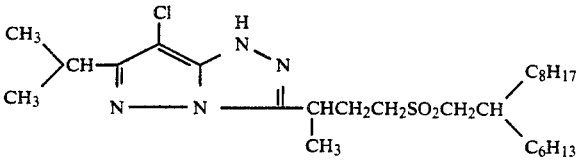

-continued
63
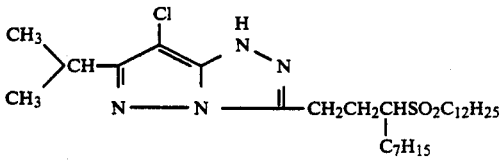
64
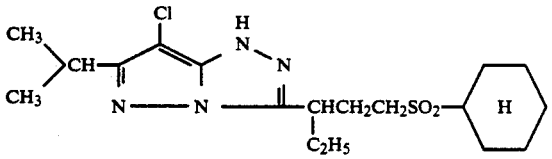
65
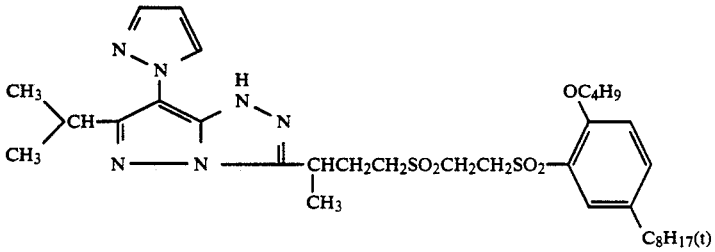
66
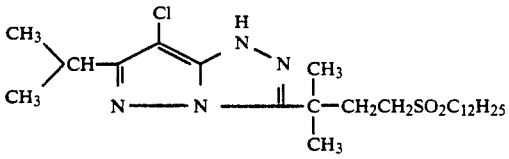
67
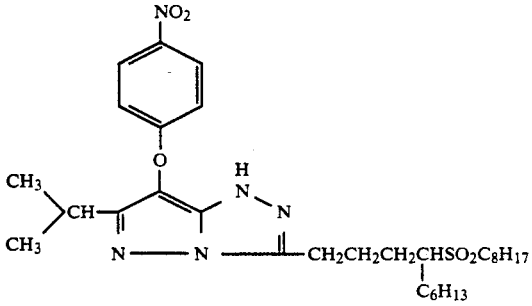
68
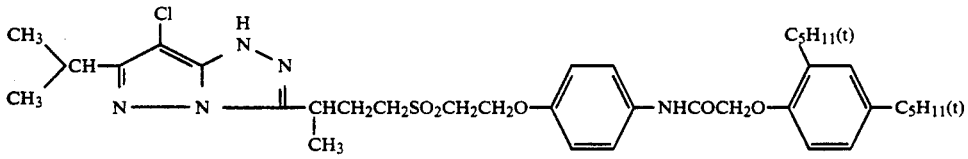
69
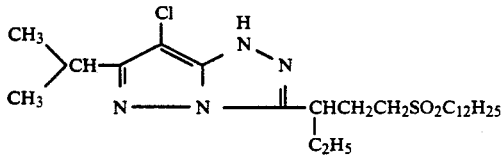
70
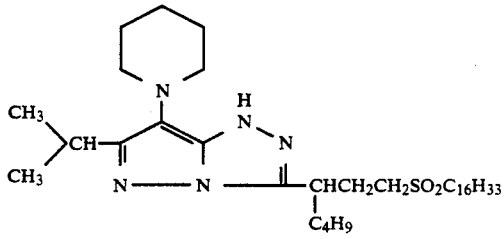

-continued
71
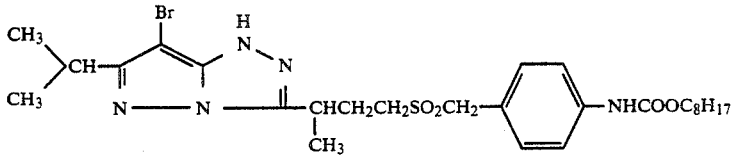
72
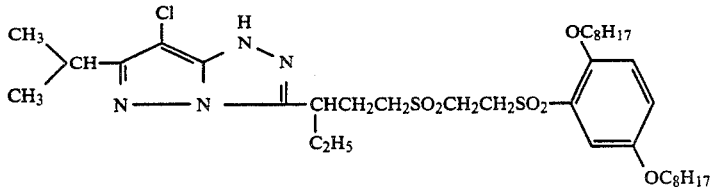
73
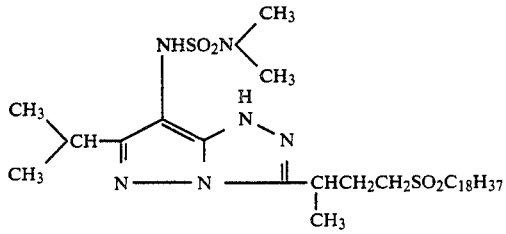
74
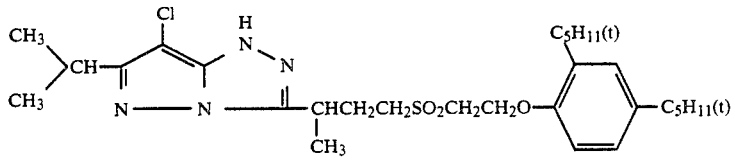
75
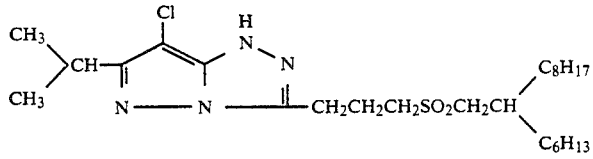
76
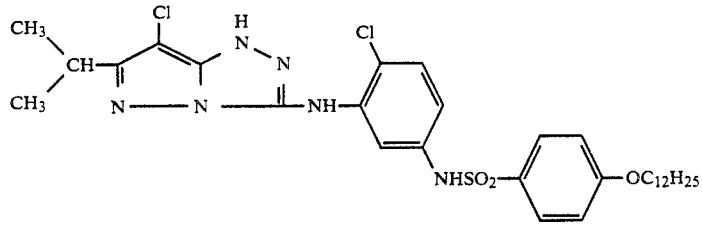
77
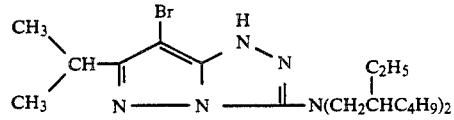
78
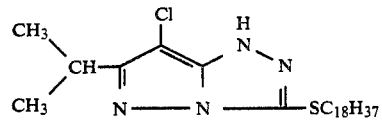
79
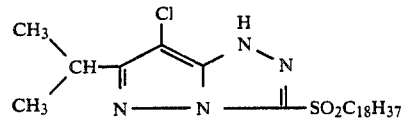

-continued
80
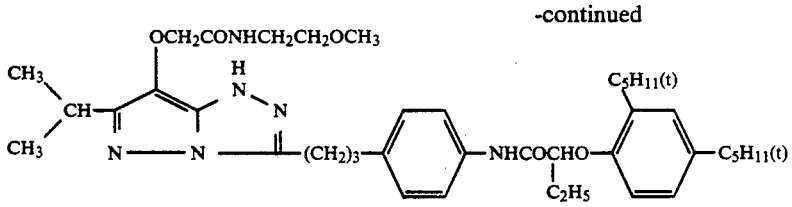
81
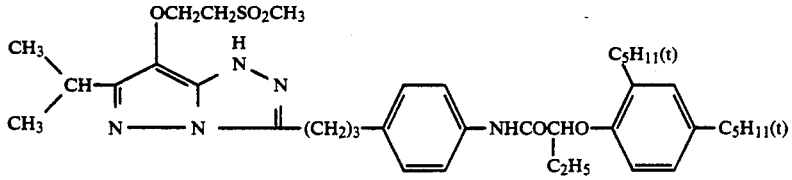
82
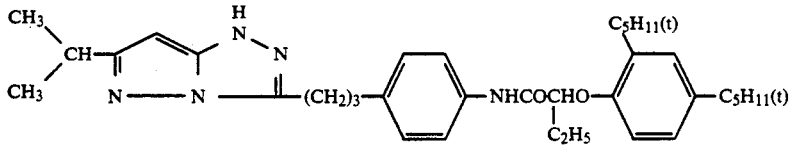
83
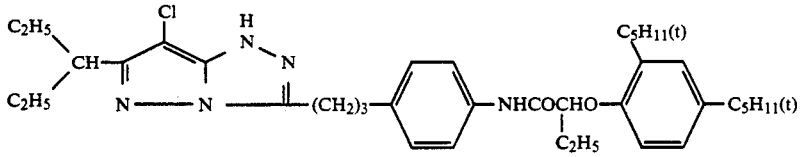
84
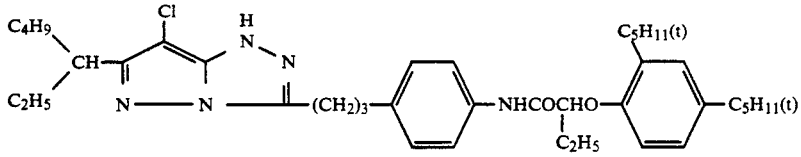
85
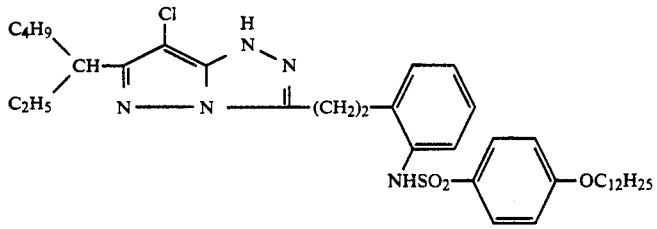
86
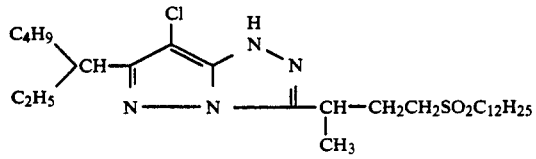
87
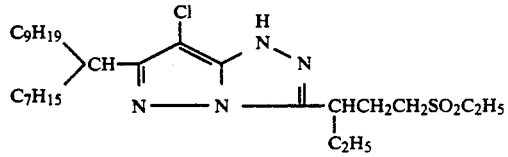
88
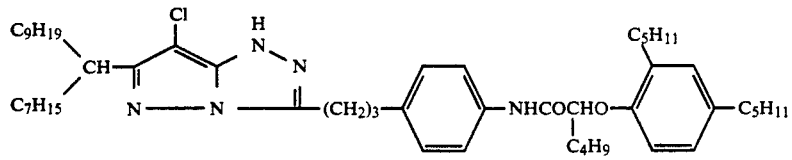

-continued
89
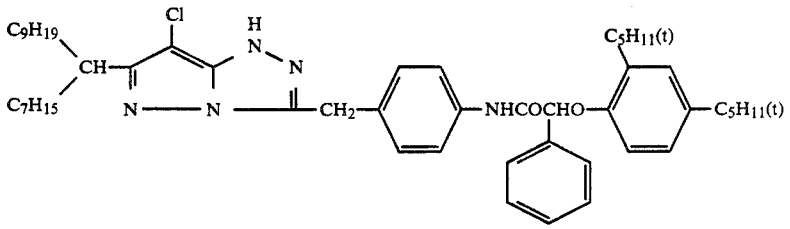
90
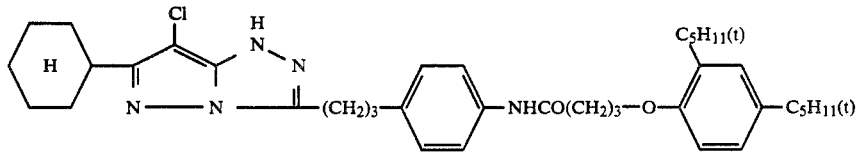
91
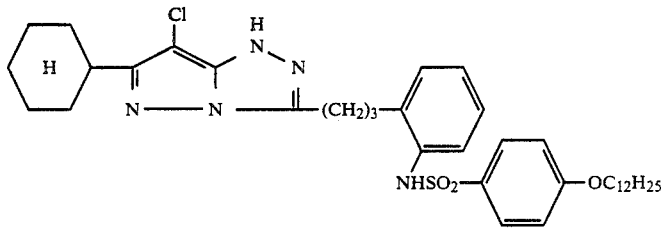
92
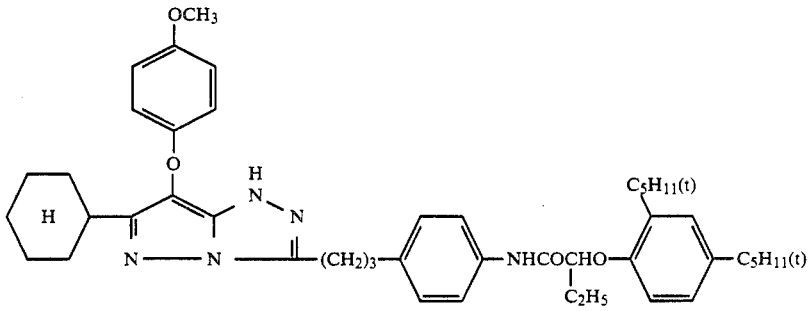
93
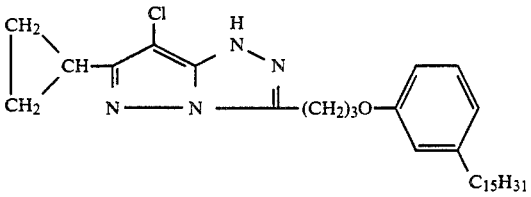
94
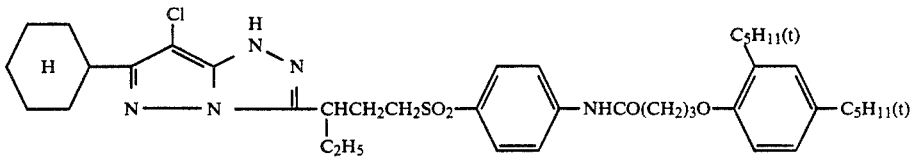
95
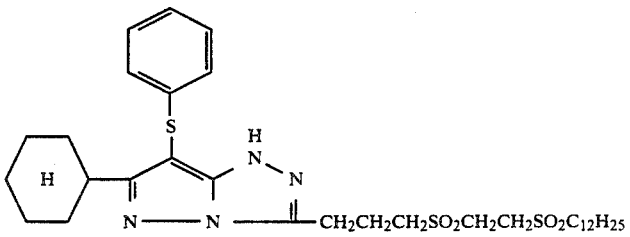

-continued
96
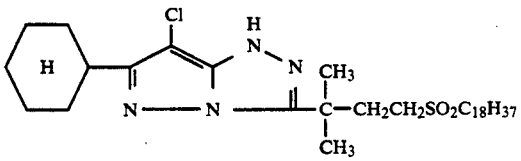
97
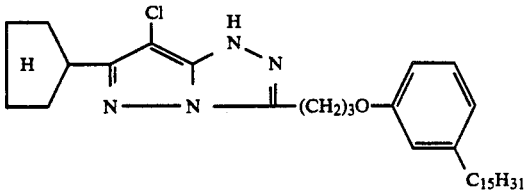
98
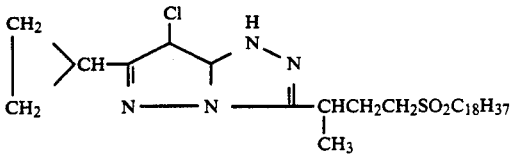
99
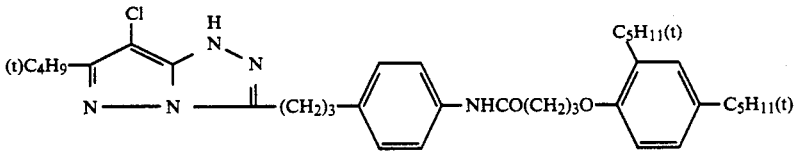
100
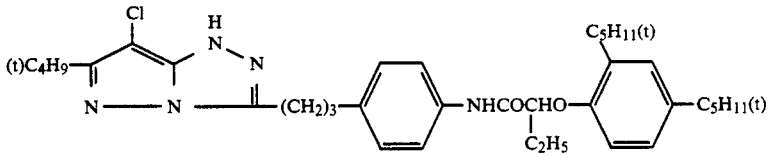
101
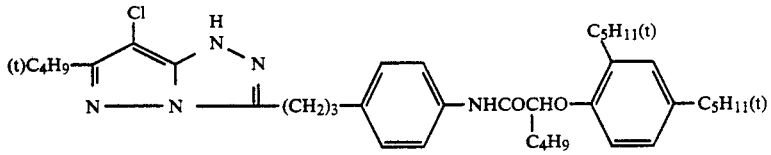
102
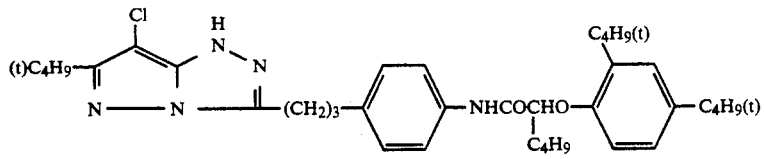
103
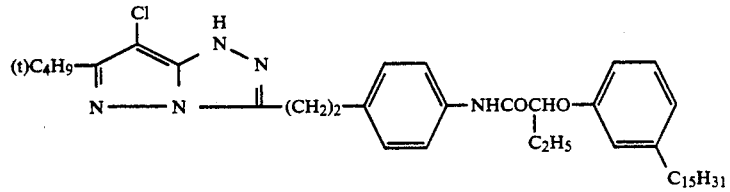
104
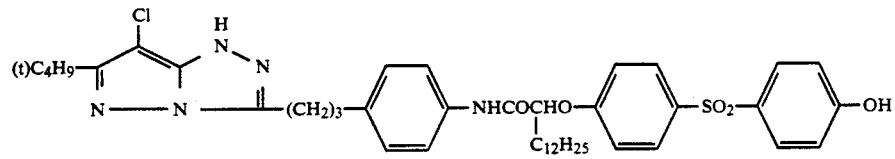

-continued
105
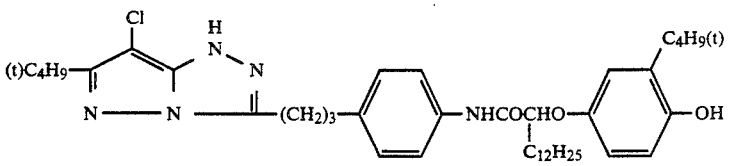
106
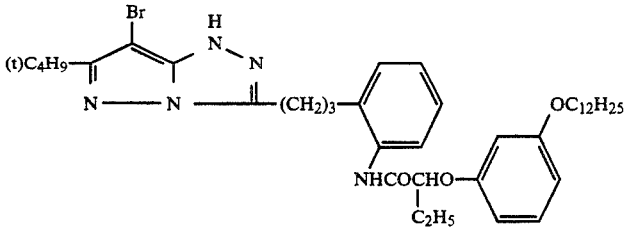
107
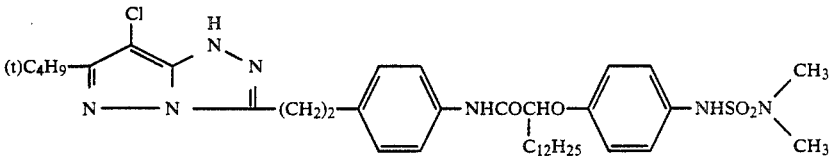
108
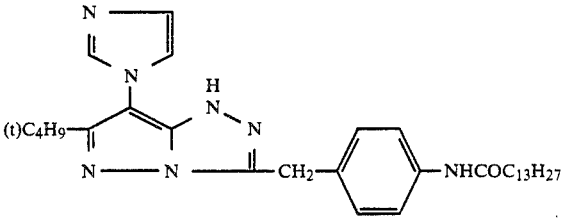
109
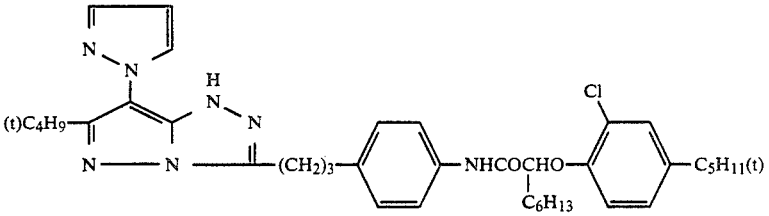
110
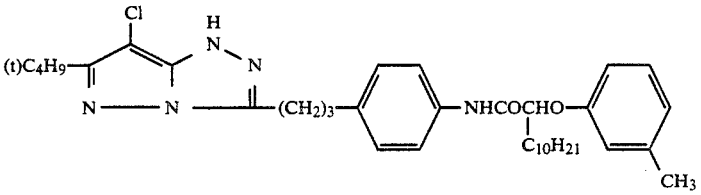
111
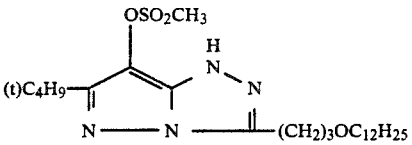
112
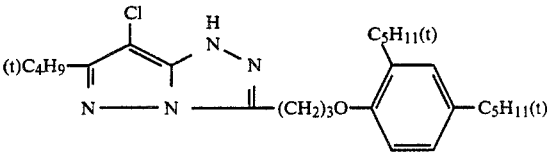

-continued
113
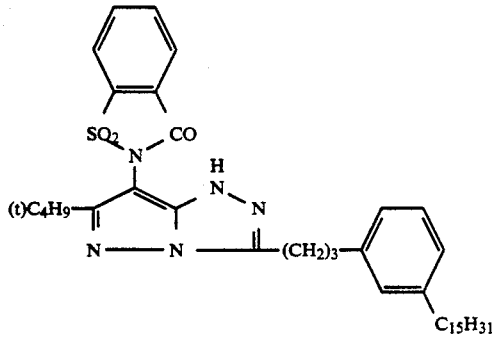
114
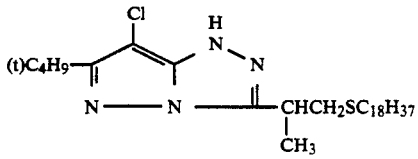
115
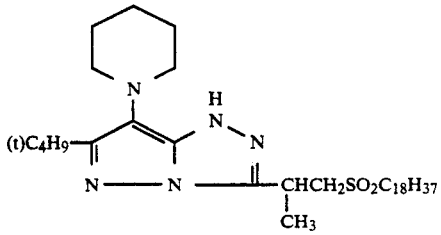
116
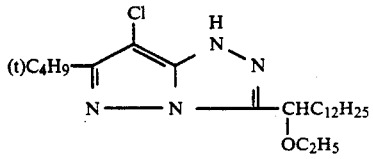
117
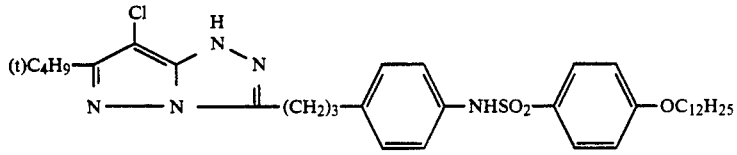
118
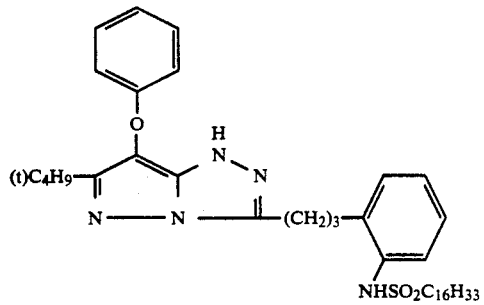
119
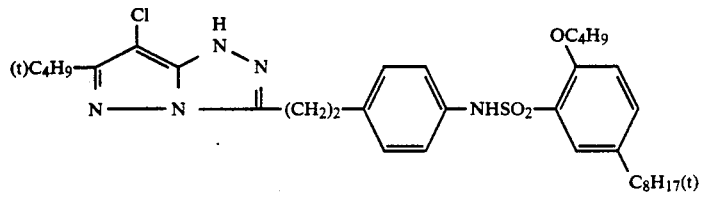

-continued
120
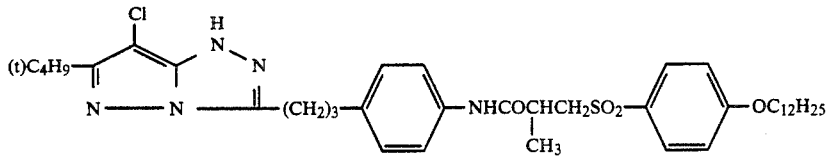
121
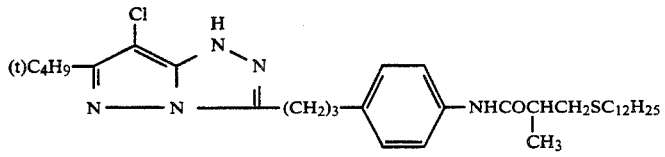
122
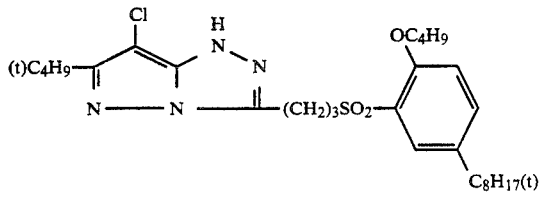
123
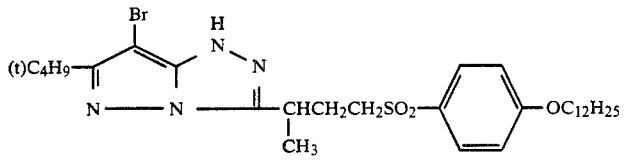
124
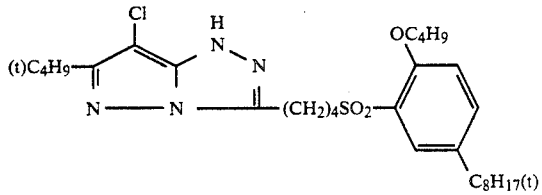
125
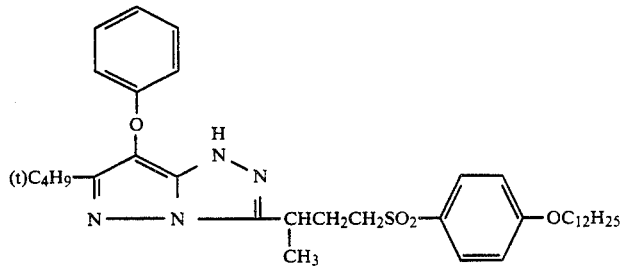
126
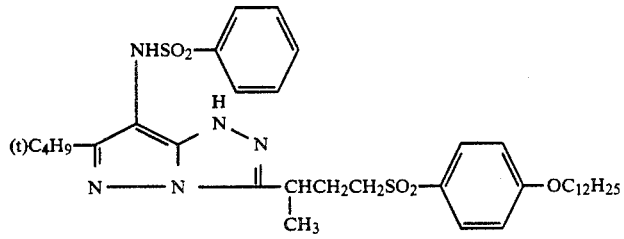
127
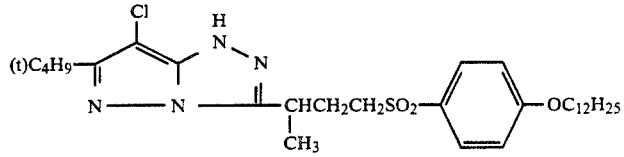

-continued
128
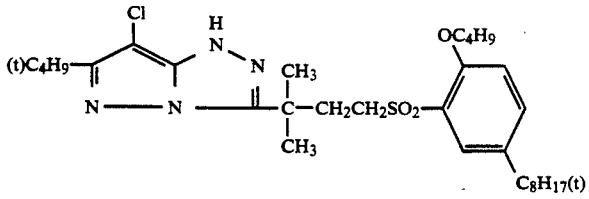
129
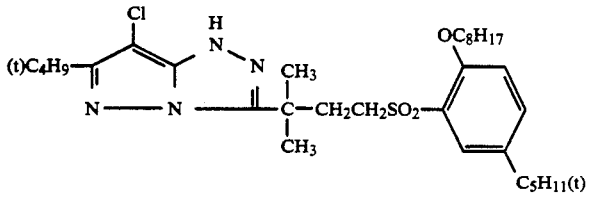
130
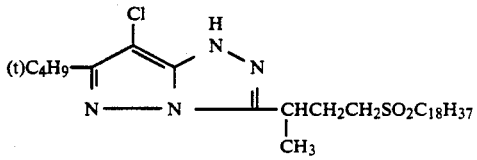
131
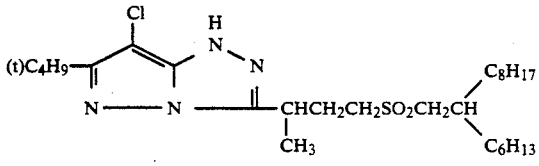
132
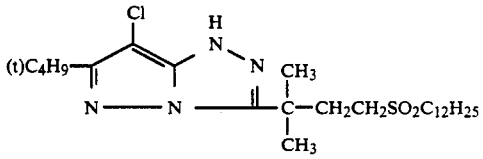
133
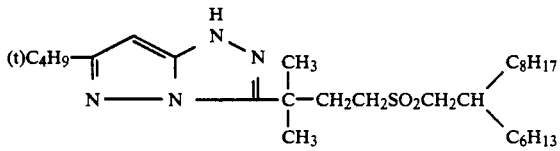
134
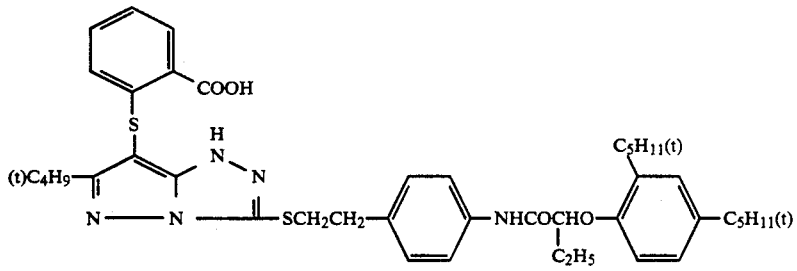
135
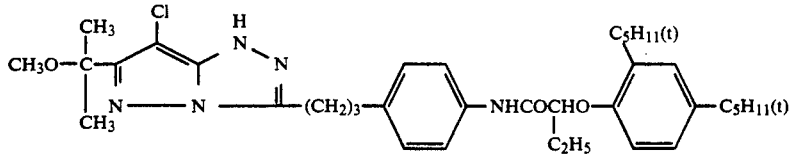

-continued
136
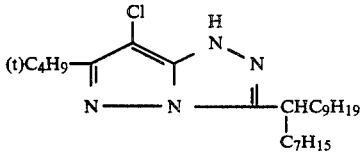
137
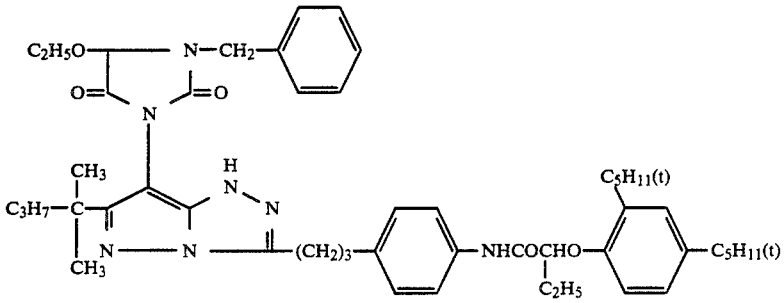
138
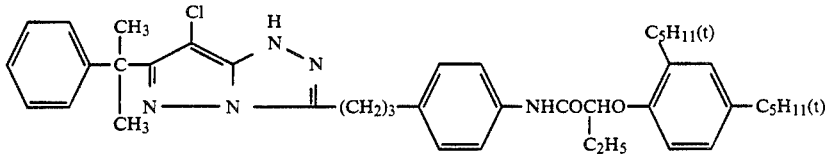
139
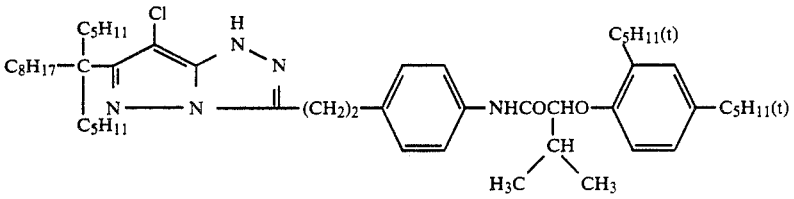
140
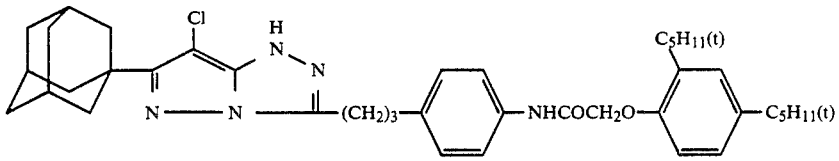
141
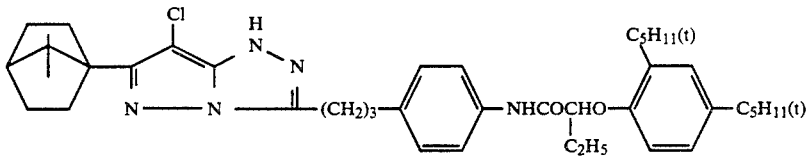
142
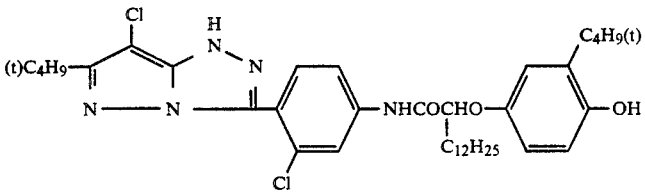

-continued
143
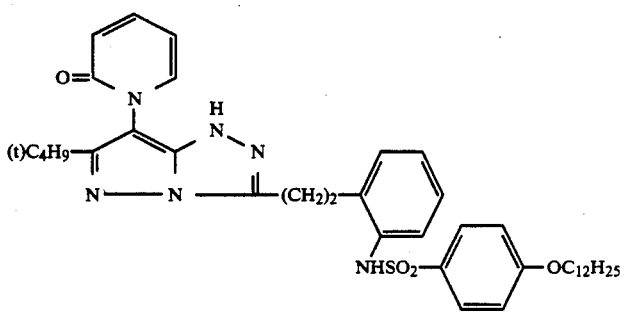
144
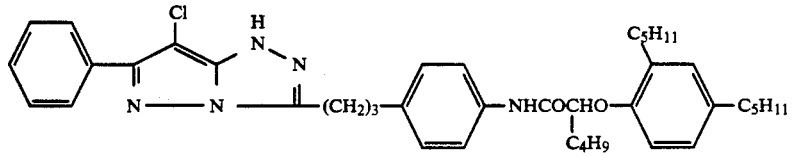
145
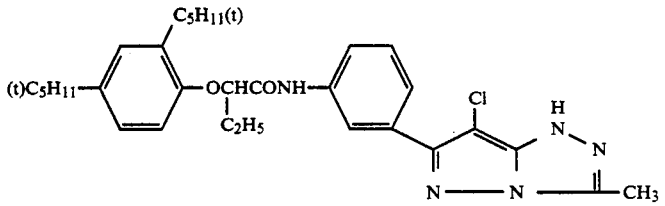
146
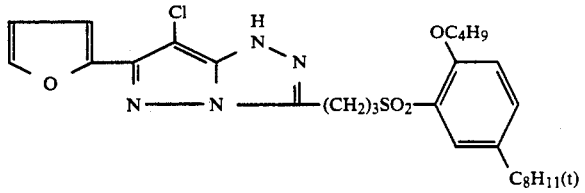
147
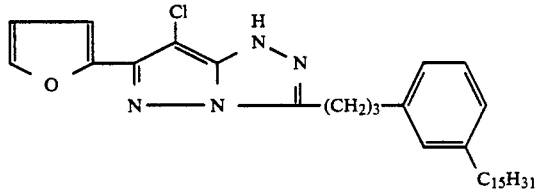
148
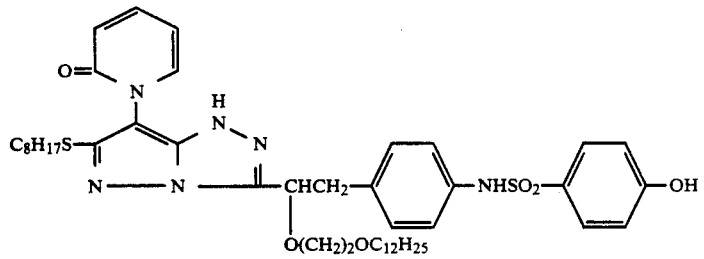
149
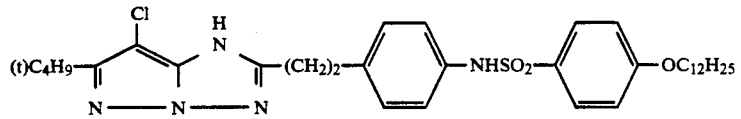
150
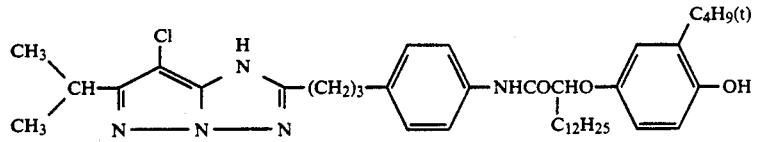

-continued
151
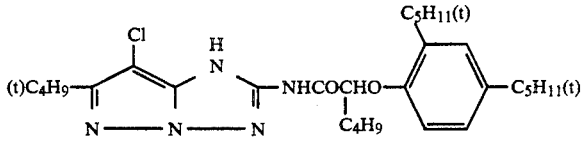
152
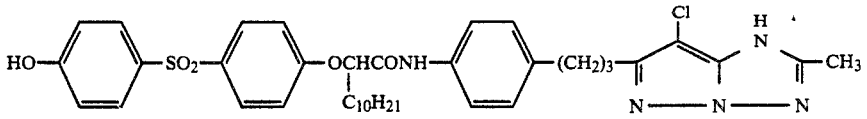
153
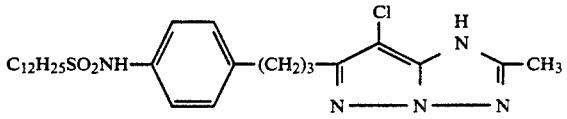
154
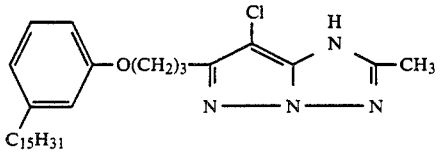
155
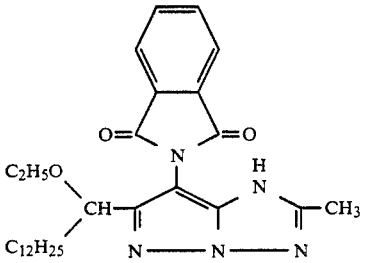
156
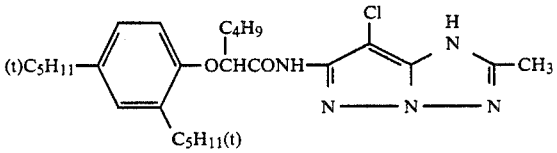
157
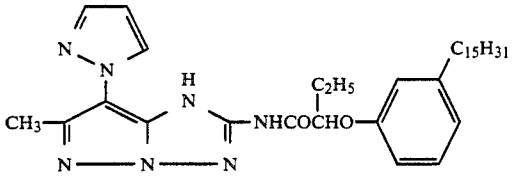
158
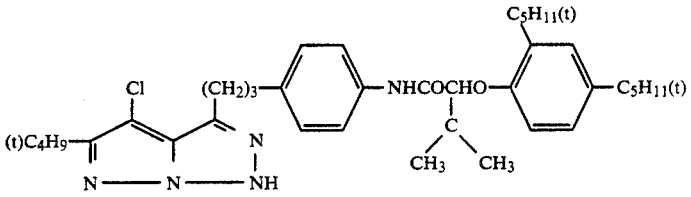
159
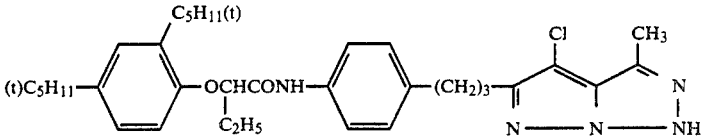

-continued
160
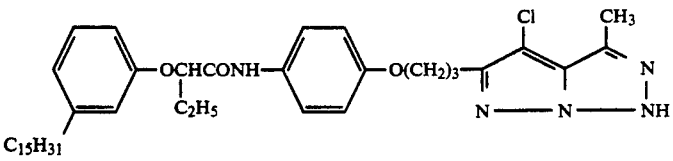
161
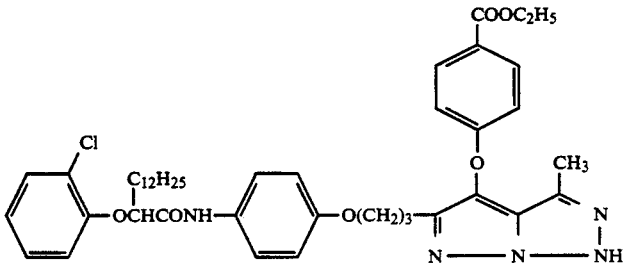
162
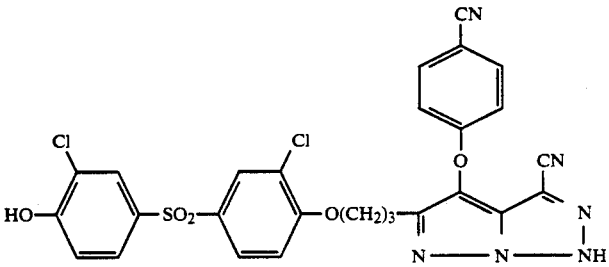
163
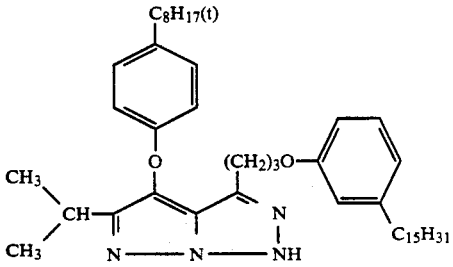
164
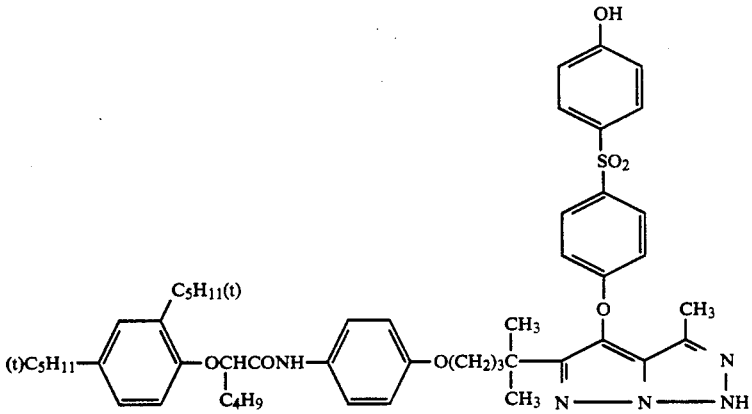
165
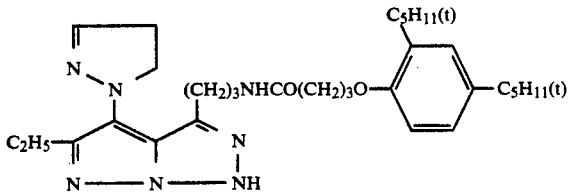

-continued
166
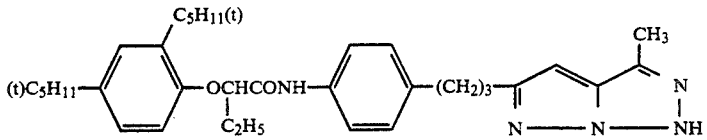
167
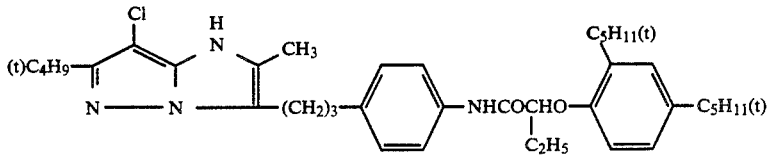
168
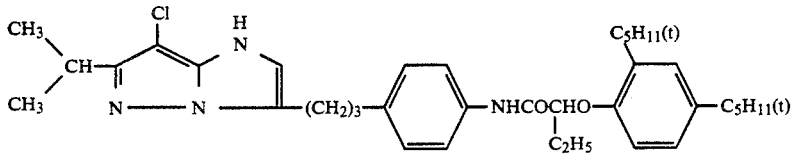
169
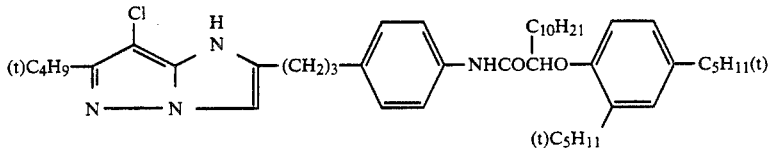
170
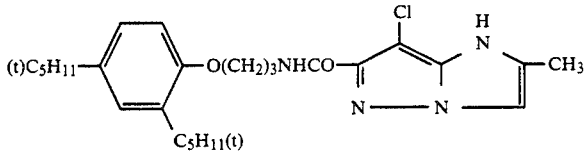
171
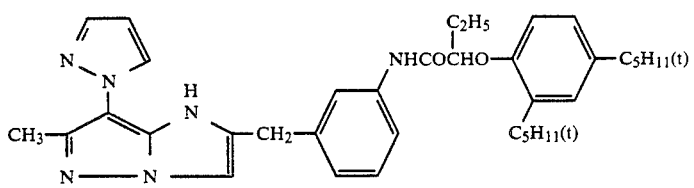
172
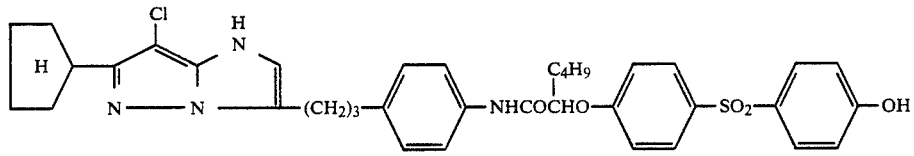
173
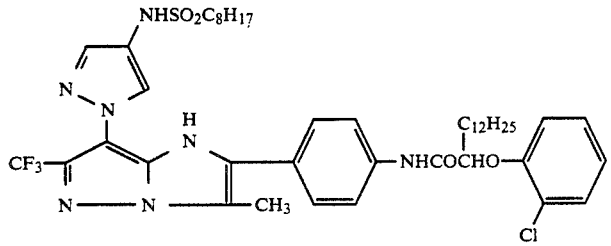
174
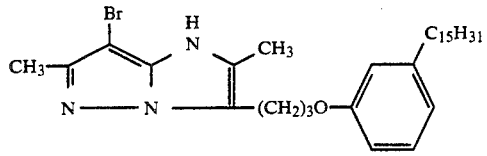

-continued
175
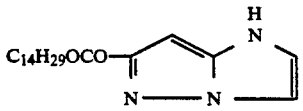
176
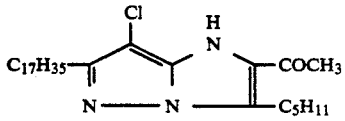
177
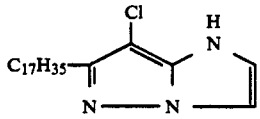
178
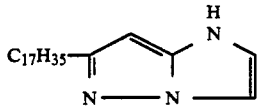
179
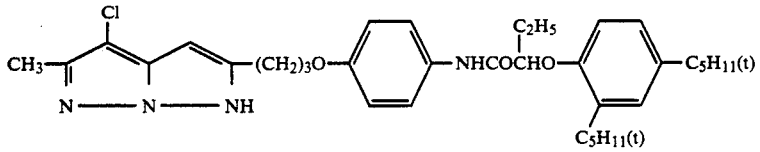
180
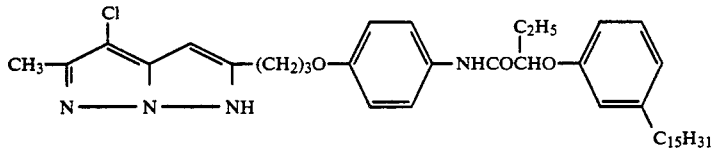
181
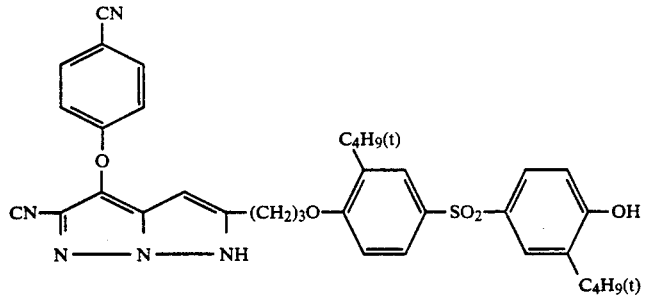
182
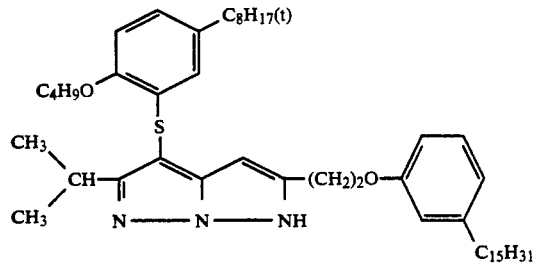
183
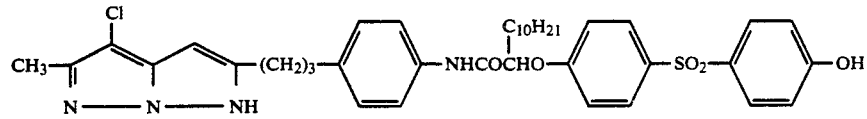

-continued
184
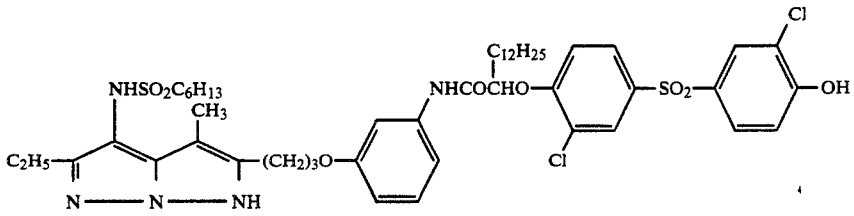
185
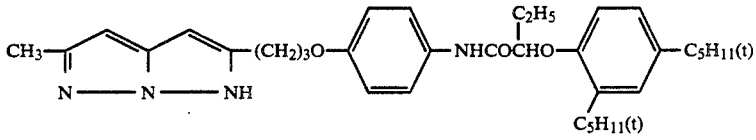
186
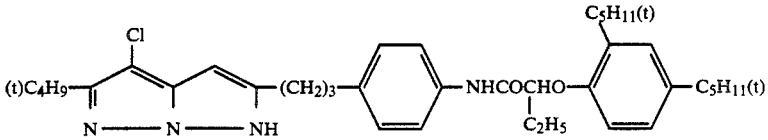
187
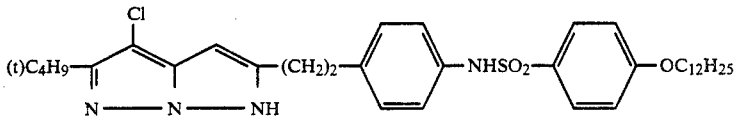
188
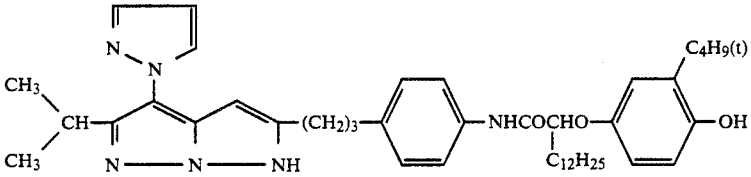
189
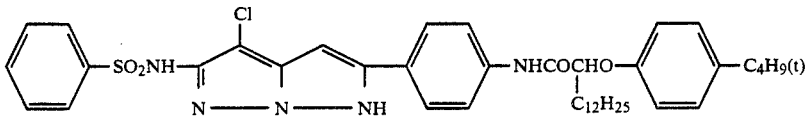
190
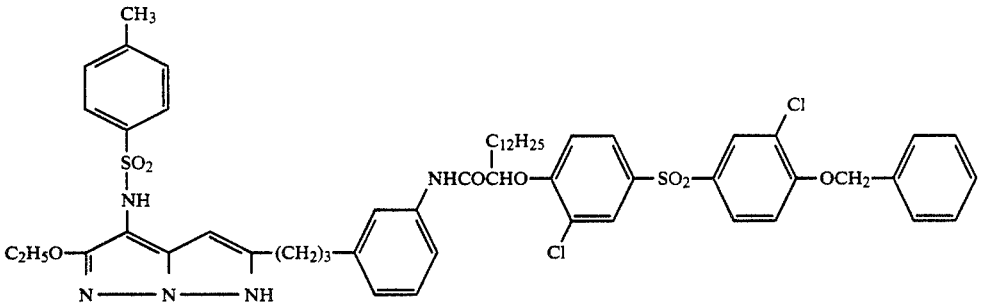
191
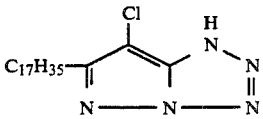
192
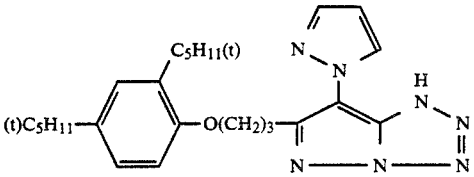

-continued

193

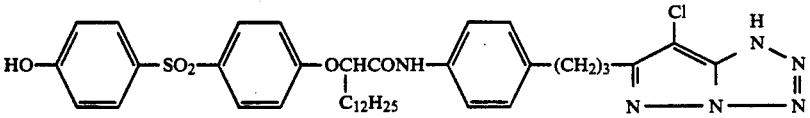

194

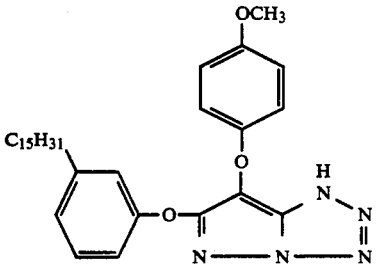

195

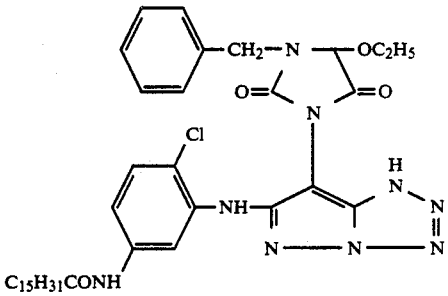

196

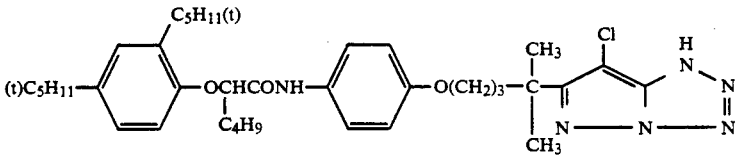

197

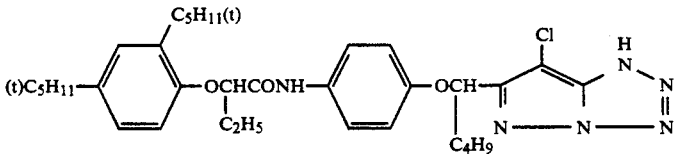

198

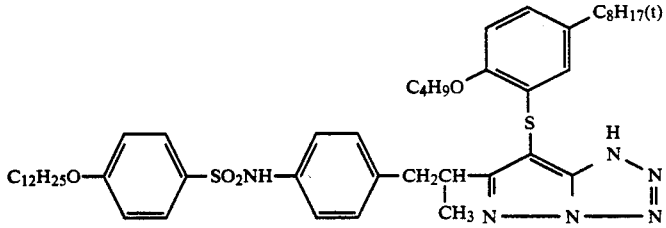

199

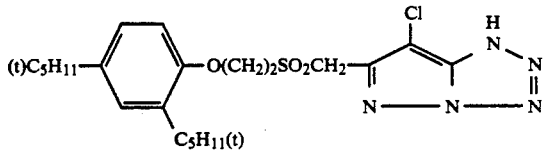

Syntheses of the above representative couplers were carried out by making reference to Journal of the Chemical Society, Perkin I, 1977, pp 2047-2052, U.S. Pat. No. 3,725,067 and Japanese Unexamined Patent Publications No. 99437/1984 and No. 42045/1983.

The couplers of this invention may be used usually in the range of $1\times10^{-3}$ mole to 1 mole, preferably $1\times10^{-2}$ to $8\times10^{-1}$ mole, per mole of silver halide.

The couplers of this invention may also be used in combination with other kinds of magenta couplers.

Next, as the light-sensitive silver halide grains having outer surfaces principally comprised of {100} face (hereinafter referred to as "silver halide grains according to this invention" unless particularly mentioned), they may include those having the crystal habit of a cube comprising {100} face only or those having the crystal habit of a tetradecahedron comprising {100} face and {111} face. Preferably, they include tetradecahedral silver halide grains satisfying the relationship of $0.5 < K < 50{,}000$ when represented by K = (Intensity of diffraction rays assigned to {200} face)/(Intensity of diffraction rays assigned to {222} face), which is measured by the X-ray diffraction method disclosed in Japanese Unexamined Patent Publication No. 9243/1984. Further, the effect of the invention becomes particularly remarkable when they are tetradecahedral silver halide grains satisfying the relationship of $5 < K < 500$.

The silver halide grains according to this invention may be either polydispersed or monodispersed. Preferably, they include monodispersed silver halide grains having, in the grain size distribution of silver halide grains, the variation coefficient of 0.22 or less, more preferably, those having the same of 0.15 or less. Here, the variation coefficient refers to a coefficient showing the width of the grain distribution, and is defined by the following equation:

$$\text{Variation coefficient } (s/\bar{r}) = \frac{\text{Standard deviation of grain size distribution}}{\text{Average grain size}}$$

$$\text{Standard deviation of grain size distribution } (S) = \sqrt{\frac{\Sigma^2_{(\bar{r}-ri)}ni}{\Sigma ni}}$$

$$\text{Average grain size } (\bar{r}) = \frac{\Sigma niri}{\Sigma ni}$$

In the above, ri and ni represent the grain size of each grain and the number thereof, respectively. The grain size mentioned herein refers, in the case of spherical silver halide grains, to the diameter, and, in the case of cubic or other than spherical silver halide grains, it refers to the diameter determined by converting a projected image thereof to a circular image having an equal area.

The silver halide grains according to this invention have an average grain size preferably ranging between 0.2 and 0.8 μm. When the average grain size is less than 0.2 μm, the grains tend to be affected by change in the conditions for developing processing, and when it is more than 0.8 μm, the sensitivity to blue light becomes lower both of which are undesirable from the view point of the color reproduction. More preferably, the silver halide grains according to this invention have an average grain size of 0.3 to 0.7 μm.

There is no particular limitation to the compositional arrangement for silver halides in the silver halide grains according to this invention, but it is preferred that it has low content for silver iodide to give substantially a silver chlorobromide emulsion. Here, what is meant by "substantially a silver chlorobromide emulsion" is that the silver halide in the silver halide grains contained in the silver halide emulsion comprises less than 1 mole of silver iodide and the balance being silver chloride and silver bromide. If the content of silver iodide is higher, the sensitivity to blue light of the silver halide grains becomes higher to make them undesirable from the viewpoint of the color reproduction. On the other hand, the higher the content of silver chloride is, the lower the sensitivity to blue light becomes, to make the grains desirable from the viewpoint of the color reproduction.

The content of the silver chloride in the silver halide grains according to this invention is preferably 5 mole % or more, more preferably, 15 mole % or more.

The compositional arrangement for silver halide grains according to this invention may be uniform from an inner portion to an outer portion of a grain, or may be different between the inner portion and the outer portion. Also, when the compositional arrangement is different between the inner portion and the outer portion of a grain, it may be continuously varied or noncontinuous.

The silver halide grains according to this invention may be those obtained by any of an acidic method, a neutral method and an ammonium method. The grains may be allowed to grow at a time, or may be allowed to grow after formation of seed grains. The method of preparing seed grains and the method for growth may be the same or different.

Also, method of reacting a soluble silver salt with a soluble halogen salt may include any of a regular mixing method, a reverse mixing method, a simultaneous mixing method and a combination of these methods, but preferred is a simultaneous mixing method to obtain the silver halide grains. For preparing monodispersed silver halide grains, it is also possible to employ the pAg-controlled-double jet method disclosed in Japanese Unexamined Patent Publication No. 48521/1979 as an embodiment of the simultaneous mixing method.

Besides, if necessary, there may be used a silver halide solvent such as thioether or a crystal habit controlling agent such as a mercapto group-containing compound and a sensitizing dye.

To the silver halide grains according to this invention, metal ions may be added by using a cadmium salt, a zinc salt, a lead salt, a thallium salt, an iridium salt or a complex salt thereof, a rhodium salt or a complex salt thereof, an iron salt or a complex salt thereof, etc. during the course of the formation and/or growth of grains to have them included in the inside and/or the surface of a grain, and also, reduction sensitizing nuclei may be imparted to the inside and/or the surface of a grain by placing grains in an appropreate reducible atmosphere.

The silver halide emulsion according to this invention may be those from which unnecessary soluble salts have been removed after completion of the growth of silver halide grains, or those containing them as they are.

When the salts are to be removed, the method disclosed in Research Disclosure No. 17643 may be used.

In the silver halide emulsion layer containing the magenta coupler according to this invention, the silver halide grains according to this invention may be used alone or by mixing of plural kinds thereof. Also, they may be used in combination with other silver halide grains than the silver halide grains of the invention, which, for example, are grains not having {100} face (for example, octahedral grains). In such a case, however, the proportion of the grains not having {100} face is preferably not more than 50% of the projected area held by the whole silver halide grains.

The silver halide grains according to this invention may be chemically sensitized by a conventional method. Namely, the sulfur sensitization using a compound containing sulfur capable of reacting with silver ion, or an active gelatin, the selenium sensitization using a selenium compound, the reduction sensitization using a reducible substance, the noble metal sensitization using noble metal compound such as gold, etc. may be employed singularly or in combination.

The silver halide grains according to this invention may be optically sensitized to a desired wavelength region by using a dye known in the photographic field as a sensitizing dye. The sensitizing dye may be used singularly or may be used in combination of two or more kinds. Together with such sensitizing dye(s), a supersensitizer which is a dye having no photosensitizing action by itself or a compound not substantially absorbing any visible light, and which strengthens the sensitizing action in a sensitizing dye.

The silver halide grains according to this invention is preferably subjected to spectral sensitization so as to have the sensitivity to green light.

To the silver halide grains according to this invention, a compound known in the photographic field as an antifoggant or a stabilizer may be added during the course of chemical ripening and/or at the time of completion of chemical ripening and/or after completion of chemical ripening, but before coating of a silver halide emulsion, for the purpose of preventing fogs and/or keeping stable photographic performances during the course of the preparation of photographic materials, during storage thereof or during the course of photographic processing.

As for a binder (or a protective colloid) in an emulsion layer containing the silver halide grains according to this invention, it is advantageous to use gelatin. Becides it, there may be also used hydrophilic colloids such as a gelatin derivative, a graft polymer of gelatin with other polymers, a protein, a sugar derivative, a cellulose derivative, a synthetic hydrophilic polymer of homopolymer or copolymer, etc.

In the light-sensitive silver halide color photographic material of this invention (referred to hereinafter as "light-sensitive material of this invention"), the photographic emulsion layer and other hydrophilic colloid layer may be hardened by using singularly or in combination a hardening agent or agents which bridge binder (or protective colloid) molecules to enhance the membrane strength. The hardening agent is preferably added in an amount that can harden a light-sensitive material to such a degree that may not necessitate adding another hardening agent in a processing solution, but it is also possible to add the hardening agent in the processing solution A plasticizer may be added for the purpose of enhancing the flexibility of the silver halide emulsion layer and/or other hydrophilic colloid layer in the light-sensitive material of the invention.

In the photographic emulsion layer and other hydrophilic colloid layer of the light-sensitive material using the silver halide emulsion of this invention, a dispersion of water-soluble or insoluble synthetic polymer (a latex) may be contained for the purpose of improving, for example, the dimentional stability.

In the emulsion layer of the light-sensitive material of this invention, when carrying out color developing, a dye forming coupler is used, which may form a dye by a coupling reaction with an oxidation product of an aromatic primary amine developing agent (for example, a p-phenylenediamine derivative, an aminophenol derivative, etc.). Usually, the dye forming coupler is selected so that there may be formed dyes which absorb light-sensitive spectral light of emulsion layer with respect to the respective emulsion layers, and thus a yellow dye forming coupler, a magenta dye forming coupler and a cyan dye forming coupler are used in a blue light-sensitive emulsion layer, a green light-sensitive emulsion layer and a red light-sensitive emulsion layer, respectively. However, depending on an object, they may be also used in a different manner from the above combination to prepare the light-sensitive material of this invention.

The yellow dye forming coupler includes an acylacetoamido coupler (for example, benzoylacetoanilides, pivaloyacetoanilides, etc.); the magenta dye forming coupler includes, besides the couplers of this invention, a 5-pyrazolone coupler, a pyrazolobenzimidazole coupler, a pyrazolotriazole coupler, an open chained acylacetonitrile coupler, etc.; and the cyan dye forming coupler includes a naphthol coupler, a phenol coupler, etc.

These couplers preferably have a group having 8 or more carbon atoms, called as a ballast group, which is capable of making the coupler non-dispersible. Also, these dye forming couplers may be either of four equivalents wherein four silver ions must be reduced to form a dye of one molecule, or of two equivalents wherein only two silver ions may be reduced.

With respect to a hydrophobic compound such as a dye forming coupler which is not required to be adsorbed on the crystal surface of a silver halide, there may be employed various methods such as a solid dispersion method, a latex dispersion method and an oil-in-water type emulsion dispersion method, which may be optionally selected depending on the chemical structure of the hydrophobic compounds such as a coupler. According to the oil-in-water type emulsion dispersion method, a method of dispersing a hydrophobic additive such as a coupler may be applied, which method may usually comprise dissolving in a high boiling organic solvent boiling at about 150° C. or higher a low boiling organic solvent and/or a water soluble organic solvent which may be optionally used in combination, and carrying out emulsification dispersion by using a surface active agent in a hydrophilic binder such as a gelatin solution and by using a dispersion means such as a stirrer, a homogenizer, a colloid mill, a flow jet mixer, an ultrasonic device, etc., followed by adding a resultant dispersion to the aimed hydrophilic colloid layer. After dispersion or at the time of the dispersion, a step to remove the low boiling organic solvent may be included.

As the high boiling organic solvent, an organic solvent boiling at 150° C. or higher may be used, comprising a phenol derivative, a phthalate, a phosphate, a citrate, a benzoate, an alkylamide, an aliphatic acid ester, a trimesic acid ester, etc. which do not react with the oxidation product of a developing agent.

As a dispersing aid to be used when the hydrophobic compound is dissolved in the solvent employing a low boiling solvent alone or in combination with the high boiling solvent to carry out the dispersion by use of a mechanical means or a ultrasonic wave, there may be used an anionic surface active agent, a nonionic surface active agent and cationic surface active agent.

It may occur that an oxidation product of developing agent or an electron-transferring agent is transferred between the emulsion layers ( between layers having same color sensitivity and/or between layers having different color sensitivity) of the light-sensitive color photographic material of this invention, to cause color turbidity or make conspicuous the deterioration in sharpness and the graininess. In order to prevent these, a color fog preventive agent is be used.

The color fog preventive agent may be used in the emulsion layer itself, or an intermediate layer may be provided between contiguous layers to use it in the intermediate layer.

In the light-sensitive material of this invention, an image stabilizing agent may be used to prevent the deterioration in dye images.

The image stabilizing agent which may be preferably used in this invention may include those represented by Formulas (A) to (H), (J) and (K) shown below:

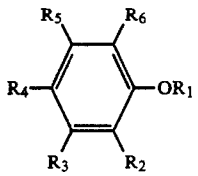

Formula (A)

In the formula, $R^1$ represents a hydrogen atom, an alkyl group, an alkenyl group, an aryl group or a heterocyclic group; $R^2$, $R^3$, $R^5$ and $R^6$ each represent a hydrogen atom, a halogen atom, a hydroxyl group, an alkyl group, an alkenyl group, an ary group, an alkoxy group or an acylamino group; $R^4$ represents an alkyl group, a hydroxyl group, an aryl group or an alkoxy group. $R^1$ and $R^2$ may be ring-closed each other to form a 5- or 6-membered ring, whereat $R^4$ represents a hydroxyl group or an alkoxy group. Also, $R^3$ and $R^4$ may be ring-closed to form a hydrocarbon ring of 5 members, whereat $R^1$ represents an alkyl group, an aryl group or a heterocyclic group, except the case where $R^1$ is a hydrogen atom and $R^4$ is a hydroxyl group.

In the above Formula (A), wherein $R^1$ represents a hydrogen atom, an alkyl group, an alkenyl group, an aryl group or a heterocyclic group, the alkyl group may include, for example, straight-chain or branched alkyl groups such as a methyl group, an ethyl group, a propyl group, n-octyl group, tert-octyl group and hexadecyl group. The alkenyl group represented by $R^1$ may include, for example, an ally group, a hexenyl group, an octenyl group, etc. Further, the aryl group represented by $R^1$ may include each of a phenyl group and a naphthyl group.

Further, the heterocyclic group represented by $R^1$ may include, specifically, a tetrahydropyranyl group, a pyrimidyl group, etc. These groups may each have a substituent. For example, as the alkyl group having a substituent, it may include a benzyl group and an ethoxymethyl group; as the aryl group having a substituent, a methoxyphenyl group, a chlorophenyl group, a 4-hydroxy-3,5-dibutylphenyl group, etc.

In Formula (A), wherein $R^2$, $R^3$, $R^5$ and $R^6$ each represent a hydrogen atom, a halogen atom, a hydroxyl group, an alkyl group, an alkenyl group, an ary group, an alkoxy group or an acylamino group, the alkyl group, the alkenyl group and the aryl group may include the alkyl group, the alkenyl group and the aryl group mentioned for the above $R^1$. Also, the above halogen atom may include, for example, fluorine, chlorine, bromine, etc. Further, the above alkoxy group may include specifically a methoxy group, an ethoxy group, etc. Further, the above acylamino group is represented by R'CONH—, wherein R' represents an alkyl group (for example, groups such as methyl, ethyl, n-propyl, n-butyl, n-octyl, tert-octyl and benzyl), an alkenyl group (for example, groups such as allyl, octinyl and oleyl), an aryl group (for example, groups such as phenyl, methoxyphenyl and naphthyl) or a heterocyclic group (for example, groups such as pyridyl and pyrimidyl).

In the above Formula (A), wherein $R^4$ represents an alkyl group, a hydroxyl group, an aryl group or an alkoxy group, the alkyl group and the aryl group may include specifically those same as in the alkyl group and the aryl group represented by the above $R^1$. Also, the alkenyl group represented by $R^4$ may include those same as in the alkoxy group mentioned for the above $R^2$, $R^3$, $R^5$ and $R^6$.

The ring formed together with a benzene by ring closure of $R^1$ and $R^2$ may include, for example, chroman, coumaran and methylenedioxybenzene. Also, the ring formed together with a benzene ring by ring closure of $R^3$ and $R^4$ may include, for example, indane. These rings may have a substituent (for example, alkyl, alkoxy and aryl).

An atom in the ring formed by ring closure of $R^1$ and $R^2$ or ring closure of $R^3$ and $R^4$ may be a spiro atom to form a spiro compound, or $R^2$ and $R^4$ may be a linking group to form a bis body.

Of the phenol series compounds and the phenylether series compounds represented by the above Formula (A), preferable is a biindane compound having four RO-groups (wherein R represents an alkyl group, an alkenyl group, an aryl group or a heterocyclic group), particularly preferable is a compound represented by Formula (A-1) shown below:

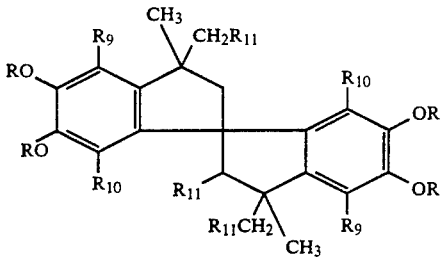

Formula (A-1)

In the formula, R represents an alkyl group (for example, methyl, ethyl, propyl, n-octyl, tert-octyl, benzyl and hexadecyl), an alkenyl group (for example, allyl, octenyl and oleyl), an aryl group (for example, phenyl and naphthyl) or a heterocyclic group (for example, tetrahydropyranyl and pyrimidyl). $R^9$ and $R^{10}$ each represent a hydrogen atom, a halogen atom (for example, fluorine, chlorine and bromine), an alkyl group (for example, methyl, ethyl, n-butyl and benzyl), an alkoxy group (for example, allyl, hexenyl and octenyl) or an alkoxy group (for example, methoxy, ethoxy and benzyloxy); $R^{11}$ represents a hydrogen atom, an alkyl group (for example, methyl, ethyl, n-butyl and benzyl), an alkenyl group (for example, 2-propenyl, hexenyl and octenyl) or an aryl group (for example, phenyl, methoxyphenyl, chlorophenyl and naphthyl).

The compound represented by the above Formula (A) may also include the compounds disclosed in U.S. Pat. Nos. 3,935,016, 3,982,944 and 4,254,216, Japanese Unexamined Patent Publications No.21004/1980 and No.145530/1979, British Patent Publications No. 2,077,455 and No. 2,062,888, U.S. Pat. Nos. 3,764,337, 3,432,300, 3,574,627 and 3,573,050, Japanese Unexamined Patent Publications No. 152225/1977, No. 20327/1978, No. 17729/1978 and No. 6321/1980, British Patent No. 1,347,556, British Patent Publication No.2,066,975, Japanese Patent Publications No. 12337/1979 and No. 31625/1973, U.S. Pat. No. 3,700,455, etc.

The compound represented by the above Formula (A) may be used in an amount of 5 to 300 mole %, preferably 10 to 200 mole % based on the magenta coupler.

Typical examples of the compound represented by Formula (A) are shown below:

Type (1)
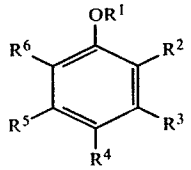
Type (2)
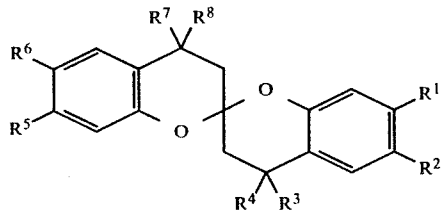
Type (3)
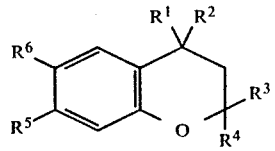
Type (4)
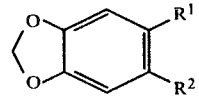
Type (5)
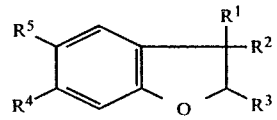
Type (6)
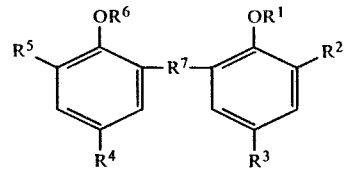

-continued

Type (7)

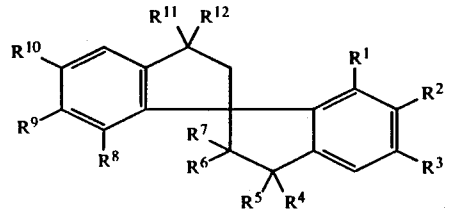

Type (1)

| Comp. No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

Type (2)

| Comp. No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

Type (3)

| Comp. No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | $(t)C_8H_{17}$ | OH |
| A-11 | $CH_3$ | $CH_3$ | H | $CH_3$ | $(t)C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | $(t)C_8H_{17}$ | OH |
| A-18 | $CH_3$ | $CH_3$ | $CH_3$ | 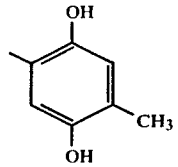 | $CH_3$ | OH |

Type (4)

| Comp. No. | $R^1$ | $R^2$ |
|---|---|---|
| A-4 | $C_3H_7$ | 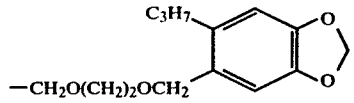 |
| A-9 | $C_3H_7$ | $-CH_2O(CH_2)_2OC_4H_9$ |

-continued

Type (5)

| Comp. No. | $R^1$ | $R^2$ | $R^3$ | $R^4$ | $R^5$ |
|---|---|---|---|---|---|
| A-5 | $CH_3$ | $CH_3$ | $C_2H_5O$ | (t)$C_8H_{17}$ | OH |

Type (6)

| Comp. No. | $R^1$ | $R^2$ | $R^3$ | $R^4$ | $R^5$ | $R^6$ | $R^7$ |
|---|---|---|---|---|---|---|---|
| A-6 | H | (t)$C_4H_9$ | $CH_3$ | $CH_3$ | (t)$C_4H_9$ | H | $CH_2$ |
| A-15 | $CH_3$ | (t)$C_4H_9$ | $CH_3$ | $CH_3$ | (t)$C_4H_9$ | $CH_3$ | $CH_2$ |

Type (7)

| Comp. No. | $R^1$ | $R^2$ | $R^3$ | $R^4$ | $R^5$ | $R^6$ | $R^7$ | $R^8$ | $R^9$ | $R^{10}$ | $R^{11}$ | $R^{12}$ |
|---|---|---|---|---|---|---|---|---|---|---|---|---|
| A-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| A-19 | H | $CH_3O$ | $CH_3O$ | $CH_3$ | $CH_3$ | H | H | H | $CH_3O$ | $CH_3O$ | $CH_3$ | $CH_3$ |
| A-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| A-22 | H | $CH_3O$ | $CH_3O$ | $C_2H_5$ | $CH_3$ | H | $CH_3$ | H | $CH_3O$ | $CH_3O$ | $CH_3$ | $C_2H_5$ |
| A-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| A-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-29 | H | (s)$C_5H_{11}O$ | (s)$C_5H_{11}O$ | $CH_3$ | $CH_3$ | H | H | H | (s)$C_5H_{11}O$ | (s)$C_5H_{11}O$ | $CH_3$ | $CH_3$ |
| A-30 | H | $C_4H_9O$ | $C_4H_9O$ | (i)$C_3H_7$ | $CH_3$ | $CH_3$ | $CH_3$ | H | $C_4H_9O$ | $C_4H_9O$ | (i)$C_3H_7$ | $CH_3$ |
| A-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

A-7

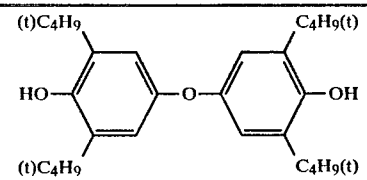

Formula (B)

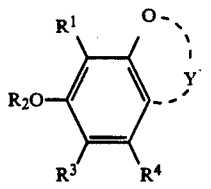

wherein, $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^2$ represents a hydrogen atom, an alkyl group, an alkenyl group, an aryl group an acyl group, a cycloalkyl group or a heterocyclic group; and R represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, an acyloxy group, a carbamoyl group, a sulfonamide group, a sulfamoyl group, etc.

Also, $R^2$ and $R^3$ may be ring-closed each other to form a 5- or 6-membered ring. The ring formed together with a benzene ring by the ring closure of $R^2$ and $R^3$ may include, for example, a chroman ring and a methyleneoxybenzene ring.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (B), compounds most useful for this invention are included in the compounds represented by Formulas (B-1), (B-2), (B-3), (B-4) and (B-5).

Formula (B-1)

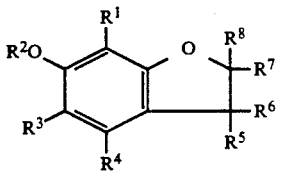

Formula (B-2)

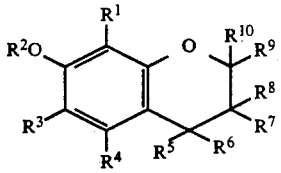

-continued

Formula (B-3)

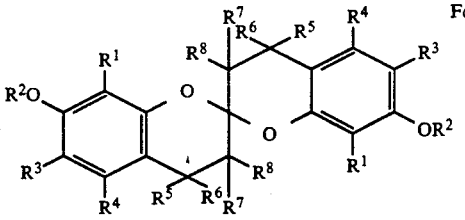

Formula (B-4)

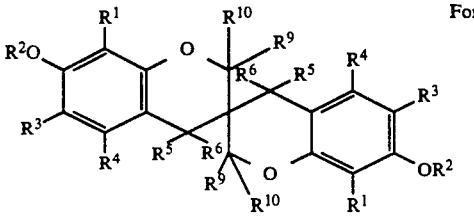

Formula (B-5)

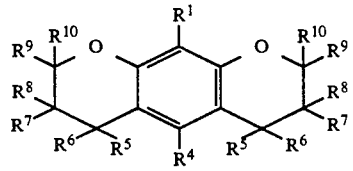

$R^1$, $R^2$, $R^3$ and $R^4$ in Formulas (B-1), (B-2), (B-3), (B-4) and (B-5) have the same meaning as those in the above Formula (B), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Also, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

In the above Formulas (B-1), (B-2), (B-3), (B-4) and (B-5), particularly useful compounds are those in which $R^1$ and $R^4$ are each a hydrogen atom, an alkyl group, an alkoxy group, a hydroxyl group or a cycloalkyl group, and $R^5$, $R^6$, $R^7$, $R^8$, $R^9$ and $R^{10}$ are each a hydrogen atom, an alkyl group or a cycloalkyl group.

The compounds represented by Formula (B) include the compounds disclosed in Tetrahedron Letters, 1970, Vol. 126, pp 4743–1751; Japan Chemical Society, 1972, No. 10, pp 0987–1990; Chem. Lett., 1972, (4), pp 315–316 and Japanese Unexamined Patent Publication No. 139383/1980, and may be synthesized by the methods also disclosed in these publications.

The above compounds represented by Formula (B) may be used preferably in an amount of 5 to 300 mole %, more preferably 10 to 200 mole %, based on the above-mentioned magenta coupler of this invention.

Typical examples of these compounds are shown below:

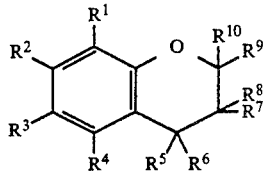

| Comp. No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 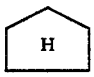 | H | H | $CH_3$ | H | H | $CH_3$ | $CH_3$ |
| B-5 | H | $CH_3$ | H | H | H | $CH_3$ | H | H | $CH_3$ | $CH_3$ |
| B-9 | $CH_3$ | H | $CH_3$ | H | H | H | H | 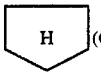 (Condensed) | | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 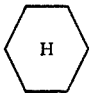 | H | H | $CH_3$ | $CH_3$ | H | H | $CH_2OH$ | $CH_3$ |
| B-14 | H | 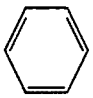 | H | H | $CH_3$ | $CH_3$ | H | H | $CH_3$ | $CH_3$ |
| B-15 | H | H | | $CH_2{=}CHCH_2CO$ | $CH_3$ | $CH_3$ | H | H | 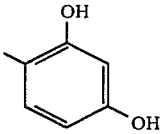 | $CH_3$ |
| B-16 | H | H | H | $CH_3SO_2NH$ | $CH_3$ | $CH_3$ | H | H | 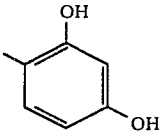 | $CH_3$ |
| B-17 | H | 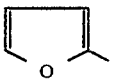 | $CH_3$ | H | Cl | H | Cl | H | $CH_3$ | $CH_3$ |
| B-18 | H | 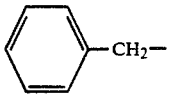 | $CH_3CONH$ | H | H | H | H | H | 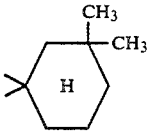 | (Spiro) |
| B-54 | $CH_3O$ | $CH_3O$ | H | H | H | H | H | H | $CH_3$ | $CH_3$ |
| B-55 | H | 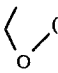 (Methylenedioxy) | | H | H | H | H | H | $CH_3$ | $CH_3$ |

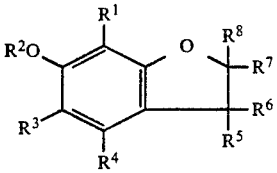

-continued

| Comp. No. | $R^1$ | $R^2$ | $R^3$ | $R^4$ | $R^5$ | $R^6$ | $R^7$ | $R^8$ |
|---|---|---|---|---|---|---|---|---|
| B-6 | H | H | H | H | H | 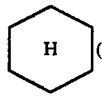 (Condensed) | | H |
| B-7 | H | H | (i)$C_3H_7$ | H | H | H | $CH_3$ | $CH_3$ |
| B-8 | H | $CH_3$ | Cl | H | H | H | $CH_3$ | $CH_3$ |
| B-19 | H | H | 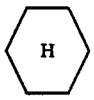 | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |
| B-21 | H | $C_3H_7$ | $C_3H_7$ | H | $CH_3$ | $CH_3$ | 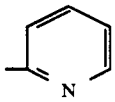 | H |
| B-22 | $CH_3$ | H | $CH_3$ | H | 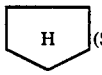 (Spiro) | | H | H |
| B-23 | $CH_3$ | H | 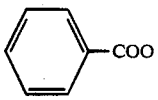 | H | $CH_3$ | $CH_3$ | $CH_3$ | $CH_3$ |

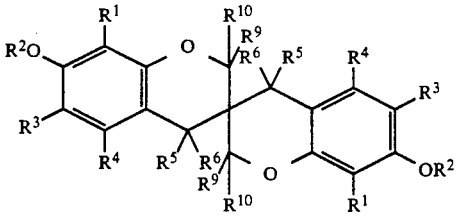

| Comp. No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 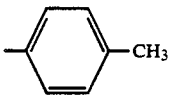 | H | $CH_3$ | $CH_3$ | H | H |
| B-29 | H | H | $C_2H_5COOCH_2$ | H | $CH_3$ | $CH_3$ | H | H |
| B-30 | $CH_3$ | 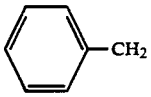 | H | $CH_3$ | $CH_3$ | $CH_3$ | H | H |
| B-31 | Cl | H | H | H | 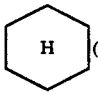 (Spiro) | | H | H |
| B-32 | H | H | $CH_3CONH$ | H | $CH_3$ | $CH_3$ | H | H |
| B-33 | $CH_3$ | 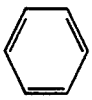 | (t)$C_8H_{17}$ | H | $CH_3$ | $CH_3$ | H | H |

-continued

| | | | | | | | | |
|---|---|---|---|---|---|---|---|---|
| B-34 | H | H | 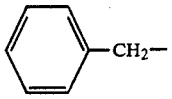 | H | $CH_3$ | $CH_3$ | H | H |

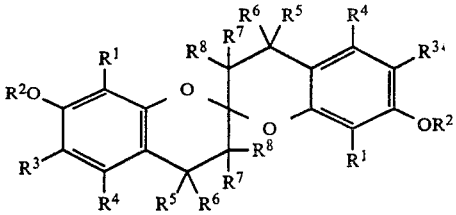

| Comp. No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | H |
| B-39 | H | H | 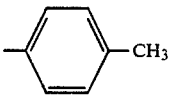 | H | $CH_3$ | $CH_3$ | H | H |
| B-40 | H | H | $CH_3SO_2NH$ | H | H | H | H | H |
| B-41 | $CH_3$ | 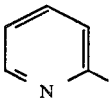 | H | $CH_3$ | $CH_3$ | $CH_3$ | H | H |
| B-42 | Cl | (t)$C_4H_9$ | H | H | 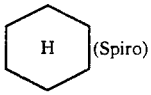 (Spiro) | | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |
| B-45 | H | H | 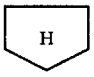 | H | $CH_3$ | $CH_3$ | H | H |

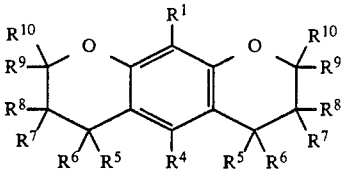

| Comp. No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 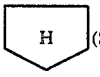 (Spiro) | |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

Formula (C)

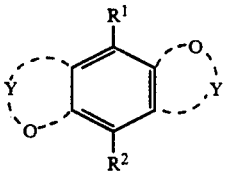

Formula (D)

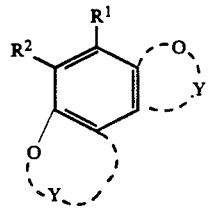

In the above formulas, $R^1$ and $R^2$ each represent a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The groups mentioned above each may be substituted with other substituent which may include, for example, a halogen atom, an alkyl group, an alkenyl group, an alkoxy group, an aryloxy group, a hydroxyl group, an alkoxycarbonyl group, an aryloxycarbonyl group, an acylamino group, a carbamoyl group, a sulfonamide group, a sulfamoyl group, etc.

Y represents a group of atoms necessary for formation of a dichroman or dicoumaran ring together with a benzene ring.

Chroman or coumaran ring may be substituted with a halogen atom, an alkyl group, a cycloalkyl group, an alkoxy group, an alkenyl group, alkenyloxy group, a hydroxyl group, an aryl group, an aryloxy group or a heterocyclic group, or further may form a spiro ring.

Of the compounds represented by Formulas (C) and (D), compounds most useful for this invention are included in the compounds represented by Formulas (C-1), (C-2), (D-1) and (D-2), respectively.

Formula (C-1)

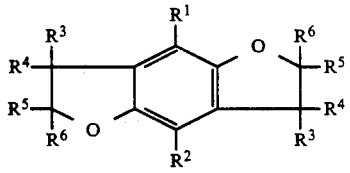

-continued

Formula (C-2)

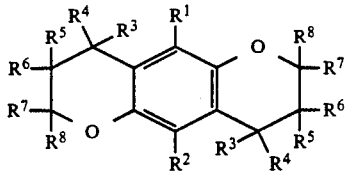

Formula (D-1)

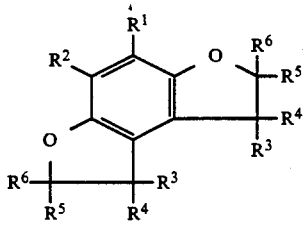

Formula (D-2)

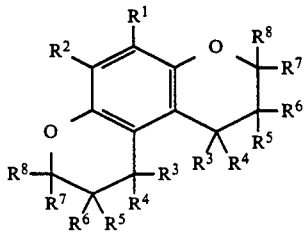

$R^1$ and $R^2$ in Formulas (C-1), (C-2), (D-1) and (D-2) have the same meaning as those in Formulas (C) and (D), and $R^3$, $R^4$, $R^5$, $R^6$ $R^7$ and $R^8$ each represent a hydrogen atom, a halogen atom, an alkyl group, an alkoxy group, a hydroxyl group, an alkenyl group, an alkenyloxy group, an aryl group, an aryloxy group or a heterocyclic ring. Also, $R^3$ and $R^4$, $R^4$ and $R^5$, $R^5$ and $R^6$, $R^6$ and $R^7$ and $R^7$ and $R^8$ each may be cyclized each other to form a carbon ring, and such a carbon ring may be further substituted with alkyl group.

In the above Formulas (C-1), (C-2), (D-1) and (D-2), particularly useful compounds are those in which $R^1$ and $R^4$ are each a hydrogen atom, an alkyl group, an alkoxy group, a hydroxyl group or a cycloalkyl group, and $R^3$, $R^4$, $R^5$, $R^6$, $R^7$ and $R^8$ are each a hydrogen atom, an alkyl group or a cycloalkyl group.

The compounds represented by Formulas (C) and (D) include the compounds disclosed in Journal of Chemical Society, Part C, 1968.(14), pp 1837–1843; Organic Synthetic Chemical Association, 1970, 28(1), pp 60–65; Tetrahedron Letters, 1973.(29), pp 2707–2710, and may be synthesized by the methods also disclosed in these publications.

The above compounds represented by Formulas (C) and (D) may be used preferably in an amount of 5 to 300 mole %, more preferably 10 to 200 mole %, based on the above-mentioned magenta coupler of this invention.

Typical examples of these compounds are shown below:

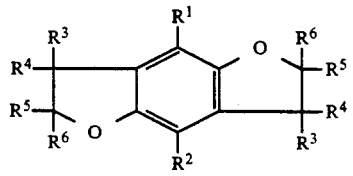

| Comp. No. | $R^1$ | $R^2$ | $R^3$ | $R^4$ | $R^5$ | $R^6$ |
|---|---|---|---|---|---|---|

-continued

| | | | | | | |
|---|---|---|---|---|---|---|
| C-11 | H | H | H | H | $CH_3$ | $CH_3$ |
| C-12 | H | H | H | H | 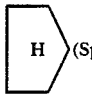 (Spiro) | |
| C-13 | H | H | H | 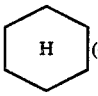 (Condensed) | | H |

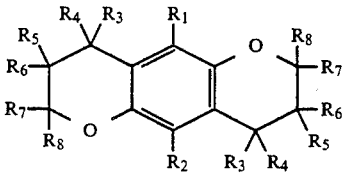

| Comp. No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |
| C-5 | OH | H | H | H | H | H | $C_2H_5$ | $CH_3$ |
| C-6 | $OCH_3$ | H | H | H | H | H | H | H |
| C-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 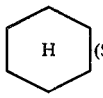 (Spiro) | |
| C-14 | $(CH_3)_2CCHCH_2$ (Cl) | $(CH_3)_2CCH_2CH_2$ (Cl) | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

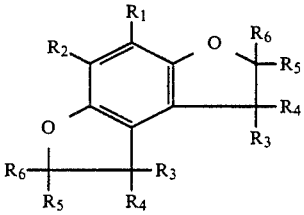

| Comp. No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |
| D-2 | H | H | H | H | $CH_3$ | $CH_3$ |

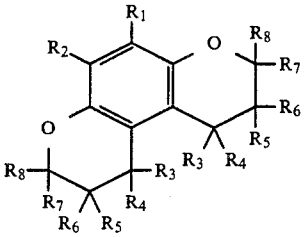

| Comp. No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |

-continued

| | | | | | | | | |
|---|---|---|---|---|---|---|---|---|
| D-6 | $(CH_3)_2\underset{\underset{Cl}{\vert}}{C}CH_2CH_2$ | $(CH_3)_2\underset{\underset{Cl}{\vert}}{C}CH_2CH_2$ | H | H | H | H | $CH_3$ | $CH_3$ |
| D-7 | H | H | Cl | H | Cl | H | H | H |
| D-8 | H | H | H | H | H | H | 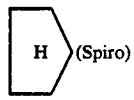 (Spiro) | |
| D-9 | $CH_3O$ | H | H | H | H | H | 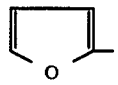 | H |
| D-10 | H | H | H | H | H | H | $CH_2OH$ | $CH_3$ |
| D-11 | 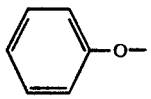 | H | H | H | H | H | $CH_3$ | $CH_3$ |

Formula (E)

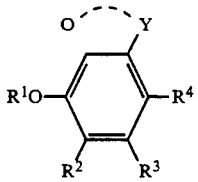

wherein, $R^1$ represents a hydrogen atom, an alkyl group, an alkenyl group, an aryl group, an acyl group, a cycloalkyl group or a heterocyclic group; and $R^3$ represents a hydrogen atom, a halogen atom, an alkyl group, an alkenyl group, an aryl group, an aryloxy group, an acyl group, an acylamino an acyloxy group, a sulfonamide group, a cycloalkyl group or an alkoxycarbonyl group.

$R^2$ and $R^4$ each represents a hydrogen atom, a halogen atom, an alkyl group, an alkenyl group, an aryl group, an acyl group, an acylamino group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be ring-closed each other to form a 5- or 6-membered ring.

In that occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (E), compounds most useful for this invention are included in the compounds represented by Formulas (E-1), (E-2), (E-3), (E-4) and (E-5).

Formula (E-1)

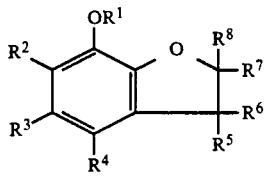

Formula (E-2)

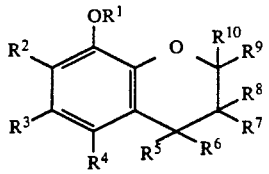

Formula (E-3)

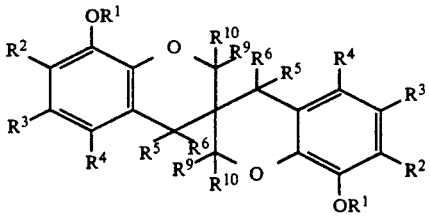

Formula (E-4)

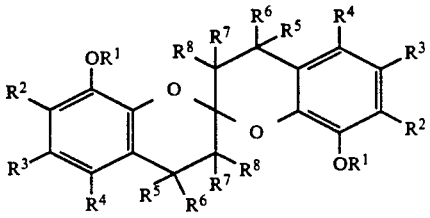

-continued

Formula (E-5)

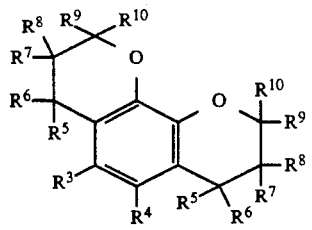

$R^1$, $R^2$, $R^3$ and $R^4$ in Formulas (E-1) to (E-5) have the same meaning as those in the above Formula (E), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

In the above Formulas (E-1) to (E-5), particularly useful compounds are those in which $R^1$, $R^2$, $R^3$ and $R^4$ are each a hydrogen atom, an alkyl group or a cycloalkyl group; and in the above Formula (E-5), $R^3$ and $R^4$ are each a hydrogen atom, an alkyl group, an alkoxy group, a hydroxyl group or a cycloalkyl group; and in the above Formulas (E-1) to (E-5), $R^5$, $R^6$, $R^7$, $R^8$, $R^9$ and $R^{10}$ are each a hydrogen atom, an alkyl group or a cycloalkyl group.

The compounds represented by Formula (E) include the compounds disclosed in Tetrahedron Letters, 1965.(8), pp 457–460; Japan Chemical Society, Part C, 1966.(22), pp 2013–2016; Zh. Org. Khim, 1970, (6), pp 1230–1237, and may be synthesized by the methods also disclosed in these publications.

The above compounds represented by Formula (E) may be used preferably in an amount of 5 to 300 mole %, more preferably 10 to 200 mole %, based on the above-mentioned magenta coupler of this invention.

Typical examples of these compounds are shown below:

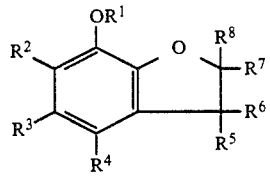

| Comp. No | $R_1$ | $R_2$ | $R_3$ | $R_4$ | $R_5$ | $R_6$ | $R_7$ | $R_8$ |
|---|---|---|---|---|---|---|---|---|
| E-19 | H | H | H | H | H | | 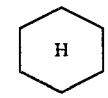 (Condensed) | H |
| E-20 | $C_3H_7$ | H | H | H | H | | 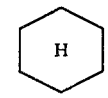 (Condensed) | H |
| E-21 | H | H | H | H | H | H | 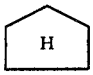 (Spiro) | |
| E-22 | $CH_3$ | H | H | H | H | H | 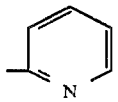 | H |
| E-23 | H | H | H | H | H | H | $CH_3$ | $CH_3$ |
| E-24 | $CH_3$ | H | 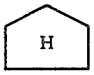 | H | H | H | $CH_3$ | $CH_3$ |
| E-25 | 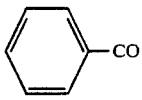 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

-continued

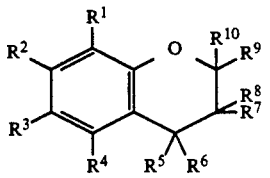

| Comp. No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |
| E-8 | 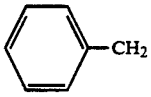 | H | H | H | H | H | H | H | H | H |
| E-9 | 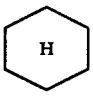 | H | H | H | H | H | H | H | $CH_3$ | $CH_3$ |
| E-10 | 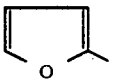 | H | H | H | H | H | H | H | $CH_3$ | $CH_3$ |
| E-11 | H | H | H | H | H | H | H | H | $CH_3$ | $C_{16}H_{33}$ |
| E-12 | H | H | 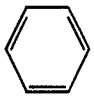 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

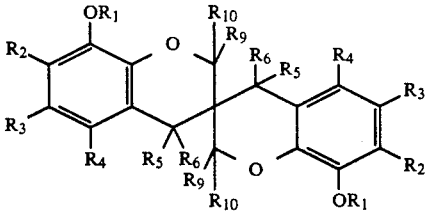

| Comp. No | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |
| E-29 | 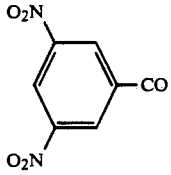 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

-continued

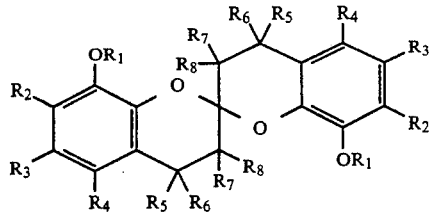

| Comp. No | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

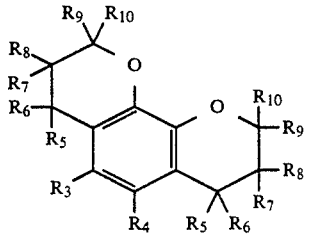

| Comp. No | $R_3$ | $R_4$ | $R_5$ | $R_6$ | $R_7$ | $R_8$ | $R_9$ | $R_{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

Formula (F)

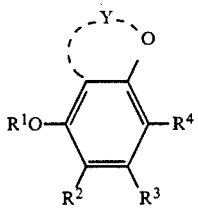

wherein, $R^1$ represents a hydrogen atom, an alkyl group, an alkenyl group, an acyl group, a cycloalkyl group or a heterocyclic group; $R^2$ represents a hydrogen atom, a halogen atom, an alkyl group, an alkenyl group, an aryl group, aryloxy group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an aryl group, an acyl group, an acylamino group, a sulfonamide group, a cycloalkyl group or an alkoxycarbonyl group; and $R^4$ represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be ring-closed each other to form a 5- or 6-membered ring. In this occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by Formula (F), compounds most useful for this invention are included in the compounds represented by Formulas (F-1), (F-2), (F-3), (F-4) and (F-5).

Formula (F-1)

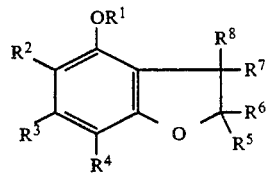

Formula (F-2)

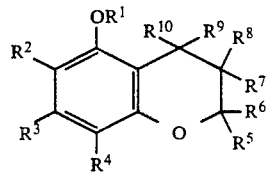

-continued

Formula (F-3)

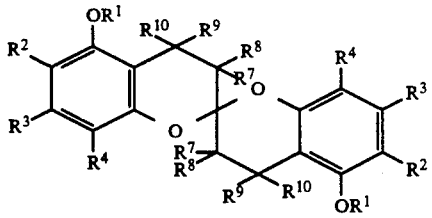

Formula (F-4)

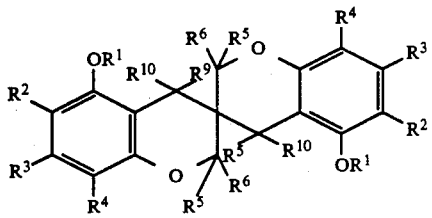

Formula (F-5)

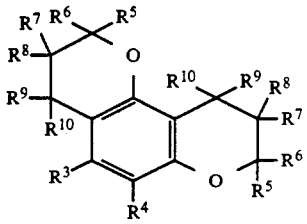

$R^1$, $R^2$, $R^3$ and $R^4$ in Formulas (F-1) to (F-5) have the same meaning as those in the above Formula (F), and $R^5$, $R^6$, $R^7$, $R^8$, $R^9$ and $R^{10}$ each represent a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

Also, in Formulas (F-3), (F-4) and (F-5), $R^1$ to $R^{10}$ in two of them each may be the same or different.

In the above Formulas (F-1), (F-2), (F-3), (F-4) and (F-5), particularly useful compounds are those in which $R^1$, $R^2$ and $R^3$ are each a hydrogen atom, an alkyl group or a cycloalkyl group; $R^4$ is a hydrogen atom, an alkyl group, an alkoxy group, a hydroxyl group or a cycloalkyl group; and further, $R^5$, $R^6$, $R^7$, $R^8$, $R^9$ and $R^{10}$ are each a hydrogen atom, an alkyl group or a cycloalkyl group.

The compounds represented by Formula (F) include the compounds disclosed in Tetrahedron Letters, 1970, Vol. 26, pp 4743–4751; Japan Chemical Society, 1972, No. 10, pp 1987–1990; Synthesis, 1975, Vol. 6, pp 392–393; and Bul. Soc. Chim. Belg, 1975, Vol. 84(7), pp 747–759, and may be synthesized by the methods disclosed in these publications.

The above compounds represented by Formula (F) may be used preferably in an amount of 5 to 300 mole %, more preferably 10 to 200 mole %, based on the above-mentioned magenta coupler of this invention.

Typical examples of the compounds represented by Formula (F) are shown below:

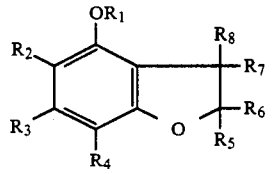

| Comp. No | $R_1$ | $R_2$ | $R_3$ | $R_4$ | $R_5$ | $R_6$ | $R_7$ | $R_8$ |
|---|---|---|---|---|---|---|---|---|
| F-11 | H | H | H | H | H | | 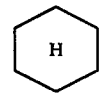 (Condensed) | H |
| F-12 | $C_3H_7$ | H | H | H | H | | 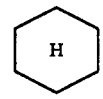 (Condensed) | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 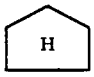 | H | H | H | $CH_3$ | H |
| F-17 | H | H | 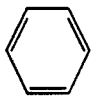 | H | H | H | $CH_3$ | H |
| F-18 | $C_3H_7$ | H | $CH_3$ | H | H | H | $CH_3$ | H |

-continued

| | | | | | | | | |
|---|---|---|---|---|---|---|---|---|
| F-19 | 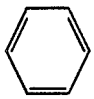 | H | H | H | 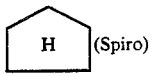 (Spiro) | | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 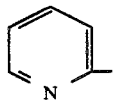 | $CH_3$ | $CH_3$ |
| F-26 | H | $CH_3$ | $CH_3$ | H | H | H | 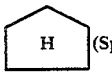 (Spiro) | |

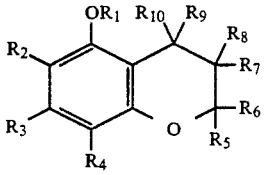

| Comp. No | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-1 | H | H | H | H | H | H | H | H | H | H |
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 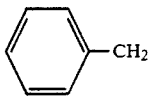 | H | H | H | $CH_3$ | $CH_3$ | H | H | H | H |
| F-9 | 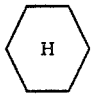 | H | H | H | $CH_3$ | $CH_3$ | H | H | H | H |
| F-10 | 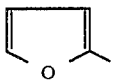 | H | H | H | $CH_3$ | $CH_3$ | H | H | H | H |
| F-20 | H | Cl | H | H | H | 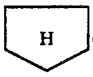 (Condensed) | | H | H | H |
| F-21 | H | H | H | H | $CH_3$ | $CH_2OH$ | H | H | $CH_3$ | $CH_3$ |
| F-22 | $C_3H_7$ | (t)$C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

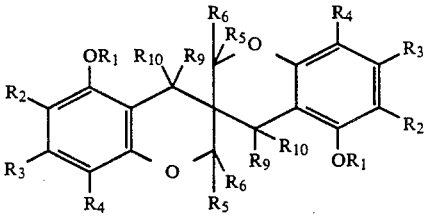

| Comp. No | $R_1$ | $R_2$ | $R_3$ | $R_4$ | $R_5$ | $R_6$ | $R_9$ | $R_{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | (t)$C_8H_{17}$ | H | H | H | H |

-continued

| | | | | | | | | |
|---|---|---|---|---|---|---|---|---|
| F-30 | H | Cl | H | H | H | H | 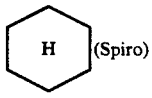 (Spiro) | |
| F-31 | 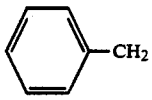 | H | H | H | H | H | $CH_3$ | $CH_3$ |

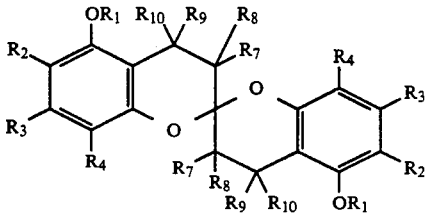

| Comp. No | $R_1$ | $R_2$ | $R_3$ | $R_4$ | $R_7$ | $R_8$ | $R_9$ | $R_{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | (t)$C_4H_9$ | H | H | $CH_3$ | $CH_3$ |
| F-36 | H | 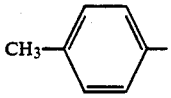 | H | H | H | H | $CH_3$ | $CH_3$ |
| F-37 | H | H | H | $CH_3SO_2NH$ | H | H | H | H |
| F-38 | 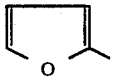 | H | H | H | H | H | $CH_3$ | $CH_3$ |
| F-39 | $C_{12}H_{25}$ | H | H | H | H | H | $CH_3$ | $CH_3$ |
| F-40 | 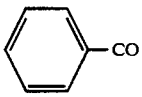 | H | H | H | H | H | 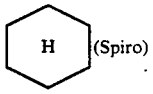 (Spiro) | |
| F-41 | H | H | 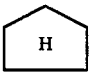 | H | H | H | $CH_3$ | $CH_3$ |

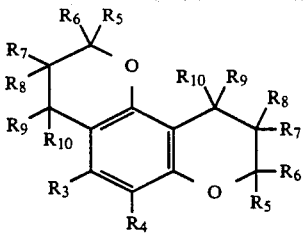

| Comp. No | $R_3$ | $R_4$ | $R_5$ | $R_6$ | $R_7$ | $R_8$ | $R_9$ | $R_{10}$ |
|---|---|---|---|---|---|---|---|---|
| F-42 | H | H | $CH_3$ | $CH_3$ | H | H | H | H |
| F-43 | H | H | 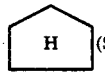 (Spiro) | | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

Formula (G)

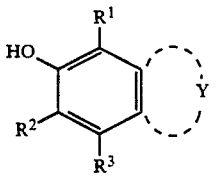

wherein, $R^1$ and $R^3$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; and $R^2$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^2$ and $R^3$ may be ring-closed each other to form a 5- or 6-membered hydrocarbon ring. This 5- or 6-membered hydrocarbon ring may be substituted with a halogen atom, an alkyl group, a cycloalkyl group, an alkoxy group, an alkenyl group, a hydroxyl group, an aryl group, an aryloxy group or a heterocyclic group.

Y represents a group of atoms necessary for formation of an indane ring. The indane ring may be substituted with a halogen atom, an alkyl group, an alkenyl group, an alkoxy group, a cycloalkyl group, a hydroxyl group, an aryl group, an aryloxy group or a heterocyclic group, or may further form a spiro ring.

Of the compounds represented by Formula (G), compounds most useful for this invention are included in the compounds represented by Formulas (G-1) to (G-3).

Formula (G-1)

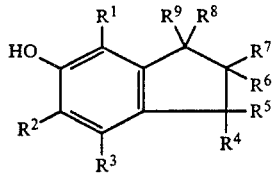

Formula (G-2)

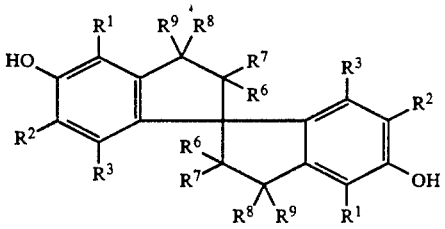

Formula (G-3)

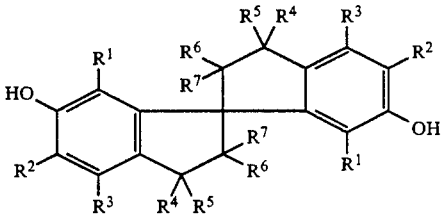

$R^1R^2$ and $R^3$ in Formulas (G-1) to (G-3) have the same meaning as those in the above Formula (G), and $R^4$, $R^5$, $R^6$, $R^7$, $R^8$ and $R^9$ each represent a hydrogen atom, an alkyl group, an alkoxy group, an alkenyl group, a hydroxyl group, an aryl group, an aryloxy group or a heterocyclic group. $R^4$ and $R^5$, $R^5$ and $R^6$, $R^6$ and $R^7$, $R^7$ and R8, and R8 and $R^9$ each may be ring-closed each other to form a hydrocarbon ring, and such a hydrocarbon ring may be further substituted with an alkyl group.

In the above Formulas (G-1) to (G-3), particularly useful compounds are those in which $R^1$ and $R^3$ are each a hydrogen atom, an alkyl group, an alkoxy group, a hydroxyl group or a cycloalkyl group; $R^2$ is a hydrogen atom, an alkyl group, a hydroxyl group or a cycloalkyl group; and $R^4$, $R^5$, $R^6$, $R^7$, $R^8$ and $R^9$ are each a hydrogen atom, an alkyl group or a cycloalkyl group.

The above compounds represented by Formula (G) may be used preferably in an amount of 5 to 300 mole %, more preferably 10 to 200 mole %, based on the above-mentioned magenta coupler of this invention.

Typical examples of the compounds represented by Formula (G) are shown below:

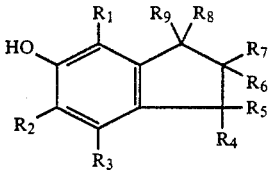

| Comp. No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | $CH_3$ |

-continued

| | | | | | | | | | |
|---|---|---|---|---|---|---|---|---|---|
| G-9 | H | H | H | H | 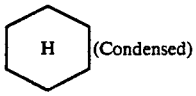 (Condensed) | | H | H | H |
| G-10 | H | H | H | H | H | H | H | 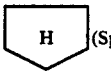 (Spiro) | |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |
| G-13 | H | 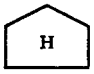 | H | $CH_3$ | $CH_3$ | H | H | $CH_3$ | $CH_3$ |
| G-14 | H | H | H | 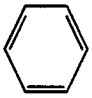 | $CH_3$ | H | H | $CH_3$ | $CH_3$ |
| G-15 | H | H | $CH_3O$ | $CH_3$ | $CH_3$ | H | H | $CH_3$ | $CH_3$ |
| G-16 | $CH_3H$ | H | H | H | 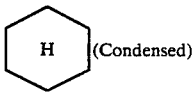 (Condensed) | | H | H | H |
| G-17 | H | $CH_3SO_2NH$ | H | $CH_3$ | $CH_3$ | H | H | $CH_3$ | $CH_3$ |
| G-18 | H | $CH_3CO$ | H | $CH_3$ | $CH_3$ | H | H | $CH_3$ | $CH_3$ |
| G-19 | H | 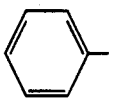 | H | $CH_3$ | $CH_3$ | H | H | $CH_3$ | $CH_3$ |
| G-20 | H | 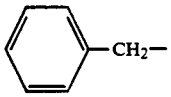 | H | $CH_3$ | $CH_3$ | H | H | $CH_3$ | $CH_3$ |
| G-21 | H | 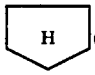 (Condensed) | | H | H | H | H | H | H |
| G-22 | H | 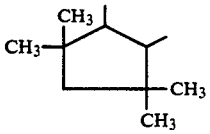 (Condensed) | | $CH_3$ | $CH_3$ | H | H | $CH_3$ | $CH_3$ |
| G-23 | H | 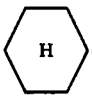 (Condensed) | | $CH_3$ | $CH_3$ | H | H | $CH_3$ | $CH_3$ |
| G-24 | $CH_3$ | 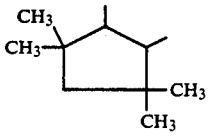 (Condensed) | | $CH_3$ | $CH_3$ | H | H | $CH_3$ | $CH_3$ |

-continued

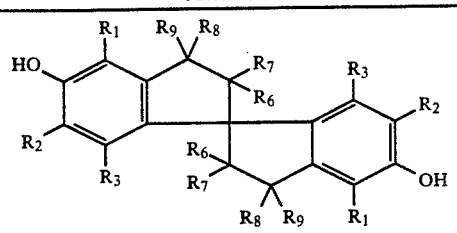

| Comp. No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |
| G-32 | $CH_3$ | H | H | H | H | $CH_3$ | $CH_3$ |

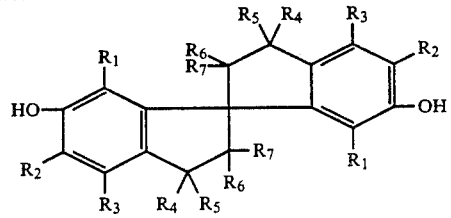

| Comp. No. | $R_1$ | $R_2$ | $R_3$ | $R_4$ | $R_5$ | $R_6$ | $R_7$ |
|---|---|---|---|---|---|---|---|
| G-25 | H | $CH_3$ | H | $CH_3$ | $C_6H_5$ | H | H |
| G-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |
| G-34 | H | H | H | $CH_3$ | $CH_3$ | H | H |
| G-35 | H | $CH_3$ | H | H | H | H | H |
| G-36 | H | H | H | H (Spiro) | | H | H |
| G-37 | $CH_3$ | H | H | $CH_3$ | $CH_3$ | H | H |
| G-38 | H | $CH_3$ | H | $CH_3$ | $C_6H_5$ | H | H |
| G-39 | H | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |
| G-42 | H | OH | H | H (Spiro) | | H | H |
| G-43 | H | $CH_2$— | H | H | H | H | H |
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

Formula (H)

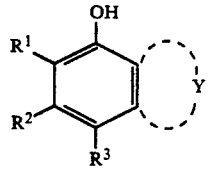

wherein, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group; and $R^3$ represents a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$, and $R^2$ and $R^3$ each may be ring-closed each other to form a 5- or 6-membered hydrocarbon ring, and the hydrocarbon ring may be substituted with a halogen atom, an alkyl group, a cycloalkyl group, an alkoxyl group, an alkenyl group, a hydroxyl group, an aryl group, an aryloxy group or a heterocyclic group.

Y represents a group of atoms necessary for formation of an indane ring. The indane ring may be substituted with a group capable of substituting the above hydrocarbon ring, or may further form a spiro ring.

Of the compounds represented by Formula (H), compounds most useful for this invention are included in the compounds represented by Formulas (H-1) to (H-3).

Formula (H-1)

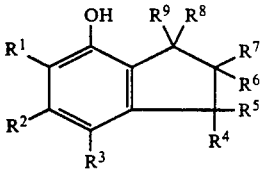

-continued

Formula (H-2)

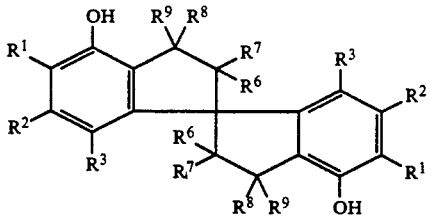

Formula (H-3)

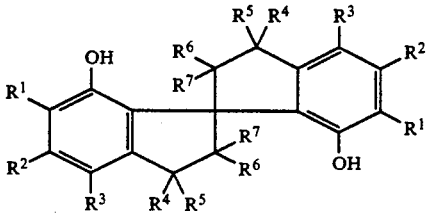

$R^1$, $R^2$ and $R^3$ in Formulas (H-1) to (H-3) have the same meaning as those in the above Formula (H), and $R^4$, $R^5$, $R^6$, $R^7$, $R^8$ and $R^9$ each represents a hydrogen atom, a halogen atom, an alkyl group, an alkoxy group, a hydroxyl group, an alkenyl group, an aryl group, an aryloxy group or a heterocyclic group. $R^4$ and $R^5$, $R^5$ and $R^6$, $R^6$ and $R^7$, $R^7$ and $R^8$, and $R^8$ and $R^9$ each may be ring-closed each other to form a hydrocarbon ring, and such a hydrocarbon ring may be further substituted with an alkyl group.

In the above Formulas (H-1) to (H-3), particularly useful compounds are those in which $R^1$ and $R^2$ are each a hydrogen atom, an alkyl group or a cycloalkyl group; $R^3$ is a hydrogen atom, an alkyl group, an alkoxy group, a hydroxyl group or a cycloalkyl group; and $R^4$, $R^5$, $R^6$, $R^7$, $R^8$ and $R^9$ are each a hydrogen atom, an alkyl group or a cycloalkyl group.

Synthesis method of the above compounds represented by Formula (H) is known, and they may be synthesized in accordance with U.S. Pat. No. 3,057,929; Chem .. Bar., 1972, 95(5), pp 1673–1674: Chemistry Letters, 1980, pp 739–742.

The above compounds represented by Formula (H) may be used preferably i an amount of 5 to 300 mole %, more preferably 10 to 200 mole %, based on the above-mentioned magenta coupler of this invention.

Typical examples of the compounds represented by Formula (H) are shown below:

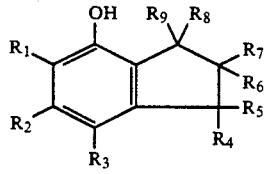

| Comp. No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| 2 | $CH_3$ | H | H | H | H | H | H | H | H |
| 3 | H | H | H | H | H | H | H | $CH_3$ | $C_{16}H_{33}$ |
| 4 | H | H | OH | H | H | H | H | H | H |
| 5 | $CH_2{=}CHCH_2$ | H | Cl | H | H | H | H | H | H |
| 6 | H | H | H | H | H | H | H | $CH_3$ | $CH_3$ |
| 7 | H | H | H | $CH_3$ | $CH_3$ | H | H | H | H |
| 8 | H | H | H | $CH_3$ | $CH_3$ | $CH_3$ | H | H | H |
| 9 | $CH_2{=}CHCH_2$ | H | $CH_3O$ | H | H | H | H | H | H |
| 10 | H | H | H | $CH_3$ | $CH_3$ | H | H | $CH_3$ | $CH_3$ |
| 11 | H | $C_3H_7$ | H | $CH_3$ | $CH_3$ | H | H | $CH_3$ | $CH_3$ |

-continued

| | | | | | | | | | | |
|---|---|---|---|---|---|---|---|---|---|---|
| 12 | Cl | | H | Cl | | H | H | H | H | $CH_3$ | $CH_3$ |

| Comp. No | $R_1$ | $R_2$ | $R_3$ | $R_4$ | $R_5$ | $R_6$ | $R_7$ | $R_8$ | $R_9$ |
|---|---|---|---|---|---|---|---|---|---|
| H-13 | H | H | H | H | 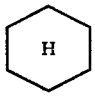 (Condensed) | | H | H | H |
| 14 | H | H | H | H | H | H | H | 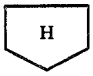 (Spiro) | |
| 15 | H | 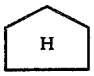 | H | $CH_3$ | $CH_3$ | H | H | $CH_3$ | $CH_3$ |
| 16 | H | $CH_3SO_2NH$ | H | $CH_3$ | $CH_3$ | H | H | $CH_3$ | $CH_3$ |
| 17 | H | $CH_3CO$ | H | H | H | H | H | $CH_3$ | $CH_3$ |
| 18 | H | 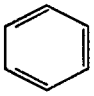 | H | $CH_3$ | $CH_3$ | H | H | $CH_3$ | $CH_3$ |
| 19 | H | 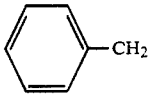 | H | $CH_3$ | $CH_3$ | H | H | $CH_3$ | $CH_3$ |
| 21 | 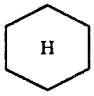 (Condensed) | | $CH_3$ | H | H | H | H | $CH_3$ | $CH_3$ |
| 22 | H | H | H | $CH_3$ | 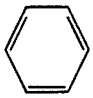 | H | H | $CH_3$ | $CH_3$ |

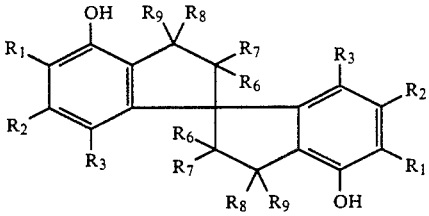

| Comp. No | $R_1$ | $R_2$ | $R_3$ | $R_6$ | $R_7$ | $R_8$ | $R_9$ |
|---|---|---|---|---|---|---|---|
| H-23 | H | H | H | H | H | H | H |
| 24 | H | H | OH | H | H | H | H |
| 25 | $CH_3$ | H | $CH_3$ | H | H | H | H |
| 26 | H | H | $CH_3$ | H | H | H | H |
| 27 | Cl | H | Cl | H | H | $CH_3$ | $CH_3$ |
| 28 | H | H | H | H | H | H | 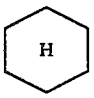 (Spiro) |
| 29 | H | H | H | H | H | $CH_3$ | 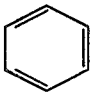 |
| 30 | H | H | 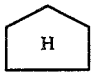 | H | H | H | H |

-continued

| | | | | | | | |
|---|---|---|---|---|---|---|---|
| 31 | H | H | 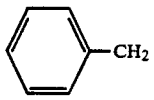 | H | H | $CH_3$ | $CH_3$ |
| 36 | H | H | (t)$C_4H_9$ | H | H | $CH_3$ | $CH_3$ |

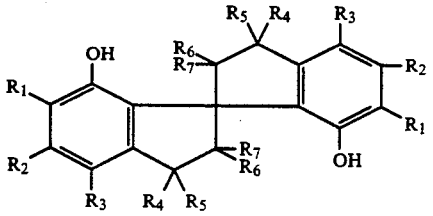

| Comp. No. | $R_1$ | $R_2$ | $R_3$ | $R_4$ | $R_5$ | $R_6$ | $R_7$ |
|---|---|---|---|---|---|---|---|
| H-32 | H | H | H | H | H | H | H |
| 33 | H | H | H | $CH_3$ | $CH_3$ | H | H |
| 34 | H | H | (t)$C_4H_9$ | $CH_3$ | $CH_3$ | H | H |
| 35 | H | H | (t)$C_8H_{17}$ | $CH_3$ | $CH_3$ | H | H |

H-20

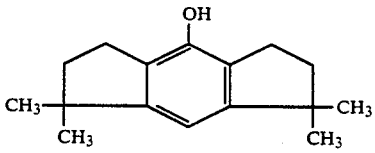

Formula (J)

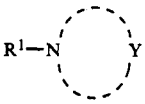

wherein, $R^1$ represents an aliphatic group, a cycloalkyl group or an aryl group; and Y represents a group of nonmetal atoms necessary for forming a heterocyclic ring of 5 to 7 members together with a nitrogen atom; provided that, when two or more hetero atoms are present in the nonmetal atom containing a nitrogen atom for forming the heterocyclic ring, at least two hetero atoms are hetero atoms which are not contiguous to each other.

The aliphatic group represented by R' may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, ethenyl group, a propenyl group, etc.

The cycloalkyl group represented by $R^1$ may include a 5- to 7-membered cycloalkyl group which may have a substituent, which may include, for example, a cyclopentyl group, a cyclohexyl group, etc.

The aryl group represented by $R^1$ may include a phenyl group and a naphthyl group, which respectively may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, an arylthio group, etc., and these substituents may further have a substituent.

In the above Formula (J), Y, which represents a group of nonmetal atoms necessary for forming a heterocyclic ring of 5 to 7 members together with a nitrogen atom, at least two of the nonmetal atoms containing a nitrogen atom for forming the heterocyclic ring must be hetero atoms, and this at least two hetero atoms must not be contiguous to each other. If, in the heterocyclic ring of the compound represented by Formula (J), all of the hetero atoms are contiguous to each other, the performance as a magenta dye image stabilizing agent will not be attained, undesirably.

The above heterocyclic ring of 5 to 7 members of the compound represented by Formula (J) may have a substituent, and the substituent may include an alkyl group, an aryl group, an acyl group, a carbamoyl group, an alkoxycarbonyl group, a sulfonyl group, a sulfamoyl group, etc., which may further have a substituent. Also, the heterocyclic ring of 5 to 7 members may be saturated, and a saturated heterocyclic ring is preferred. Further, a benzene ring, etc. may be condensed, or a spiro ring may be formed.

The above compounds represented by Formula (J) may be used preferably in an amount of 5 to 300 mole %, more preferably 10 to 200 mole %, based on the above-mentioned magenta coupler represented by Formula (1) of this invention.

Typical examples of the compounds represented by Formula (J) are shown below:

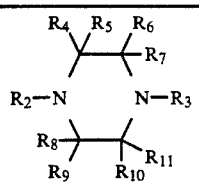

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{25}$ | $C_{12}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{16}H_{33}$ | $C_{16}H_{33}$ | H | H | H | H | H | H | H | H |
| J-6 | $C_{14}H_{29}$ | $CH_3$ | H | H | H | H | H | H | H | H |
| J-7 | 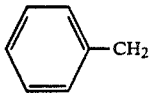 | 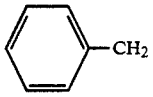 | H | H | H | H | H | H | H | H |
| J-8 | 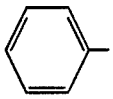 | 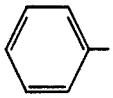 | H | H | H | H | H | H | H | H |
| J-11 | $CH_3$ | 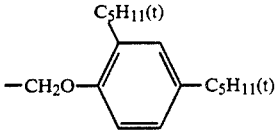 | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 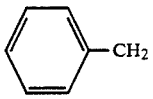 | H | H | H | H | H | H | H | H |
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | $CH_3$ | 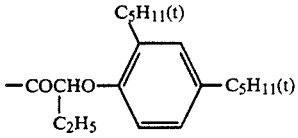 | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |
| J-21 | $CH_3$ | 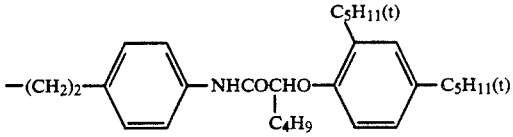 | H | H | H | | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{12}H_{25}$ | $CH_3$ | H | H | H | H | H | $CH_3$ | H |
| J-24 | $C_{16}H_{33}$ | $C_{16}H_{33}$ | $CH_3$ | H | H | H | H | H | $CH_3$ | H |
| J-25 | $C_6H_5CH{=}CH{-}CH_2{-}$ | $C_{12}H_{25}$ | H | H | H | H | H | H | H | H |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | H |
| J-30 | $CH_3O(CH_2)_4{-}$ | $CH_3O(CH_2)_4$ | H | H | H | H | H | H | H | H |

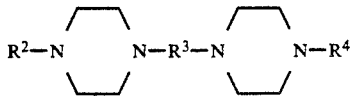

| $R^2$ | $R^3$ | $R^4$ |
|---|---|---|

-continued
| | | | |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |
| J-28 | $C_{12}H_{25}$ | 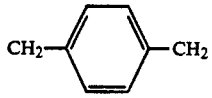 | $C_{12}H_{25}$ |
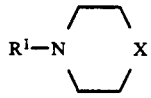
| | X | $R_1$ |
|---|---|---|
| J-31 | O | $C_{12}H_{25}$ |
| J-32 | O | $C_{14}H_{29}$ |
| J-33 | O | $C_6H_5CH{=}CH-$ |
| J-34 | O | 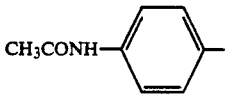 |
| J-35 | O | α-⊣ ) ⊣ )V |
| J-36 | O | 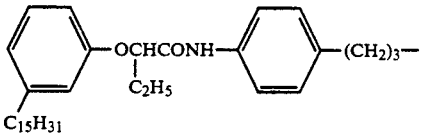 |
| J-37 | O | 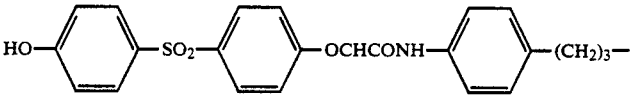 |
| J-38 | O | 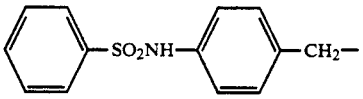 |
| J-39 | O | 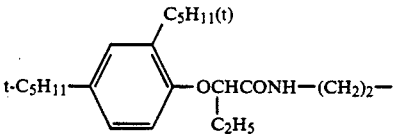 |
| J-40 | O | 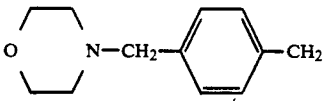 |
| J-41 | S | $C_{14}H_{29}$ |
| J-42 | S | 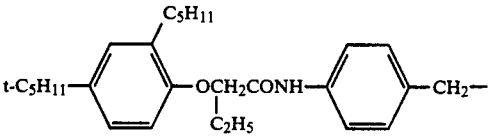 |
| J-43 | S | 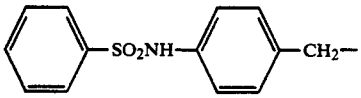 |
| J-44 | S | 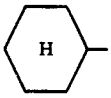 |
α-⊣ > ⊣ )V -continued
| | | |
|---|---|---|
| J-45 | S | 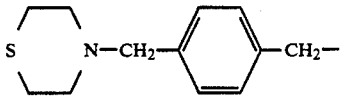 |
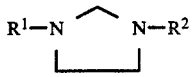
| | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
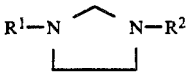
| | | |
|---|---|---|
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |
| J-56 | $C_2H_5$ | 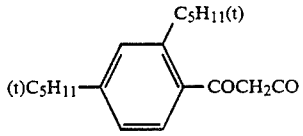 |
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9SO_2$ |
| J-60 | $C_{14}H_{29}$ | $(CH_3)_2NSO_2$ |
| J-61 | $C_{12}H_{25}$ | 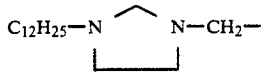 |
| J-62 | H | 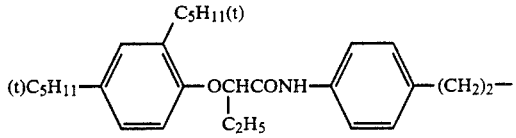 |
J-63
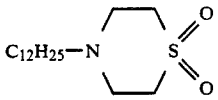
J-64
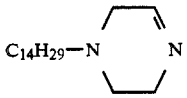
J-65
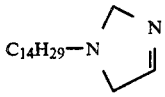
J-66
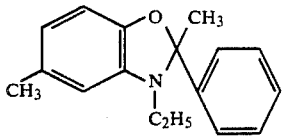

-continued
J-67
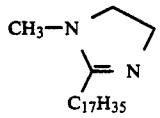
J-68
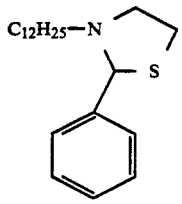
J-69
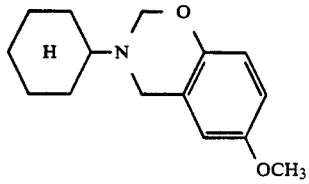
J-70
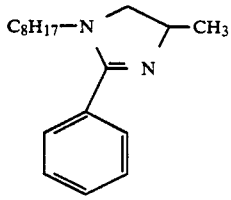
J-71
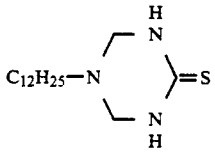
J-72
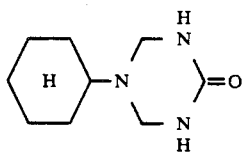
J-73
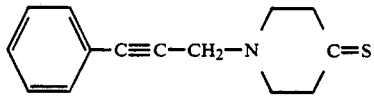
J-74
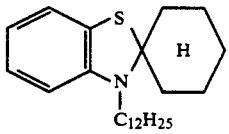
Of the compounds represented by Formula (J), particularly preferable are piperazine series compounds and homopiperazine series compounds, and more preferably, they are the compounds represented by Formula (J-1) or (J-2) shown below:
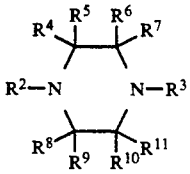
Formula (J-1)

-continued

Formula (J-2)

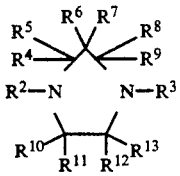

In the formulas, $R^2$ and $R^3$ each represent a hydrogen atom, an alkyl group or an aryl group, provided that $R^2$ and $R^3$ are not hydrogen atoms at the same time. $R^4$ to $R^{13}$ each represent a hydrogen atom, an alkyl group or an aryl group.

In the above Formulas (J-1) and (J-2), wherein $R^2$ and $R^3$ each represent a hydrogen atom, an alkyl group or an aryl group, the alkyl group represented by $R^2$ or $R^3$ may include, for example, a methyl group, an ethyl group, a butyl group, an octyl group, a dodecyl group, a tetradecyl group, a hexadecyl group, an octadecyl group, etc. The aryl group represented by $R^2$ or $R^3$ may included a phenyl group, etc. The alkyl group and the aryl group represented by $R^2$ or $R^3$ may have a substituent, and the substituent may include a halogen atom, an alkyl group, an aryl group, an alkoxy group, an aryloxy group, a heterocyclic group, etc.

The sum of the number of the carbon atoms of $R^2$ and $R^3$ (including their substituents) is preferably 6 to 40.

In the above Formulas (J-1) and (J-2), wherein $R^4$ to $R^{13}$ each represent a hydrogen atom, an alkyl group or an aryl group, the alkyl group represented by $R^4$ to $R^{13}$ may include, for example, a methyl group, an ethyl group, etc. The aryl group represented by $R^4$ to $R^{13}$ may include a phenyl group, etc.

Examples of the compounds represented by Formula correspond to the compounds disclosed in the exemplary piperazine series compounds (J-1) to (J-30) and the exemplary homopiperazine series compounds (J-51) to (J-62).

Synthesis examples for typical magenta dye image stabilizing agents of the invention represented by the above Formula (J) are shown in the following:

SYNTHESIS EXAMPLE 1 (SYNTHESIS OF COMPOUND J-2)

To 100 ml of acetone in which 9.0 g of piperazine and 55 g of myristylbromide were dissolved, 15 g of anhydrous potassium carbonate was added to carry out reaction while boiling under reflux for 10 hours. After the reaction was completed, the reaction mixture was emptied to 500 ml of water, followed by extraction with 500 ml of ethyl acetate. After the layer of ethyl acetate was dried with use of magnesium sulfate, the ethyl acetate was evaporated to obtain resultant white crystals, which were recrystallized with use of 300 ml of acetone to obtain 34 g of white scaly crystals (Yield: 100%). m.p.: 55° to 58° C.

SYNTHESIS EXAMPLE 2 (SYNTHESIS OF COMPOUND J-34)

After 18 g of 4-morpholinoaniline was dissolved in 100 ml of ethyl acetate, 12 ml of acetic anhydride was added little by little with stirring, while maintaining the reaction mixture to 20° C. After acetic anhydride was added, the reaction mixture was ice-cooled to collect by filtration the crystals precipitated, followed by recrystallization with use of ethyl acetate to obtain 16.5 g of white powdery crystals (Yield: 75%). m.p.: 207° to 210° C.

Formula (K)

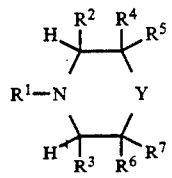

In the formula, $R^1$ represents an aliphatic group, and Y represents a simple bond arm or a divalent hydrocarbon group necessary for forming a heterocyclic ring of 5 to 7 members together with a nitrogen atom. $R^2$, $R^3$, $R^4$, $R^5$, $R^6$ and $R^7$ each represent a hydrogen atom, an aliphatic group, a cycloalkyl group or an aryl group. However, $R^2$ and $R^4$, and $R^3$ and $R^6$ each may be bonded to each other to form simple bond arms to form a heterocyclic ring of 5 to 7 members together with a nitrogen atom and Y. Also, when Y is the simple bond arm, $R^5$ and $R^7$ may be bonded to each other to form the simple bond arm to form an unsaturated heterocyclic ring of 5 to 7 members together with Y. When Y is not the simple bond arm, $R^5$ and Y, and $R^7$ and Y or Y itself may form unsaturated bonds to form an unsaturated heterocyclic ring of 6 or 7 members together with a nitrogen atom and Y.

The aliphatic group represented by $R^1$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^1$ may include a cycloalkyl group of 5 to 7 members which may have a substituent, for example, a cyclopentyl group, a cyclohexyl group, etc.

The aryl group represented by $R^1$ may include a phenyl group and a naphthyl group, each of which may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic ring, an alkylthio group, an arylthio group, etc., and these substituents may further have a substituent.

In the above Formula (K), wherein Y represents a simple bond arm or a divalent hydrocarbon group necessary for forming a heterocyclic ring of 5 to 7 members together with a nitrogen atom, and when Y is the simple bond arm, $R^5$ and $R^7$ may further be bonded to each other to form a simple bond arm to form an unsaturated heterocyclic ring of 5 members; when Y is the divalent hydrocarbon group, namely a methylene group, $R^5$ and Y, or $R^7$ and Y may form an unsaturated bond to form an unsaturated heterocyclic ring of 6 members, and when it is an ethylene group, R5 and Y, $R^7$ and Y, or Y itself may form an unsaturated bond to form an unsaturated heterocyclic ring of 7 members. Further, the divalent hydrocarbon represented by Y may have a substituent, and such a substituent may include an alkyl group, a carbamoyl group, an alkyloxycarbonyl group, an acylamino group, a sulfonamide group, a sulfamoyl group, an aryl group, a heterocyclic group, etc.

In the above Formula (K), wherein $R^2$, $R^3$, $R^4$, $R^5$, $R^6$ and $R^7$ each represent a hydrogen atom, an aliphatic group, a cycloalkyl group or an aryl group, the aliphatic group represented by $R^2$ to $R^7$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^2$ to $R^7$ may include a cycloalkyl group of 5 to 7 members which may have a substituent, for example, a cyclopentyl group, a cyclohexyl group, etc.

The aryl group represented by $R^2$ to $R^7$ may include a phenyl group and a naphthyl group, each of which may have a substituent.

The substituents for the aliphatic group, the cycloalkyl group and the aryl group represented by $R^2$ to $R^7$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, etc.

The compound represented by the above Formula (K) is more preferable when it has a saturated heterocyclic ring of 5 to 7 members than when it has an unsaturated one.

The compound represented by the above Formula (K) may be used preferably in an amount of 5 to 300 mole %, more preferably 10 to 200 mole %, based on the magenta coupler represented by the above Formula (I) of the invention.

Typical examples of the compound represented by the above Formula (K) are shown below:

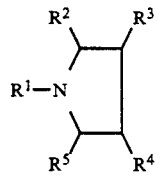

| | $R^1$ | $R^2$ | $R^3$ | $R^4$ | $R^5$ |
|---|---|---|---|---|---|
| K-1 | $C_8H_{17}$ | H | H | H | H |
| K-2 | 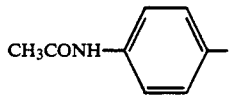 | H | H | H | H |
| K-3 | 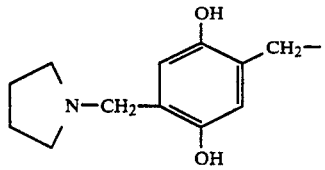 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 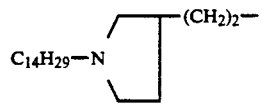 | H | H |
| K-8 | 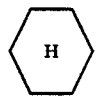 | $CH_3$ | $CH_3$ | H | H |
| K-9 | $C_6H_5CH{=}CHCH_2$— | H | H | H | H |
| K-10 | 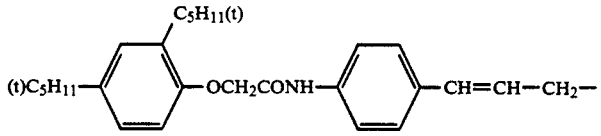 | H | H | H | H |

-continued
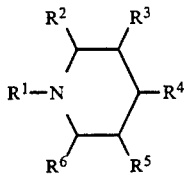
| | $R^1$ | $R^2$ | $R^3$ | $R^4$ | $R^5$ | $R^6$ |
|---|---|---|---|---|---|---|
| K-11 | $(t)C_8H_{17}$ | H | H | H | H | H |
| K-12 | 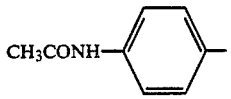 | H | H | H | H | H |
| K-13 | $C_{12}H_{25}$ | H | H | H | H | H |
| K-14 | $C_{14}H_{29}$ | H | H | H | H | H |
| K-15 | $C_{16}H_{33}$ | H | H | H | H | H |
| K-16 | $C_{14}H_{29}$ | $CH_3$ | H | H | H | H |
| K-17 | 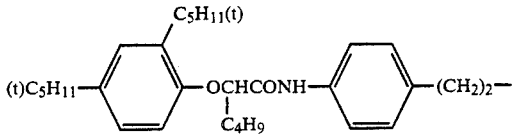 | | | H | H | H |
| K-18 | $C_8H_{17}$ | $CH_3$ | $CH_3$ | H | $CH_3$ | $CH_3$ |
| K-19 | 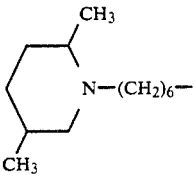 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_6H_5$ | H | H | $C_{12}H_{25}OCO$— | H | H |
| K-24 | $CH_3$ | $C_6H_5$ | H | H | H | H |
| K-25 | 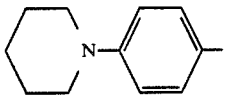 | H | H | H | H | H |
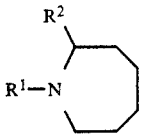
| | $R^1$ | $R^2$ |
|---|---|---|
| K-26 | $C_8H_{17}$ | H |
| K-27 | 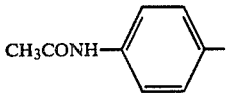 | H |
| K-28 | 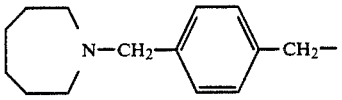 | H |
| K-29 | $C_{14}H_{29}$ | H |

-continued

| | | |
|---|---|---|
| K-30 | 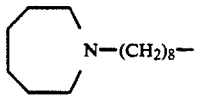 | H |
| K-31 | $C_{16}H_{33}$ | $CH_3$ |
| K-32 | 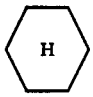 | H |
| K-33 | 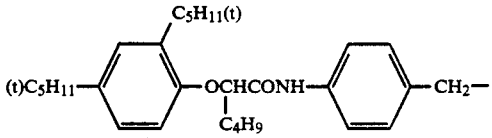 | H |
| K-34 | 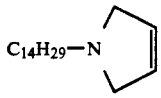 | |
| K-35 | 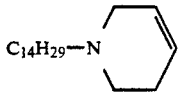 | |
| K-36 | 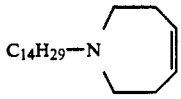 | |
| K-37 | 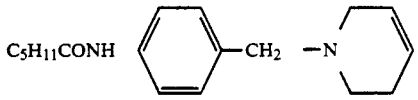 | |
| K-38 | 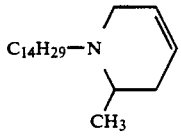 | |
| K-39 | 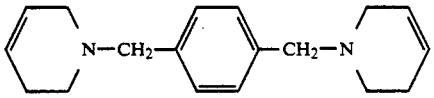 | |
| K-40 | 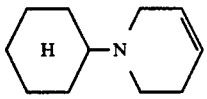 | |
| K-41 | 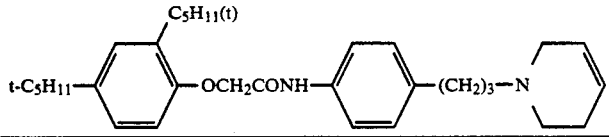 | |

Next, a synthesis example for the compound represented by the above Formula (K) is shown below:

SYNTHESIS EXAMPLE 1 (SYNTHESIS OF COMPOUND K-14),

To 60 ml of acetone in which 9.0 g of piperazine and 28 g of myristylbromide were dissolved, 6.0 g of anhydrous potassium carbonate was added to carry out reaction while boiling under reflux for 20 hours. After the reaction was completed, the reaction mixture was emptied to 300 ml of water, followed by extraction with 300 ml of ethyl acetate. After the layer of ethyl acetate was dried with use of magnesium sulfate, the ethyl acetate was evaporated to obtain resultant white crystals, which were recrystallized with use of 100 ml of acetone to obtain 12 g of white scaly crystals (Yield: 43%). m.p.: 175° to 180° C.

In the hydrophilic colloid layers such as a protective layer or an intermediate layer of the light-sensitive material of this invention, an ultraviolet absorbent may be contained in order to prevent fogs which may be produced by electrostatic discharge caused by friction or the like of the light-sensitive material, or prevent deterioration of images due to ultraviolet light.

In the light-sensitive material of this invention, it is possible to provide an auxiliary layer such as a filter layer, antihalation layer and/or an antiirradiation layer. In these layers and/or emulsion layers, a dye may also be contained, which is either flow out of a light-sensitive color material or bleached, during the course of developing processing.

To the silver halide emulsion layer and/or other hydrophilic colloid layer of the light-sensitive material of this invention, a matte agent may be added in order to decrease gloss of the light-sensitive material, enhance inscribability on the light-sensitive material, prevent light-sensitive materials from sticking to each other, and so on.

A lubricant may be added to decrease sliding friction of the light-sensitive material of this invention. For the purpose of preventing the light-sensitive material from electrostatically charged, an antistatic agent may be added thereto. The antistatic agent may sometimes be used in an antistatic layer which is on the side of a support which is not provided with emulsion layers, or may be used also in a protective colloid layer other than the emulsion layers which are on the side provided with emulsion layers. In the photographic emulsion layers and/or the other hydrophilic colloid layers of the light-sensitive material of this invention, various surface active agents may be used for the purpose of improvement in coating property, prevention of electrostatic discharge, improvement in lubricity, emulsification dispersion, prevention of sticking and improvement in other photographic properties (such as development acceleration, achievement of high contrast, and sensitization).

The photographic emulsion layers and the other layers of the light-sensitive material of this invention may be coated on a flexible reflective support such as a baryta paper, a paper laminated with α-olefin polymer or the like, a synthetic paper; a film comprised of a semi-synthetic or synthetic polymer such as cellulose acetate, cellulose nitrate, polystyrene, polyvinyl chloride, polyethylene terephthalate, polycarbonate and polyamide; or a hard material such as glass, metal and ceramic.

The light-sensitive material of this invention may be coated on the surface of a support directly or through interposition of one or two or more of subbing layer(s) (for improving adhesion property of the support surface, antistatic property, dimentional stability, wear resistance, hardness, antihalation property, friction characteristics and/or the other characteristics), optionally after application of corona discharge, ultraviolet irradiation, flame treatment, etc.

When the light-sensitive material of this invention is coated, a thickening agent may be used to improve the coating property. As the coating method, extrusion coating and curtain coating are particularly useful, which are feasible of coating two or more layers simultaneously.

The light-sensitive material of this invention may be exposed by use of electromagnetic waves in the spectral region to which the emulsion layers constituting the light-sensitive material of this invention has sensitivity. As a light source, there may be used any of known light sources such as natural light (sunlight), a tungsten lamp, a fluorescent lamp, a mercury lamp, a xenon arc lamp, a carbon arc lamp, a xenon flash lamp, a cathode ray tube flying spot, every kind of laser beams, light from light emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive material of this invention can form images by carrying out color development known in the art.

The aromatic primary amine series color developing agent used for a color developing solution in this invention includes known ones widely used in the various color photographic processes. These developing agents include aminophenol series and p-phenylenediamine series derivatives. These compounds, which are more stable than in a free state, are used generally in the form of a salt, for example, in the form of a hydrochloride or a sulfate. Also, these compounds are used generally in concentration of about 0.1 g to about 30 g per liter of the color developing agent, preferably in concentration of about 1 g to about 15 g per liter of the color developing agent.

The aminophenol series developing agent may include, for example, o-aminophenol, p-aminophenol, 5-amino-2-oxytoluen, 2-amino-3-oxytoluen, 2-oxy-3-amino-1,4-dimethylbenzene, etc.

Most useful aromatic primary amine series color developing agents include N,N'-dialkyl-p-phenylenediamine series compounds, wherein an alkyl group and a phenyl group may be substituted with an optional substituent. Of these, particularly preferable compounds may include, for example, N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluen, N-ethyl-N-β-methanesulfonamideethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, etc.

Also, in addition to the above aromatic primary amine series color developing agents, the color developing solution used in the processing in this invention may optionally further contain various components usually added in the color developing solution, for example, an alkali agent such as sodium hydroxide, sodium carbonate and potassium carbonate, a sulfite of alkali metals, a bisulfite of alkali metals, a thiocyanate of alkali metals, a halogen compound of alkali metals, benzyl alcohol, a water softening agent, a thickening agent, etc. This color developing solution has generally the pH value of 7 or more, most generally about 10 to about 13.

In this invention, after color developing processing, processing by use of a processing solution having fixing ability is carried out. When the processing solution having fixing ability is a fixing solution, a bleaching is carried out beforehand. As a bleaching agent used in the bleaching step, there may be used a metal complex salt of an organic acid. The metal complex salt has an action to oxidize a metal silver formed by development to allow it to revert to silver halide, and, at the same time, color develop an undeveloped portion of a coupler. It has the structure in which a metal ion such as cobalt ion, cupper ion, etc. is coordinated with an organic acid such as an aminopolycarboxylic acid or oxalic acid, citric acid, etc. The organic acid most preferably used for formation of the metal complex salt of such an organic acid may include polycarboxylic acid or aminopolycarboxylic acid. The polycarboxylic acid or aminopolycarboxylic acid may be in the form of an alkali metal salt, an ammonium salt or a water soluble amine salt.

Typical examples of these may include the following:

(1) Ethylenediaminetetraacetic acid
(2) Nitrilotriacetic acid
3) Iminodiacetic acid
(4) Disodium ethylenediaminetetraacetate
(5) Tetra(trimethylammonium) ethylenediaminetetraacetate
(6) Tetrasodium ethylenediaminetetraacetate
(7) Sodium nitrilotriacetate A bleaching solution to be used may contain as the bleaching agent the above metal complex salt of the organic acid, and also contain various additives. Preferably, the additives to be contained may include in particular a re-halgenating agent such as an alkali halide or an ammonium halide, for example, potassium bromide, sodium bromide, sodium chloride, ammonium bromide, etc., a metal salt and a chelating agent. Also, there may be optionally added those which are known to be usually added to a bleaching solution, including a pH buffering agent such as borate, oxalate, acetate, carbonate and phosphate, an alkylamine, a polyethyleneoxide, etc.

Further, the fixing solution and bleach-fixing solution may contain a pH buffering agent including sulfites such as ammonium sulfite, potassium sulfite, ammonium bisulfite, potassium bisulfite, sodium bisulfite, ammonium metabisulfite, potassium metabisulfite and sodium metabisulfite, and boric acid, borax, sodium hydroxide, potassium hydroxide, sodium carbonate, potassium carbonate, sodium bicarbonate, potassium bicarbonate, acetic acid, sodium acetate, ammonium hydroxide, etc., which may be added singularly or in combination of two or more.

When the processing of this invention is carried out while replenishing a bleach-fixing replenishing agent in a bleach-fixing solution (or bath), tee bleach-fixing solution (or bath) may contain a thiosulfate, a thiocyanate or a sulfite, etc., or these salts may be contained in a bleach-fixing replenishing solution which is replenished to the processing bath.

In this invention, if desired, blowing of air or blowing of oxygen may be carried out in the bleach-fixing bath and in a storage tank for the bleach-fixing replenishing solution in order to enhance the activity in the bleach-fixing solution, or a suitable oxidizing agent including, for example, hydrogen peroxide, bromate, persulfate, etc. may be added.

This invention will be described concretely by referring to the following Examples, by which, however, embodiments of this invention are not limited.

EXAMPLE 1

An aqueous solution of silver nitrate and a mixed halide aqueous solution comprising potassium bromide and sodium chloride were mixed in the presence of inert gelatin at 50° C. over a period of 10 minutes according to a double jet method, and thereafter physical ripening was carried out at 50° C. for 60 minutes. Subsequently, the emulsion obtained was subjected to chemical ripening at 50° C. by use of sodium thiosulfate, a sensitizing dye (D-1) and 4-hydroxy-6-methyl-1,3,3a,7-tetrazaindene to obtain an emulsion EM-1. As a result of electron microscopic observation and analysis by X-ray diffraction, EM-1 was found to be an emulsion comprising grains of silver chlorobromide (silver bromide: 90 mole %), having an average grain size of 0.55 μm, a variation coefficient of 0.20, irregular shape, and the value K as defined in the present specification of 0.01.

Next, in the presence of inert gelatin, at 60° C., and in accordance with the double jet method which is carried out while keeping the pAg constant at 7.5, and controlling the rate of addition to a maximum addition rate (which was experimentally determined in advance) at which new grains are no longer produced, an aqueous solution of silver nitrate and a mixed halide aqueous solution comprising potassium bromide and sodium chloride were mixed over a period of 80 minutes to obtain an emulsion EM-2. EM-2 was found to be an emulsion comprising tetradecahedral monodispersed grains of silver chlorobromide (silver bromide: 60 mole %) having an average grain size of 0.50 μm, a variation coefficient of 0.13 and a K value of 80.

Next, EM-2 was divided into two fractions, one of which was subjected to chemical ripening at 55° C. by using sodium thiosulfate, a sensitizing dye (D-1) and 4-hydroxy-6-methyl-1,3,3a,7-tetrazaindene to obtain an emulsion EM-3.

The other fraction of the divided EM-2 was similarly subjected to chemical ripening, provided that the pAg during the course of the chemical ripening and the amounts of addition of sodium thiosulfate and 4-hydroxy-6-methyl-1,3,3a,7-tetrazaindene were varied from those for EM-3 in order to make the sensitivity higher, to obtain an emulsion EM-4 which had higher sensitivity than EM-3.

Next, on a paper support whose surface was coated with polyethylene containing anatase type titanium dioxide, an emulsion layer comprising the above EM-1 and a comparative coupler (M-1) as magenta coupler was provided by coating to have the coating silver weight of 0.4 g/m$^2$, and further on that layer a protective layer comprising gelatin and a hardening agent (H-1) was provided by coating to prepare Sample-1.

Next, Sample-2 was prepared in the same manner as Sample-1, except that the magenta coupler was replaced by a comparative coupler M-2.

Next, Sample-3 to Sample-6 were prepared in the same manner as Sample-1, except that the magenta coupler was replaced by a comparative coupler M-3 and the exemplary compounds 18, 44 and 87 of this invention, respectively, and the coating silver weight was made to be 0.2 g/m$^2$.

Next, Sample-7 and Sample-8 were prepared in the same manner as Sample-2, except that the above EM-3 and EM-4 were used as emulsions, respectively.

(D-1)

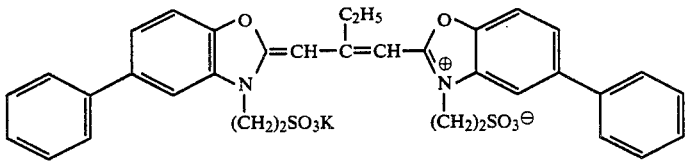

(H-1)

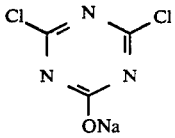

(M-1)

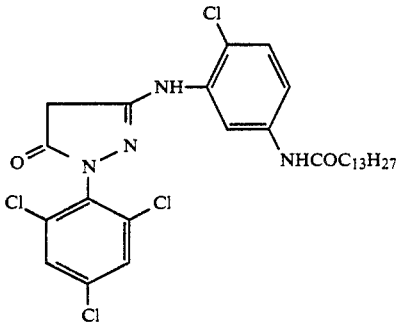

(M-2)

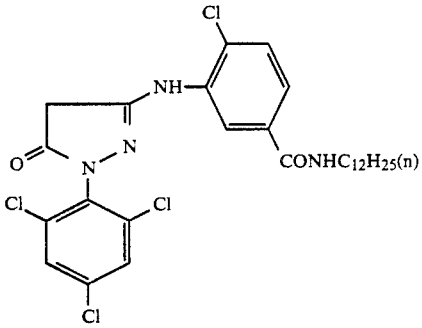

(M-3)

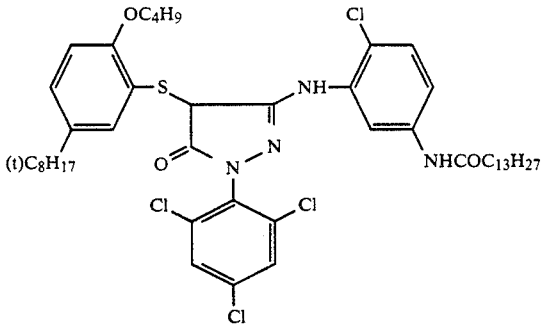

Next, Sample-9, Sample-10 and Sample-11 were prepared in the same manner as Sample-8, except that the exemplary compounds 18, 44 and 87 were used as the magenta coupler and the coating silver weight was made to be 0.20 g/m$^2$.

On Sample-1 to Sample-11 obtained in the above, sensitometry characteristic tests and evaluation of the influence which the secondary absorption of magenta coupler may give to the color reproducibility were carried out according to the methods shown below, in order to confirm the effect of this invention. Results are shown in Table 1.

(1) Sensitometry Characteristic Tests

Eleven kinds of monochromatic photographic elements were exposed to white light through an optical wedge by use of a sensitometer (KS-7 type; manufactured by Konishiroku Photo Industry, Co., Ltd.), and thereafter processing was carried out in accordance with the following processing steps.

Processing Steps

| | | | |
|---|---|---|---|
| [1] | Color developing | 38° C. | 3 min. 30 sec. |
| [2] | Bleach-fixing | 33° C. | 1 min. 30 sec. |
| [3] | Washing with water | 25-30° C. | 3 min. |

-continued

| | | | |
|---|---|---|---|
| [4] | Drying | 75-80° C. | about 2 min. |

Composition Of Processing Solutions

| | |
|---|---|
| (Color developing tank solution) | |
| Benzyl alcohol | 15 ml |
| Ethylene glycol | 15 ml |
| Potassium sulfite | 2.0 g |
| Potassium bromide | 0.1 g |
| Sodium chloride | 0.2 g |
| Potassium carbonate | 30.0 g |
| Hydroxylamine sulfate | 3.0 g |
| Polyphosphorous acid (TPPS) | 2.5 g |
| 3-Methyl-4-amino-N-ethyl-N-(ethyl β-methanesulfonamide)aniline sulfate | 5.5 g |
| Brightening agent (a 4,4'-diaminostylbenzsulfonic acid derivative) | 1.0 g |
| Potassium hydroxide | 2.0 g |
| Made up to one liter in total amount by adding water, and adjusted to pH 10.20. | |
| (Bleach-fixing tank solution) | |
| Ferric ammonium ethylenediaminetetraacetate bihydrate | 60 g |
| Ethylenediaminetetraacetic acid | 3 g |
| Ammonium thiosulfate (70% solution) | 100 ml |
| Ammonium sulfite (40% solution) | 27.5 ml |
| Adjusted to pH 7.1 by use of potassium carbonate or glacial acetic acid, and made up to one liter in total amount by adding water. | |

Density measurement was carried out on each of the samples obtained, by use of a photoelectric densitometer (PDA-60 type; manufactured by Konishiroku Photo Industry, Co., Ltd). Evaluations were made on sensitivity, γ (gamma) and fog. Sensitivity is shown in terms of the relative value of a reciprocal of the exposure which may give the density of fog density plus 0.6; γ is shown in terms of the inclination at the density of 0.5 to 1.5; and fog is shown in terms of the value of the reflection density obtained by subtracting the base density.

(2) Evaluation of the Influence Which the Secondary Absorption of Magenta Dye May Give to the Color Reproduction In respect of Sample-1 to Sample-11, by use of the same sensitometer as used in (1), exposure to white light whose exposure was controlled in such an amount that the spectral reflection density at the maximum absorption wavelength (referred to "λ max") in the visible region of the magenta dye may be about 1.0 was carried out, to which the developing processing in the same manner as in (1) was applied. The optical reflection density was measured on each of the samples obtained, by use of a color analyzer (607 type; manufactured by Hitachi, Ltd), and evaluated in terms of the value for D430/D max shown below:

$$D430/D\lambda max = \frac{\text{Spectral reflection density at 430 nm}}{\text{Spectral reflection density at } \lambda \text{ max}}$$

In this case, the smaller the value for D430/Dλmax is, the more desirable it is evaluated to be from the view point of the color reproducibility.

TABLE 1

| Sample | Emulsion | Magenta coupler | Sensitivity | gamma | fog | D430/Dλmax |
|---|---|---|---|---|---|---|
| Comparative examples: | | | | | | |
| 1 | EM-1 | M-1 | 100 | 3.55 | 0.05 | 0.38 |
| 2 | EM-1 | M-2 | 98 | 3.43 | 0.05 | 0.39 |
| 3 | EM-1 | M-3 | 48 | 3.70 | 0.07 | 0.37 |
| 4 | EM-1 | Comp. 18 | 46 | 3.65 | 0.08 | 0.22 |
| 5 | EM-1 | Comp. 44 | 45 | 3.54 | 0.07 | 0.21 |
| 6 | EM-1 | Comp. 87 | 49 | 3.60 | 0.08 | 0.22 |
| 7 | EM-3 | M-2 | 102 | 3.57 | 0.05 | 0.38 |
| 8 | EM-4 | M-2 | 140 | 3.05 | 0.05 | 0.38 |
| Present invention: | | | | | | |
| 9 | EM-4 | Comp. 18 | 115 | 3.58 | 0.05 | 0.22 |
| 10 | EM-4 | Comp. 44 | 108 | 3.46 | 0.05 | 0.21 |
| 11 | EM-4 | Comp. 87 | 117 | 3.55 | 0.05 | 0.22 |

It is seen from Table 1 that, in the samples using comparative couplers, deterioration in the color reproducibility based on the secondary absorption of magenta dye is remarkable, although there is no problem in the sensitometry characteristics except for Sample-3 and Sample-8. It is seen that Sample-3 and Sample-8 is insufficient in both the sensitometry characteristics and the color reproducibility. Also, in the comparative samples in which the magenta couplers of this invention were used, Sample-4, Sample-5 and Sample-6 which comprise combination with silver halide grains other than those of this invention have problems in the sensitivity and the fog, although the color reproducibility is good. On the other hand, it is seen that Sample-9, Sample-10 and Sample-11 which are in accordance with the constitution of this invention are satisfactory in both the color reproducibility and the sensitometry characteristics.

It is also seen that, according to this invention, still higher sensitivity can be achieved than that in the comparative examples according to conventional arts, without being accompanied with deterioration of the gradation characteristics. EM-4, though having high sensitivity, has been regarded as an emulsion which could not be put into practical use because of its problem in the gradation when used in combination with the conventional pyrazolone series magenta couplers. However, it has become possible to use it in combination with the magenta couplers of this invention. This had not been expected from the data for Sample-2, Sample-7, Sample-8, etc., and was realized to be an unexpected effect this invention has brought about.

EXAMPLE 2

Using EM-1, prepared in Example 1, as a green sensitive emulsion, and using (M-1) as a magenta coupler, the respective layers as shown in Table 2 were provided by coating on a paper-made support whose surface was coated with polyethylene containing anatase type titanium dioxide to prepare a multi-layer light-sensitive silver halide color photographic material, which was designated as Sample-12. In this sample, the third layer was made to have the coating silver weight of 0.38 g/m$^2$.

Next, using the magenta coupler of Exemplary Compound No. 59, Sample-13 was prepared in the same manner as Sample-12, except that the third layer was made to have the coating silver weight of 0.19 g/m$^2$.

Next, EM-5 was prepared in the same manner as EM-1 in Examples 1, except that the temperature for mixing a silver ion solution and a halide ion solution during the course of formation of silver halide grains and the temperature for physical ripening was altered to 60° C. Here, EM-5 had an average grain size of 0.71 μm, a variation coefficient of 0.19, irregular shape and a K value of 0.01.

Next, in the same manner as EM-2 except that the proportion of potassium bromide and sodium chloride in the halide aqueous solution was varied and the pAg during the growth of silver halide grains was controlled to 8.3, a monodispersed emulsion (having a crystal habit of substantially octahedron) of silver chlorobromide (silver bromide: 80 mole %), having an average grain size of 0.52 μm, a variation coefficient of 15% and a K value of $10^{-4}$.

This emulsion was subjected to chemical ripening in the same manner as EM-3 to obtain an emulsion EM-6.

Next, in the same manner as EM-6 except that the pAg during the growth of silver halide grains was controlled to 5.0, a green sensitive emulsion EM-7 was obtained, which is comprised of cubic monodispersed grains having an average grain size of 0.51 μm, a variation coefficient of 0.09 and a K value of $10^4$.

Next, in the same manner as EM-6 except that the pAg during the growth of silver halide was controlled to 7.5, a green sensitive emulsion EM-8 was obtained, which is comprised of tetradecahedral monodispersed grains having an average grain size of 0.50 μm, a variation coefficient of 0.12 and a K value of 70 was obtained.

Next, Sample-14 to Sample-17 were prepared in the same manner as Sample-17, except that EM-5, EM-6, EM-7 and EM-8 were respectively used as green sensitive emulsions.

TABLE 2

| | |
|---|---|
| Seventh layer: | Gelatin |
| | Hardening agent (H-1) |
| Sixth layer: | Ultraviolet absorbent (UV-1) |
| | Gelatin |
| Fifth layer: | Red sensitive silver chlorobromide emulsion (silver bromide: 60 mole %, coating silver weight: 0.25 g/m$^2$) |
| | Cyan coupler (C-1) |
| | Dioctylphthalate |
| | Gelatin |
| Fourth layer: | Ultraviolet absorbent (UV-1) |
| | Gelatin |
| Third layer: | Blue sensitive emulsion |
| | Magenta coupler |
| | Dioctylphthalate |
| | Gelatin |

TABLE 2-continued

| | |
|---|---|
| Second layer: | Gelatin |
| First layer: | Blue sensitive silver chlorobromide emulsion (silver bromide: 90 mole %, coating silver weight: 0.35 g/m$^2$) |
| | Yellow coupler (Y-1) |
| | Dioctylphthalate |
| | Gelatin |
| | Support |

The light-sensitive silver halide color photographic materials, Sample-12 to Sample-17, prepared as above were treated in the same manner as in Example 1, and, on the color images obtained, evaluations for the sensitometry characteristics and the color reproducibility were made according to the following method:

(1) Sensitometry Characteristics Test

Evaluation of sensitometry characteristics was made in the same manner as in Example 1, except that an ultraviolet cut filter and a sensitivity correction filter were used when exposure was carried out. In Table 3, however, there are shown only the sensitivity and the fog value based on values obtained by measuring the density by use of green light.

(2) Evaluation of the Color Reproducibility (i) Evaluation of influence to color reproducibility by blue light-sensitivity of green sensitive emulsion:

On the six kinds of multi-layered materials, Sample-12 to Sample-17, exposure treatment and density measurement were carried out in the same procedures as show in Example 1, except that the exposure to blue light was effected through Kodak Wratten filter No. 47B and an ultraviolet cut filter. The influence to blue sensitivity was evaluated in terms of magenta dye density (density of reflection of green light) $D_M{}^B$. Herein, the smaller the value for $D_M{}^B$ is, it follows that the less the magenta dye color-develops is, and can h=said to be desirable.

(ii) Evaluation of influence to color reproducibility by the secondary absorption of magenta dye:

On the six kinds of multi-layered materials, Sample-12 to Sample-17, D430/D λmax was determined in the same manner as in item (2) in Example 1, except that the exposure to green light was effected through Kodak Wratten filter No. 61 and an ultraviolet cut filter. Herein also, the smaller the secondary absorption of magenta coupler is, and can be said to be desirable from the viewpoint of the color reproducibility.

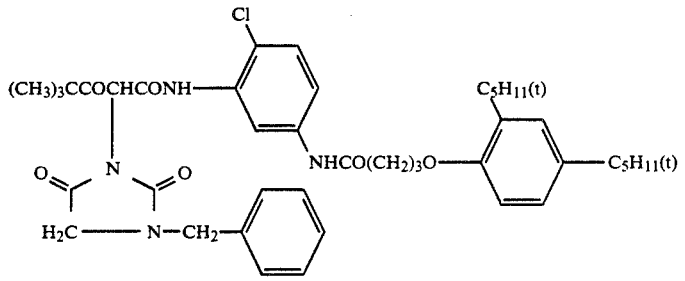

(Y-1)

-continued

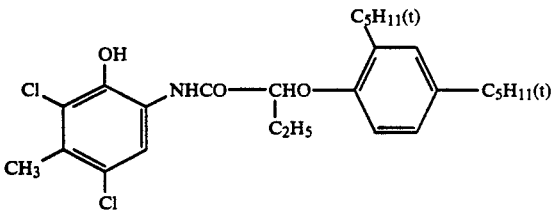

(C-1)

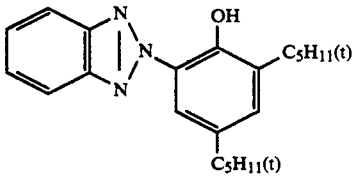

(UV-1)

TABLE 3

| Sample No. | Green sensitive emulsion | Magenta coupler | Green light-sensitivity | Fog (Green light density | $D_M^B$ | D430/ Dλmax |
|---|---|---|---|---|---|---|
| Comparative examples: | | | | | | |
| 12 | EM-1 | M-1 | 100 | 0.05 | 0.51 | 0.39 |
| 13 | EM-1 | Comp. 59 | 61 | 0.07 | 0.35 | 0.22 |
| 14 | EM-5 | Comp. 59 | 102 | 0.08 | 0.68 | 0.22 |
| 15 | EM-6 | Comp. 59 | 85 | 0.06 | 0.41 | 0.22 |
| Present invention: | | | | | | |
| 16 | EM-7 | Comp. 59 | 115 | 0.06 | 0.25 | 0.22 |
| 17 | EM-8 | Comp. 59 | 117 | 0.05 | 0.27 | 0.22 |

As will be seen from Table 3, Sample-13 shows low sensitivity because of use of the magenta coupler of this invention, but Sample-14 in which the low sensitivity was corrected by increasing the size of silver halide grains shows increase in the blue light-sensitivity, and is undesirable from the viewpoint of the color reproducibility. Also, in the case (Sample-15) where silver halide grains having little (100) face, even though having the same monodispersed grains, the blue light-sensitivity is undesirably higher in proportion to lowness in the green light-sensitivity. Accordingly, it is seen that it is possible only in this invention to obtain the light-sensitive silver halide color photographic materials having high sensitivity, low fog and excellent color reproducibility (namely, the blue light-sensitivity of green sensitive emulsion is low and the secondary absorption of magenta dye is small).

We claim:

1. A light-sensitive silver halide color photographic material, having at least one light-sensitive silver halide emulsion layer on a support, wherein at a least one of said emulsion layer contains monodispersed light-sensitive silver halide grains substantially consisting of silver chlorobromide grains having a grain size distribution of silver halide grains with a variation coefficient of 0.22 or less and outer surfaces principally comprised of {100} face; and a magenta dye image forming coupler represented by Formula (I) shown below:

Formula (I):

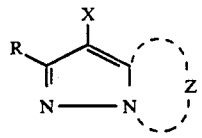

wherein Z represents a group of nonmetal atoms necessary for formation of a nitrogen-containing hetero ring; said ring formed by Z may have a substituent; X represents a hydrogen atom or a substituent eliminable through the reaction with an oxidation product of a color developing agent; and R represents a hydrogen atom or a substituent.

2. The light-sensitive silver halide color photographic material according to claim 1, wherein the coupler represented by Formula (I) is a coupler selected from the couplers represented by Formulas (II) to (VII) shown below:

Formula (II)

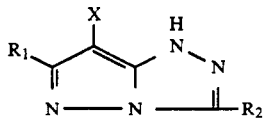

Formula (III)

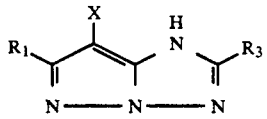

Formula (IV)

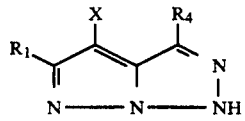

Formula (V)

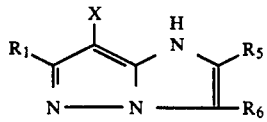

Formula (VI)

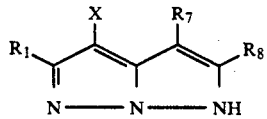

-continued

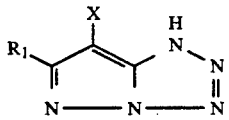

Formula (VII)

wherein $R^1$ to $R^8$ and X each have the same meaning as R and X in Formula (I).

3. The light-sensitive silver halide color photographic material according to claim 1, wherein the coupler represented by Formula (I) is a coupler represented by Formula (VIII) shown below:

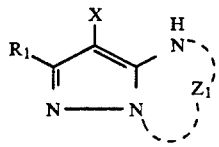

Formula (VIII)

wherein $R^1$, X and $Z^1$ each have the same meaning as R, X and Z in Formula (I).

4. The light-sensitive silver halide color photographic material according to claim 1, wherein the substituent represented by R in Formula (I) is a substituent represented by Formula (IX) shown below:

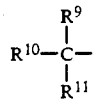

Formula (IX)

wherein $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

5. The light-sensitive silver halide color photographic material according to claim 4, wherein two of $R^9$ to $R^{11}$ are each an alkyl group.

6. The light-sensitive silver halide color photographic material according to claim 4, wherein one of $R^9$ to $R^{11}$ is a hydrogen atom, and the other two are bonded to form a cycloalkyl together with the root carbon atom.

7. The light-sensitive silver halide color photographic material according to claim 2, wherein the coupler represented by Formula (I) is the coupler represented by Formula (II).

8. The light-sensitive silver halide color photographic material according to claim 1, wherein the substituent possessed by the ring to be formed by Z in Formula (I) is a substituent represented by Formula (X) shown below:

$$-R^1-SO_2-R^2$$

Formula (X)

wherein $R^1$ represents an alkylene group, $R^2$ represents an alkyl group, a cycloalkyl group or an aryl group.

9. The light-sensitive silver halide color photographic material according to claim 1, wherein the coupler represented by Formula (I) is a coupler represented by Formula (XI) shown below:

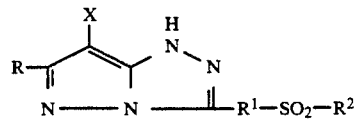

Formula (XI)

wherein R and X each have the same meaning as R and X in Formula (I), $R^1$ represents an alkylene group, and $R^2$ represents an alkyl group, a cycloalkyl group or an aryl group.

10. The light-sensitive silver halide color photographic material according to claim 1, wherein the coupler of Formula (I) is used in an amount ranging between $1\times10^{-3}$ mole and 1 mole per mole of silver halide.

11. The light-sensitive silver halide color photographic material according to claim 1, wherein said light-sensitive silver halide grains are tetradecahedral silver halide grains satisfying the relationship of $0.5 < K \leqq 50{,}000$ when represented by K = (Intensity of diffraction rays assigned to {200} face)/(Intensity of diffraction rays assigned to {222} face).

12. The light-sensitive silver halide color photographic material according to claim 1, where said light-sensitive silver halide grains are substantially cubic or tetradecahedral grains satisfying the relationship of $5 < K$, where K = (Intensity of diffraction rays assigned to (200) face/(Intensity of diffraction rays assigned to (111) face).

13. The light-sensitive silver halide color photographic material according to claim 1, wherein said light-sensitive silver halide grains have an average grain size ranging between 0.2 and 0.8 μm.

14. The light-sensitive silver halide color photographic material according to claim 1, wherein said light-sensitive silver halide emulsion layer further contains an image stabilizing agent selected from the compounds reresented by Formulas (A) to (H), (J) and (K) shown below:

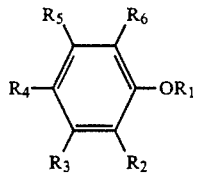

Formula (A)

wherein $R^1$ represents a hydrogen atom, an alkyl group, an alkenyl group, an aryl group or a heterocyclic group; $R^2$, $R^3$, $R^5$ and $R^6$ each represent a hydrogen atom, a halogen atom, a hydroxyl group, an alkyl group, an alkenyl group, an ary group, an alkoxy group or an acylamino group; $R^4$ represents an alkyl group, a hydroxyl group, an aryl group or an alkoxy group;

Formula (B)

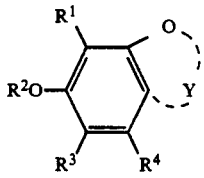

wherein, $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^2$ represents a hydrogen atom, an alkyl group, an alkenyl group, an aryl group an acyl group, a cycloalkyl group or a heterocyclic group; $R^3$ represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group; and Y represents a group of atoms necessary for formation of a chroman or coumaram ring.

Formula (C)

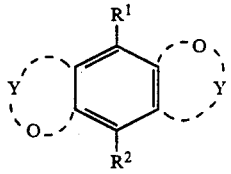

Formula (D)

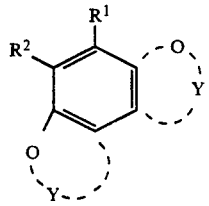

wherein $R^1$ and $R^2$ each represent a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group; and Y represents a group of atoms necessary for forming a dichroman or dicoumaran ring together with a benzene ring;

Formula (E)

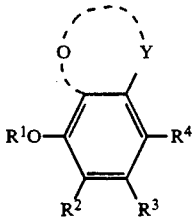

wherein, $R^1$ represents a hydrogen atom, an alkyl group, an alkenyl group, an aryl group, an acyl group, a cycloalkyl group or a heterocyclic group; $R_3$ represents a hydrogen atom, a halogen atom, an alkyl group, an alkenyl group, an aryl group, an aryloxy group, an acyl group, an acylamino an acyloxy group, a sulfonamide group, a cycloalkyl group or an alkoxycarbonyl group; $R^2$ and $R^4$ each represents a hydrogen atom, a halogen atom, an alkyl group, an alkenyl group, an aryl group, an acyl group, an acylamino group, a sulfonamide group, a cycloalkyl group or an alkoxycarbonyl group; and Y represents a group of atoms necessary for formation of a chroman or coumaran ring;

Formula (F)

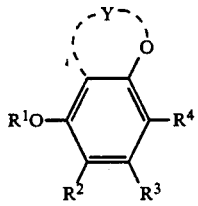

wherein $R^1$ represents a hydrogen atom, an alkyl group, an alkenyl group, an acyl group, a cycloalkyl group or a heterocyclic group; $R^2$ represents a hydrogen atom, a halogen atom, an alkyl group, an alkenyl group, an aryl group, aryloxy group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an aryl group, an acyl group, an acylamino group, a sulfonamide group, a cycloalkyl group or an alkoxycarbonyl group; $R^4$ represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group; and Y represents a group of atoms necessary for formation of a chroman or coumaran ring.

Formula (G)

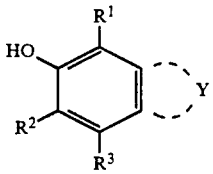

wherein $R^1$ and $R^3$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; $R^2$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group; and Y represents a group of atoms necessary for formation of an indane ring;

Formula (H)

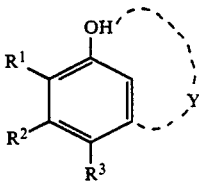

wherein, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group; $R^3$ represents a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group; and Y represents a group of atoms necessary for formation of an indane ring;

Formula (J)

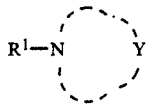

wherein $R^1$ represents an aliphatic group, a cycloalkyl group or an aryl group; and Y represents a group of nonmetal atoms necessary for forming a heterocyclic ring of 5 to 7 members together with a nitrogen atom; provided that, when two or more hetero atoms are present in the nonmetal atom containing a nitrogen atom for forming the heterocyclic ring, at least two hetero atoms are hetero atoms which are not contiguous to each other; and Formula (K)

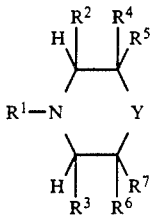

wherein $R^1$ represents an aliphatic group; Y represents a simple bond arm or a divalent hydrocarbon group necessary for forming a heterocyclic ring of 5 to 7 members together with a nitrogen atom; and $R^2$, $R^3$, $R^4$, $R^5$, $R^6$ and $R^7$ each represent a hydrogen atom, an aliphatic group, a cycloalkyl group or an aryl group.

15. The light-sensitive silver halide color photographic material according to claim 14, wherein said image stabilizing agent is contained in an amount ranging between 5 and 300 mole % based on the magenta coupler represented by Formula (I).

16. The light-sensitive silver halide color photographic material according to claim 15, wherein the coupler represented by Formula (I) is a coupler selected from the couplers represented by Formulas (II) to (VII) shown below:

Formula (II)

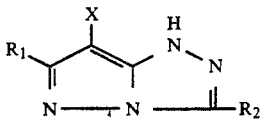

Formula (III)

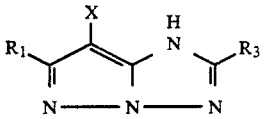

Formula (IV)

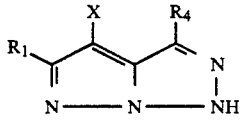

Formula (V)

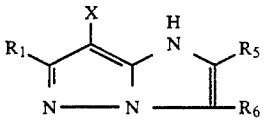

Formula (VI)

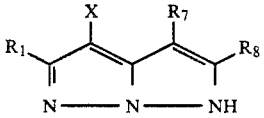

Formula (VII)

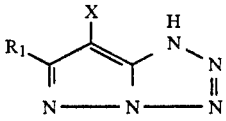

wherein $R^1$ to $R^8$ and X each have the same meaning as R and X in Formula (I).

17. The light-sensitive silver halide color photographic material according to claim 16, wherein said light-sensitive silver halide grains are substantially cubic or tetradecahedral grains satisfying the relationship of $5 < K$, where K = (Intensity of diffraction rays assigned to (200) face/(Intensity of diffraction rays assigned to (111).

* * * * *